US012799845B2

(12) United States Patent
Gunasekaran et al.

(10) Patent No.: US 12,799,845 B2
(45) Date of Patent: Nov. 17, 2026

(54) DOWNHOLE DEVICE EMPLOYING AN ELECTROMAGNET ASSEMBLY AND FERROMAGNET ASSEMBLY TO ACTUATE A MECHANICAL CONNECTING APPARATUS

(71) Applicant: Halliburton Energy Services, Inc., Houston, TX (US)

(72) Inventors: Mohan Gunasekaran, Al-Khobar (SA); Luis Herrera-Cruz, Houston, TX (US); Charles David McFate, Houston, TX (US); Hassan Mansir, Frimley (GB); James Dan Vick, Jr., Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/424,876

(22) Filed: Dec. 18, 2025

(65) Prior Publication Data

US 2026/0168355 A1 Jun. 18, 2026

Related U.S. Application Data

(60) Provisional application No. 63/902,146, filed on Oct. 20, 2025, provisional application No. 63/735,424, filed on Dec. 18, 2024.

(51) Int. Cl.
*E21B 34/06* (2006.01)

(52) U.S. Cl.
CPC ..... *E21B 34/066* (2013.01)

(58) Field of Classification Search
CPC ..... E21B 34/066; E21B 41/00; E21B 34/12
See application file for complete search history.

(56) References Cited

U.S. PATENT DOCUMENTS 4,191,248 A 3/1980 Huebsch et al.
5,076,114 A * 12/1991 Moody ..... F16C 1/10 335/286
7,487,829 B2 2/2009 McDonald et al.
(Continued)

FOREIGN PATENT DOCUMENTS

WO 2020023018 A1 1/2020

*Primary Examiner* — Shane Bomar
(74) *Attorney, Agent, or Firm* — Scott Richardson; Parker Justiss, P.C.

(57) ABSTRACT

Provided is a downhole device, method, and well system. The downhole device, in one aspect, includes a first portion, the first portion including an electromagnet assembly coupled thereto, and a second portion, the second portion including a valve closure mechanism and a bore flow management actuator, the bore flow management actuator configured to slide from a first position to a second position to move the valve closure mechanism between a closed state and an open state. The downhole device further includes a third portion, the third portion including a mechanical connecting apparatus coupled to the bore flow management actuator and having a ferromagnet assembly coupled thereto, the electromagnet assembly operable to receive electric power to produce an electromagnetic field having an electromagnetic polarity (Y) configured to magnetically engage with the ferromagnet assembly to actuate the mechanical connecting and slide the bore flow management actuator.

44 Claims, 72 Drawing Sheets

(56) References Cited

U.S. PATENT DOCUMENTS

| | | | | |
|---|---|---|---|---|
| 10,724,332 | B2 | 7/2020 | Henschel, Jr. et al. | |
| 2002/0153982 | A1* | 10/2002 | Jones | H01F 7/122 335/220 |
| 2006/0226728 | A1* | 10/2006 | Pal | H02K 7/1884 310/180 |
| 2008/0053662 | A1 | 3/2008 | Williamson et al. | |
| 2009/0206290 | A1 | 8/2009 | Wygnanski | |
| 2009/0218096 | A1* | 9/2009 | Vick, Jr. | E21B 34/10 166/250.15 |
| 2011/0080060 | A1 | 4/2011 | Camacho | |
| 2011/0120727 | A1* | 5/2011 | Lake | F16K 31/082 166/66.7 |
| 2011/0120728 | A1* | 5/2011 | Lake | E21B 34/066 137/1 |
| 2013/0333872 | A1 | 12/2013 | McMillon et al. | |
| 2016/0265309 | A1 | 9/2016 | Vick, Jr. | |
| 2017/0241246 | A1* | 8/2017 | Hamnsberger | H02K 1/34 |
| 2018/0163657 | A1* | 6/2018 | Hauser | F02D 41/20 |
| 2020/0270965 | A1 | 8/2020 | Vick, Jr. et al. | |
| 2021/0115759 | A1* | 4/2021 | Ng | E21B 34/066 |
| 2022/0109361 | A1* | 4/2022 | Johnson | H02K 33/18 |
| 2023/0399919 | A1 | 12/2023 | Passmore et al. | |
| 2023/0417123 | A1 | 12/2023 | Wood et al. | |
| 2025/0207493 | A1* | 6/2025 | Gunasekaran | E21B 34/066 |
| 2025/0305387 | A1 | 10/2025 | Mallawany | |

* cited by examiner

700

700

700

DOWNHOLE DEVICE EMPLOYING AN ELECTROMAGNET ASSEMBLY AND FERROMAGNET ASSEMBLY TO ACTUATE A MECHANICAL CONNECTING APPARATUS

CROSS-REFERENCE TO RELATED APPLICATION

This application claims the benefit of U.S. Provisional Application Ser. No. 63/735,424, filed on Dec. 18, 2024, entitled "SAFETY VALVE WITH ELECTROMAGNET FOR A WELLBORE," and U.S. Provisional Application Ser. No. 63/902,146, filed on Oct. 20, 2025, entitled "SAFETY VALVE WITH ELECTROMAGNET FOR A WELLBORE," both of which are commonly assigned with this application and incorporated herein by reference in its entirety.

BACKGROUND

Downhole devices, such as safety valves (e.g., downhole subsurface safety valves (SSSVs)), among others, are well known in the oil and gas industry and provide one of many failsafe mechanisms to prevent the uncontrolled release of subsurface production fluids, should a wellbore system experience a loss in containment. In certain instances, safety valves comprise a portion of a tubing string, the entirety of the safety valve being set in place during completion of a wellbore. In other instances, the safety valves are wireline deployed/retrieved after the tubing string is positioned in the wellbore. Although a number of design variations are possible for safety valves, the vast majority are flapper-type valves or ball-type valves that open and close in response to lateral (e.g., longitudinal) movement of a movable element (e.g., flow control tube in the case of a flapper-type valve).

Since safety valves typically provide a failsafe mechanism, the default positioning of the safety valve is usually closed, in order to minimize the potential for inadvertent release of subsurface production fluids. The safety valves are typically opened through various means of control from the earth's surface, in order to provide a flow pathway for production to occur. What is needed in the art is an improved downhole device that does not encounter the problems of existing downhole devices.

BRIEF DESCRIPTION

Reference is now made to the following descriptions taken in conjunction with the accompanying drawings, in which:

FIGS. 2A through 2K illustrate different simplistic views of a downhole device designed, manufactured and/or operated according to one or more embodiments of the disclosure during different operational states;

Figure 7A:
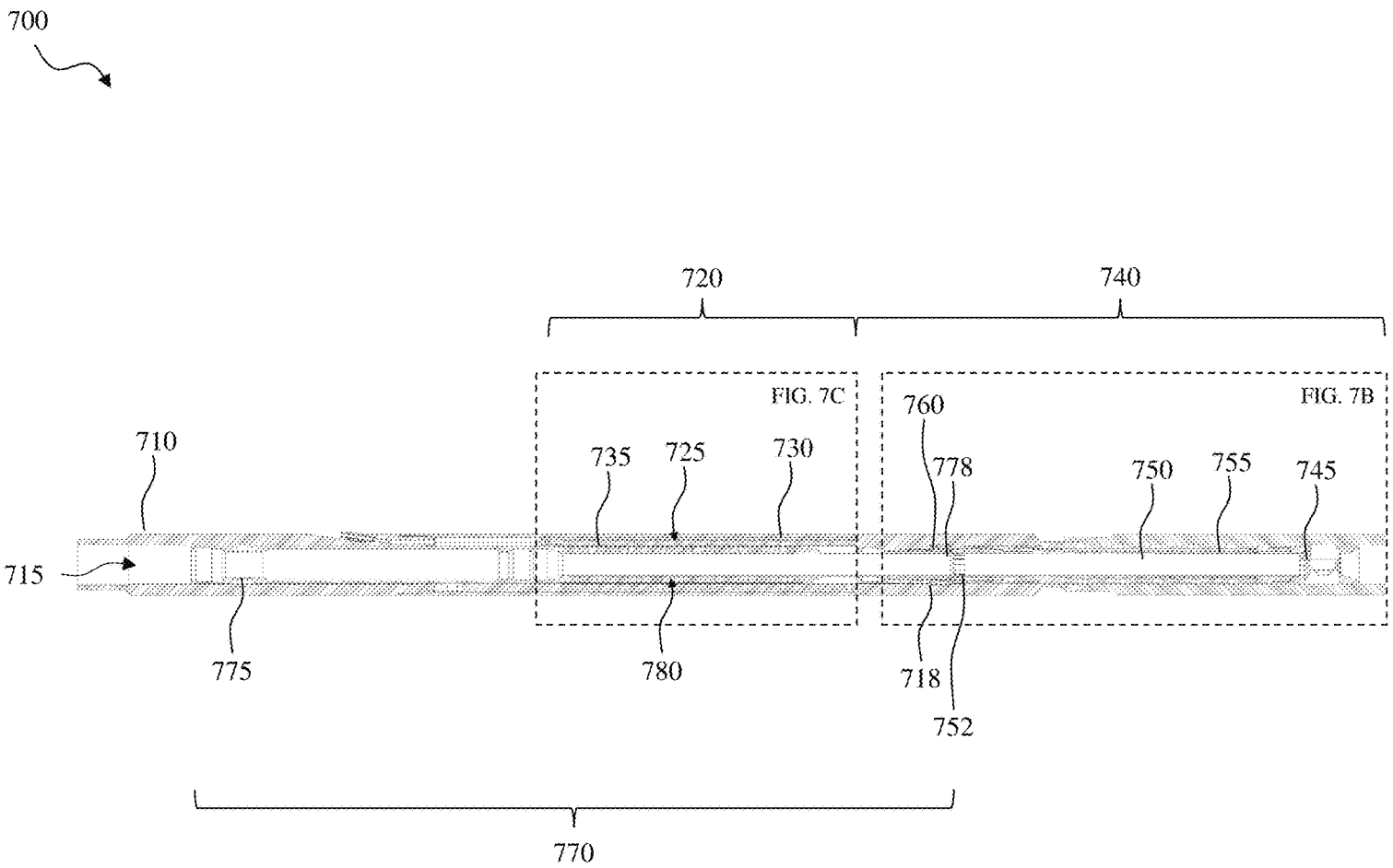
Figure 7B:
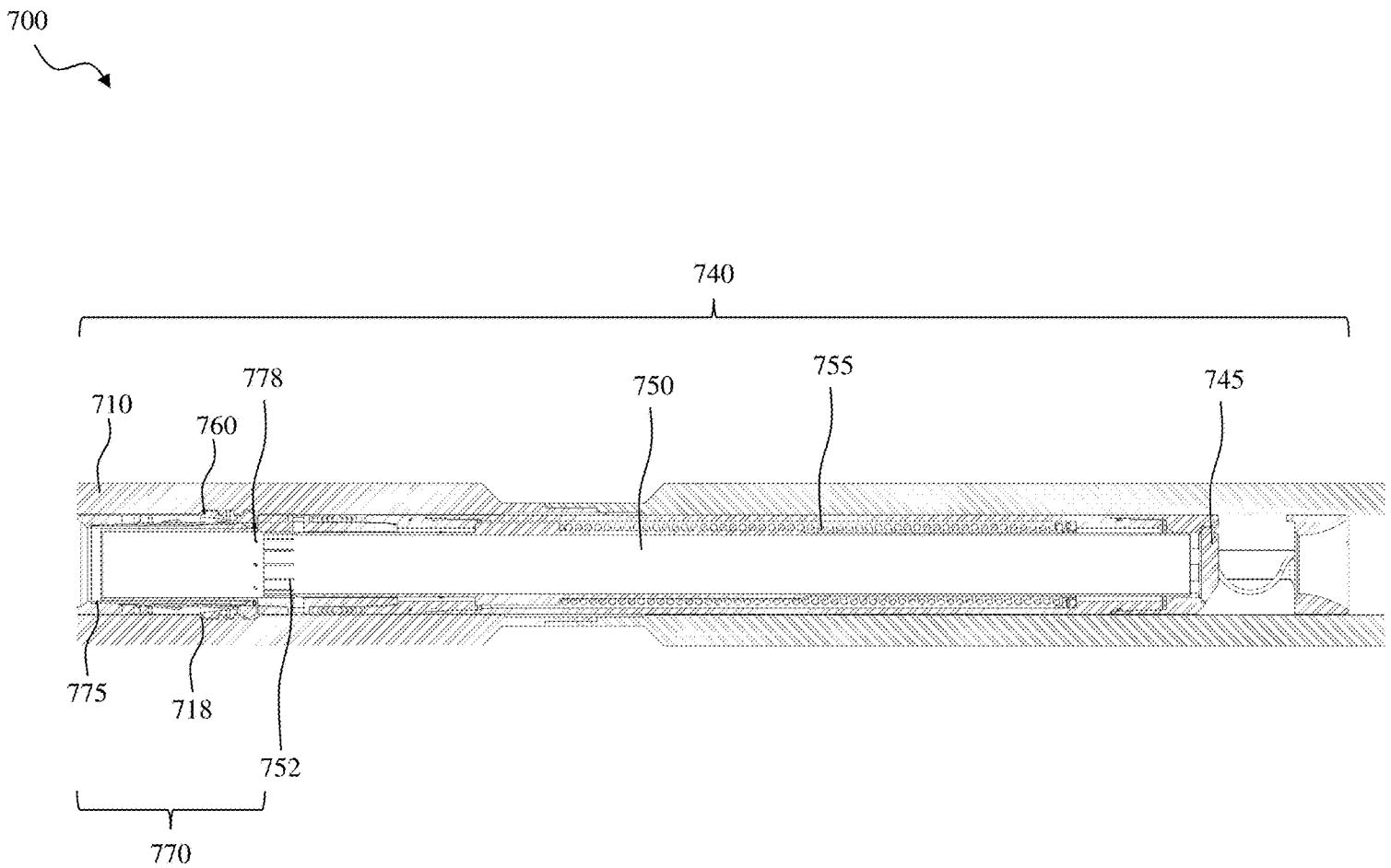
Figure 7C:
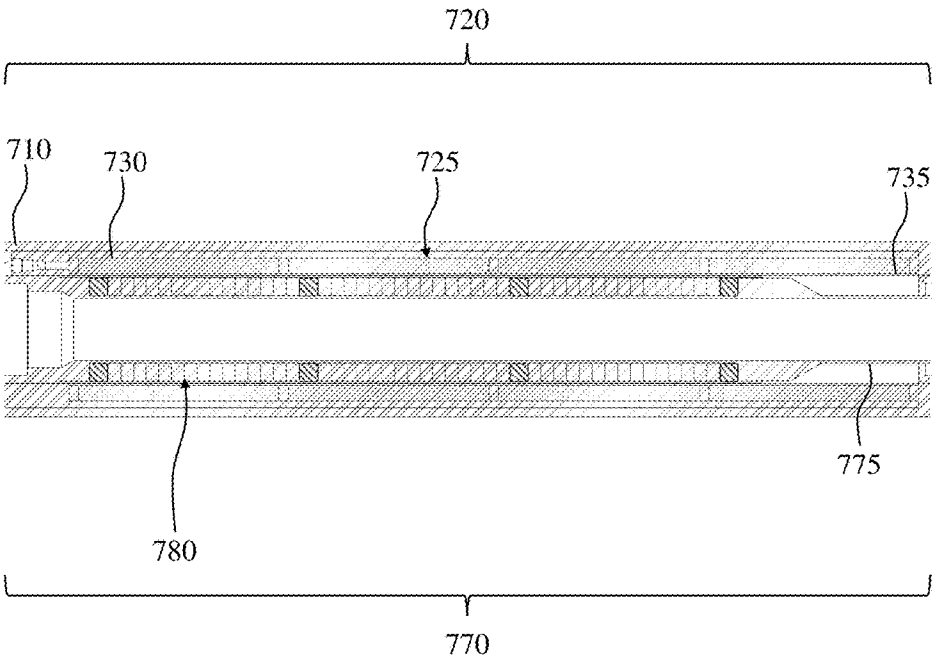

FIGS. 5A through 5H illustrate different cross-sectional views of a downhole device designed, manufactured and/or operated according to one or more alternative embodiments of the disclosure during different operational states; and FIGS. 6A through 6H illustrate different cross-sectional views of a downhole device designed, manufactured and/or operated according to one or more alternative embodiments of the disclosure during different operational states;

FIGS. 7A through 7C illustrate different cross-sectional views of a downhole device designed, manufactured and/or operated according to one or more alternative embodiments of the disclosure; and FIGS. 8A through 12C illustrate different cross-sectional views of a downhole device designed, manufactured and/or operated according to one or more alternative embodiments of the disclosure during different operational states.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown for the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term "or," as used herein, refers to a non-exclusive or, unless otherwise indicated.

Unless otherwise specified, use of the terms "connect," "engage," "couple," "attach," "fixed," or any other like term describing an interaction between elements, is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

Various values and/or ranges may be explicitly disclosed in certain embodiments herein. However, values/ranges from any lower limit may be combined with any upper limit to recite a range not explicitly recited. Similarly, values/ranges from any lower limit may be combined with any other lower limit to recite a range not explicitly recited. In the same way, values/ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from a to b," or, equivalently, "from about a to about b," or, equivalently, "from approximately a to b," or, equivalently, "from approximately a-b") disclosed herein is to be understood to set forth every number and range encompassed within the broader range of values, even if not explicitly recited. Thus, every point or individual value may serve as its own lower or upper limit, combined with any other point or individual value or any other lower or upper limit, to recite a range not explicitly recited. Similarly, any individual value disclosed herein may be combined with another individual value or range disclosed herein to form another range.

The present disclosure is based, at least in part, on the physics of electromagnetism, and how specifically electromagnetism may be employed to actuate a movable element of a downhole device. As those skilled in the art appreciate, similar poles of separate magnets (e.g., whether of permanent magnet assemblies or electromagnet assemblies) repel one another, whereas opposite poles of those same magnets (e.g., whether of permanent magnet assemblies or electromagnet assemblies) attract one another.

With the foregoing in mind, the present disclosure has developed a downhole device that employs one or more electromagnet assemblies that magnetically engage with one or more ferromagnet assemblies (e.g., permanent magnet assemblies with inherent magnetic fields, in one embodiment). The collection of the one or more electromagnet assemblies and the one or more ferromagnet assemblies (e.g., permanent magnet assemblies with inherent magnetic fields, in one embodiment) may be used to actuate the movable element from a first position toward a second position when the one or more electromagnet assemblies receive electric power. In at least one embodiment, an electromagnetic field produced by the powered one or more electromagnet assemblies independently hold the movable element in the second position when the one or more electromagnet assemblies receive the electric power. The phrase "independently holds," as used herein, means that it holds without the need for a separate retention mechanism (e.g., separate mechanical retention feature), such as a collet, snap ring, etc. The present disclosure has pinpointed that such separate retention mechanisms have significant safety concerns, which very well may exclude their use in such applications downhole. Any reference to a need for a retention mechanism, or any benefits from using such a retention mechanism, would clearly be considered directly contrary to this disclosure, and a direct teaching away from any claim of a downhole device having one or more powered electromagnet assemblies that independently hold the movable element in the second position when the electromagnet assembly receives the electric power.

Notwithstanding the foregoing, the present disclosure has recognized that the electric power required to maintain the movable element in the second position may be significant, even though it is a drastic improvement (e.g., reliability and safety improvements) to the aforementioned separate retention mechanism. With this recognition in mind, the present disclosure contemplates employing one or more permanent magnet assemblies with inherent magnetic fields as the one or more ferromagnet assemblies. Thus, in at least this embodiment, the downhole device might include a permanent magnet assembly fixed to one of the member or the movable element, the permanent magnet assembly producing an inherent magnetic field having a magnetic polarity (X), the permanent magnet assembly generating a magnetic coupling force that biases the movable element toward its first position (e.g., closed position). Further to this embodiment, the downhole device might include an electromagnet assembly fixed to an other of the movable element or the member, the electromagnet assembly operable to receive electric power to produce an electromagnetic field having an electromagnetic polarity (Y) similar in direction to the magnetic polarity (X). The phrase "similar in direction", as used herein with regard to the polarity, means that the North-pole (N-pole) of the electromagnet assembly and the N-pole of the permanent magnet assembly are pointed more away from one another than toward one another, and similarly the South-pole (S-pole) of the electromagnet assembly and the S-pole of the permanent magnet assembly are pointed more away from one another than toward one another. In accordance with this embodiment, the electromagnetic field is configured to generate an opposite electromagnetic coupling force greater than the magnetic coupling force to actuate the movable element from the first position toward the second position (e.g., open position) when the electromagnet assembly receives the electric power.

Having made the above recognitions, the present disclosure has further recognized that if the magnetic coupling force and relative positions of the permanent magnet assembly and the electromagnet assembly are set appropriately along a stroke distance (D), a required electric power needed to generate the opposite electromagnetic coupling force greater than the magnetic coupling force to actuate the movable element decreases as the movable element moves from the first position to the second position. In fact, the electric power required to begin the actuation may be 10% greater, if not 20%, 30%, 40%, 50%, 75%, 100%, 150%, 200%, 300%, 400%, 500% greater than the electric power required to complete the actuation as the movable element approaches the second position. With this in mind, the present disclosure envisions, reducing the electric power as the movable element approaches the second position, or at a minimum reducing the electric power when the movable element is at the second position to hold (e.g., independently hold in one embodiment) the movable element in the second position when the electromagnet assembly continues to receive the electric power. As will be understood fully below, a significant degree of planning and experimentation has gone into determining where to position the stroke distance (D) of the downhole device (e.g., in relation to the magnetic coupling force and relative positions of the permanent magnet assembly and the electromagnet assembly), for example to achieve the ability to reduce the electric power.

In at least one embodiment, the downhole device additionally includes a separate energy storage element, such as a spring element, coupled with the movable element, the separate energy storage element generating a return force that biases the movable element toward the first position. In this embodiment, the electromagnet assembly would need to be designed, manufactured and/or operated in such a way as to generate the opposite electromagnetic coupling force greater than the magnetic coupling force and the return force to actuate the movable element. Furthermore, in at least one embodiment the magnetic coupling force, the return force, and the relative positions of the permanent magnet assembly and the electromagnet assembly could be set along the stroke distance (D) such that the required electric power needed to generate the opposite electromagnetic coupling force greater than the magnetic coupling force and the return force to actuate the movable element decreases as the movable element moves from the first position to the second position, as discussed above.

Figure 1:
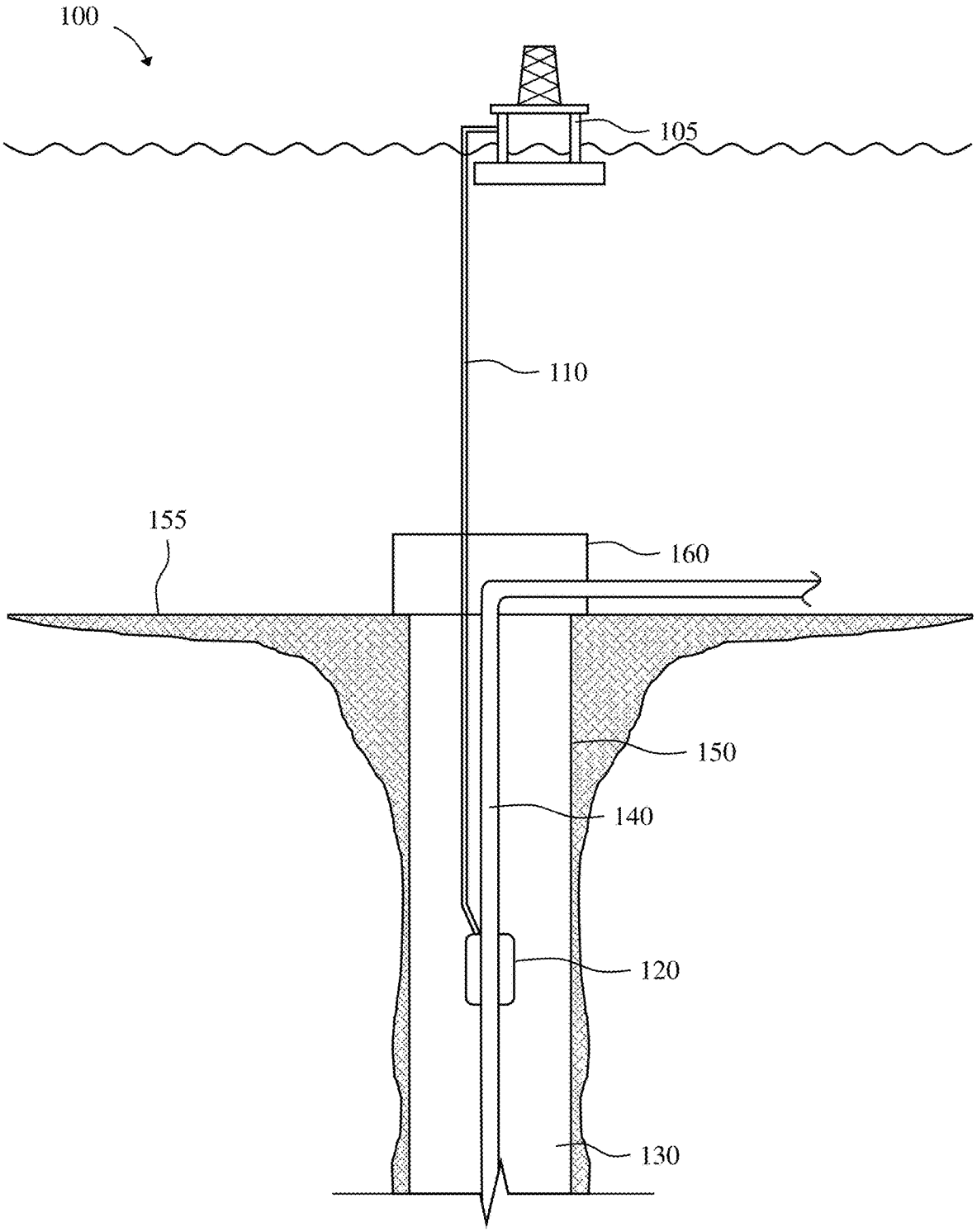
FIG. 1 illustrates a well system designed, manufactured and/or operated according to one or more aspects of the disclosure.

Turning to FIG. 1, illustrated is a well system 100 designed, manufactured and/or operated according to one or more aspects of the disclosure. In the illustrated embodiment, the well system 100 includes an offshore platform 105 connected to a downhole device 120, for example via an electrical connection 110. An annulus 130 may be defined between the walls of wellbore 150 (e.g., extending through one or more subterranean formations) and a conduit 140. A wellhead 160, for example positioned at the surface 155 of the wellbore 150, may provide a means to hand off and seal the conduit 140 against the wellbore 150 and provide a profile to latch a subsea blowout preventer to. The conduit 140 may be coupled to the wellhead 160. The conduit 140 may be any conduit such as a casing, liner, production tubing, or other tubulars disposed in a wellbore. While the electrical connection 110 is illustrated as being connected to an offshore platform, the electrical connection 110 may be connected to any type of completion without departing from the disclosure. In at least one embodiment, the electrical connection 110 is a tubing encapsulated conductor (TEC), if not one or more TECs.

The downhole device 120, in one or more embodiments, may be interconnected in the conduit 140 and positioned in wellbore 150. The downhole device 120 may provide a means to actuate a movable element (e.g., linearly actuate the movable element, or alternatively radially actuate the movable element) within the wellbore 150, including a means to isolate a lower portion of the conduit 140 from an upper portion of the conduit 140. The lower portion of the conduit 140 may be fluidically connected to a subterranean formation, such that formation fluids may flow into the lower portion of the conduit 140. The electrical connection 110 may extend into the wellbore 150 and may be connected to the downhole device 120. The electrical connection 110 may provide electric power to an electromagnet assembly disposed as part of the downhole device 120. As will be described in further detail below, electric power provided to the electromagnet assembly may energize the electromagnet assembly to actuate and/or hold the movable element of the downhole device 120. Actuation may include opening the downhole device 120 to provide a flow path for wellbore fluids in a lower portion of conduit 140 to flow into an upper portion of conduit 140. The electrical connection 110 may also provide a means to close the downhole device 120 and isolate a lower portion of conduit 140 to flow from an upper portion of conduit 140, for example to provide well control. In one embodiment, this is achieved when electric power is cut to the electrical connection 110 or the polarity of the supplied voltage/electric power is changed.

Turning to FIGS. 2A through 2K, illustrated are different simplistic cross-sectional views of a downhole device 200 designed, manufactured and/or operated according to one or more embodiments of the disclosure during different operational states. The downhole device 200 of FIGS. 2A through 2K could be any tool used in a downhole environment that is seeking to actuate a movable element using an electromagnet assembly configured to generate an electromagnetic field. Nevertheless, in one or more particularly pertinent embodiments, the downhole device 200 is a fluid flow control valve, such as a safety valve (e.g., subsurface safety valve (SSSV), whether a tubing retrievable safety valve (TRSV) or a wireline retrievable safety valve (WLRSV), or interval control valve (ICV). Accordingly, unless otherwise required, the present disclosure should not be limited to any type of downhole device.

The downhole device 200 of FIGS. 2A through 2K, in one or more embodiments, includes a member 210 having a first member end 215*a* and a second opposite member end 215*b*. The term "member," as used herein with respect to this feature, may include any structure, including tubular members and non-tubular members, which may be used within a wellbore. In the illustrated embodiment, the member 210 is a rigidly fixed member, for example as it might be coupled in line with a tubing string located within a wellbore.

The downhole device 200 of FIGS. 2A through 2K, in one or more embodiments, may additionally include a movable element 220 positioned about the member 210, the movable element 220 having a first movable element end 225*a* and a second opposite movable element end 225*b*. The term "movable element," as used herein with regard to this feature, may include any element of a downhole device that there is a desire to actuate from a first position to a second position, in this embodiment via an electromagnet assembly. The term "about," as used herein with regard to this feature, means adjacent in a way that would allow the movable element 220 to move in relation to a magnetic field, and includes, without limitation, at least partially radially inside or at least partially radially outside of the member 210, among other configurations.

Figure 2A:
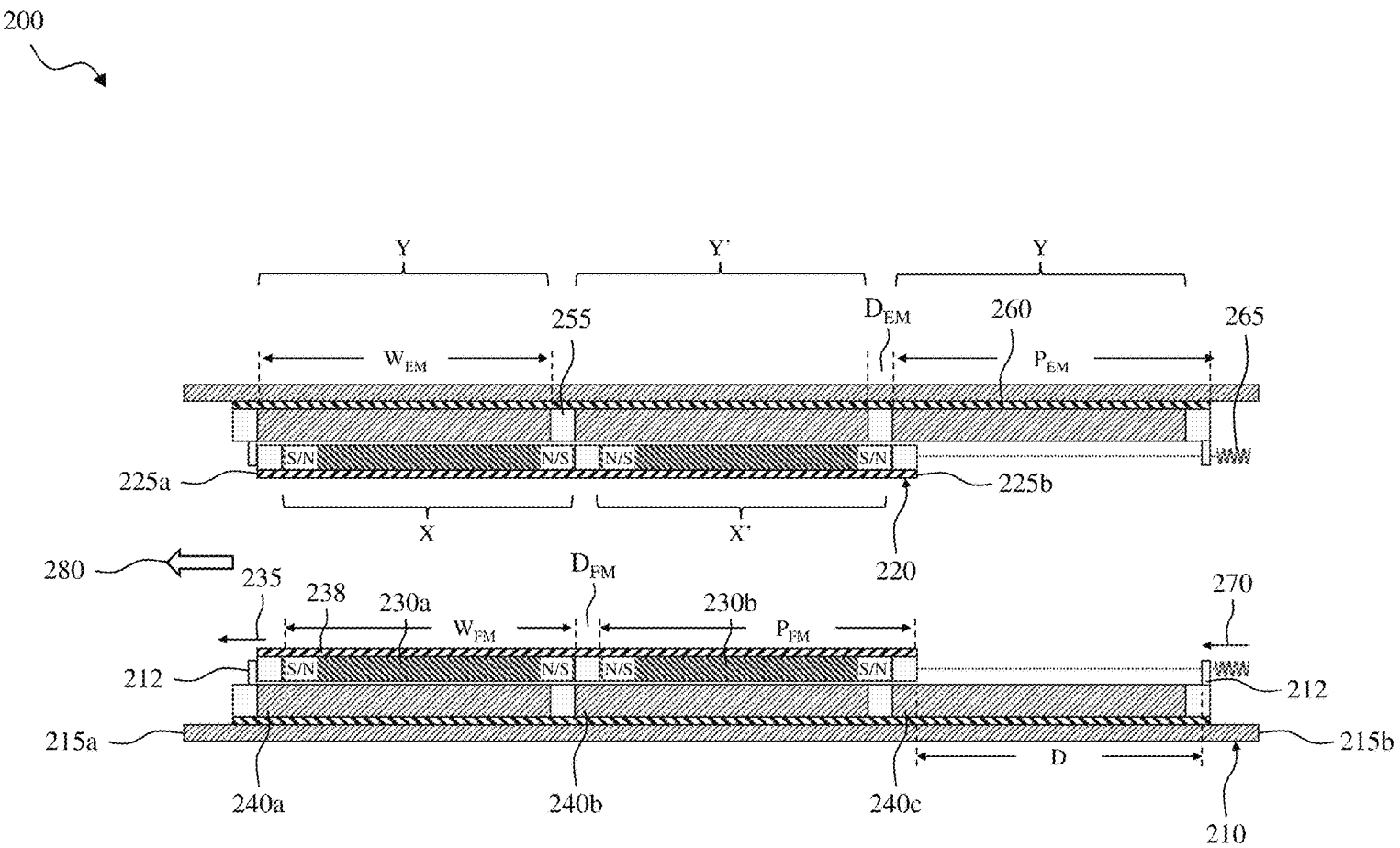
Figure 2B:
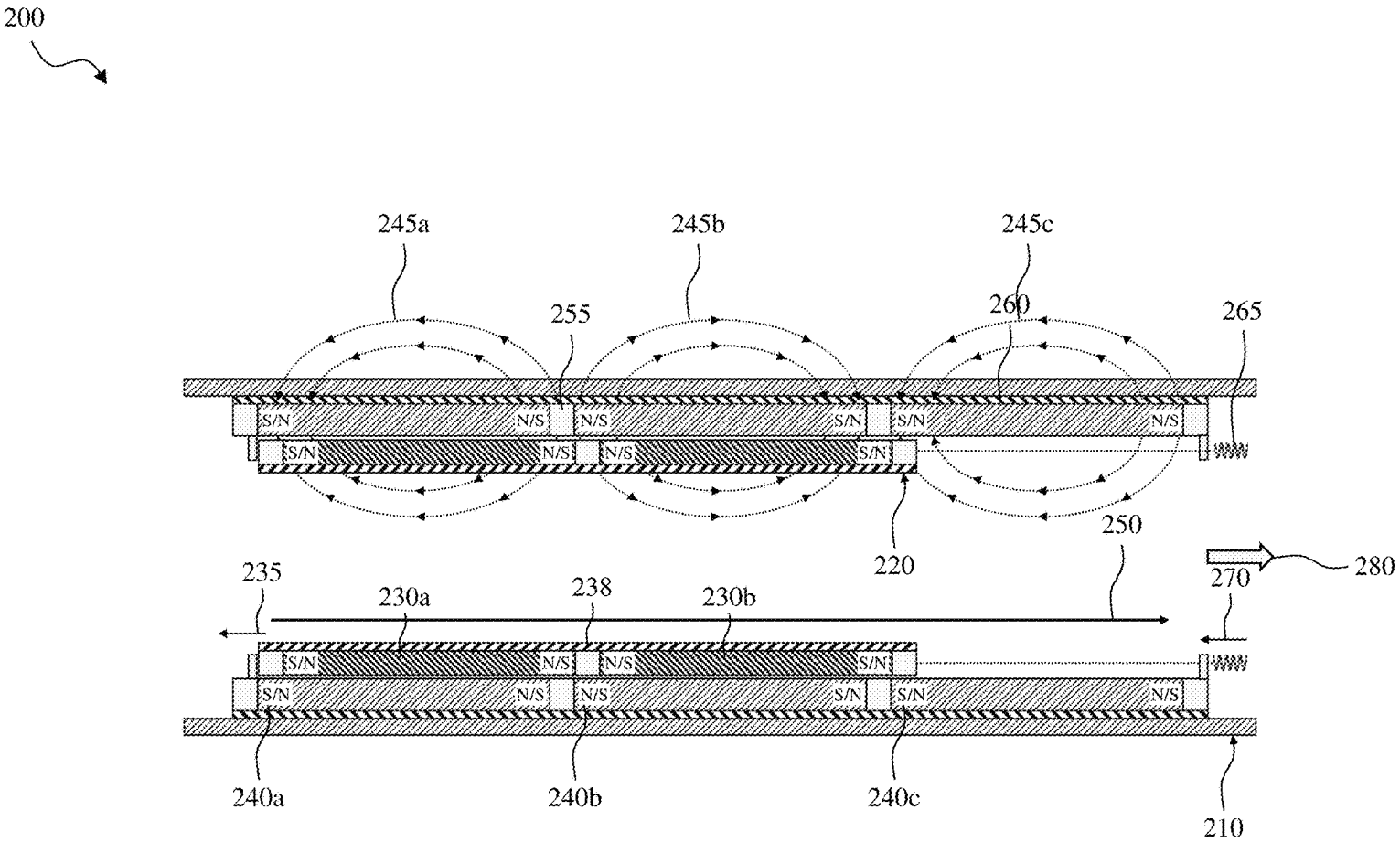
Figure 2C:
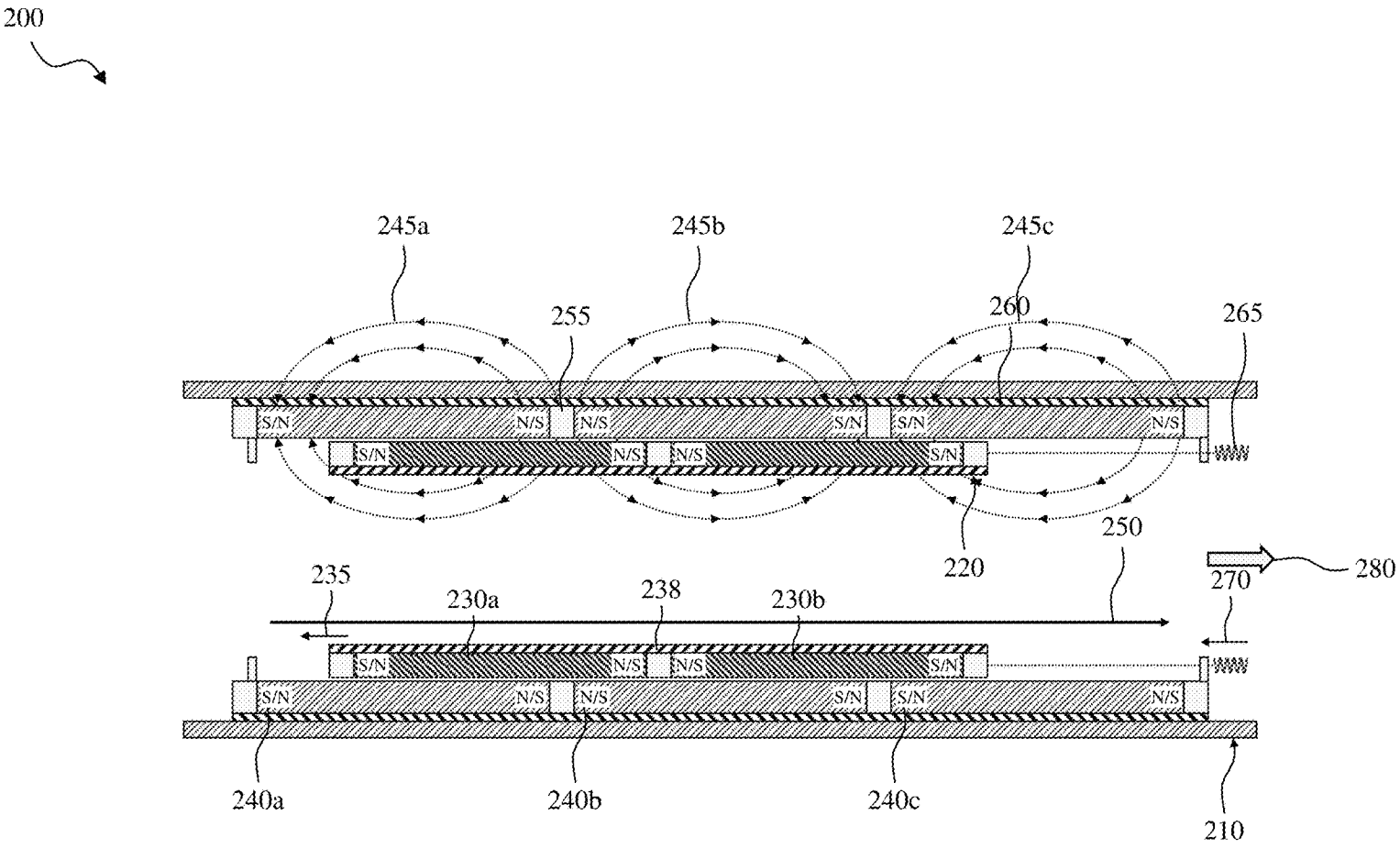
Figure 2D:
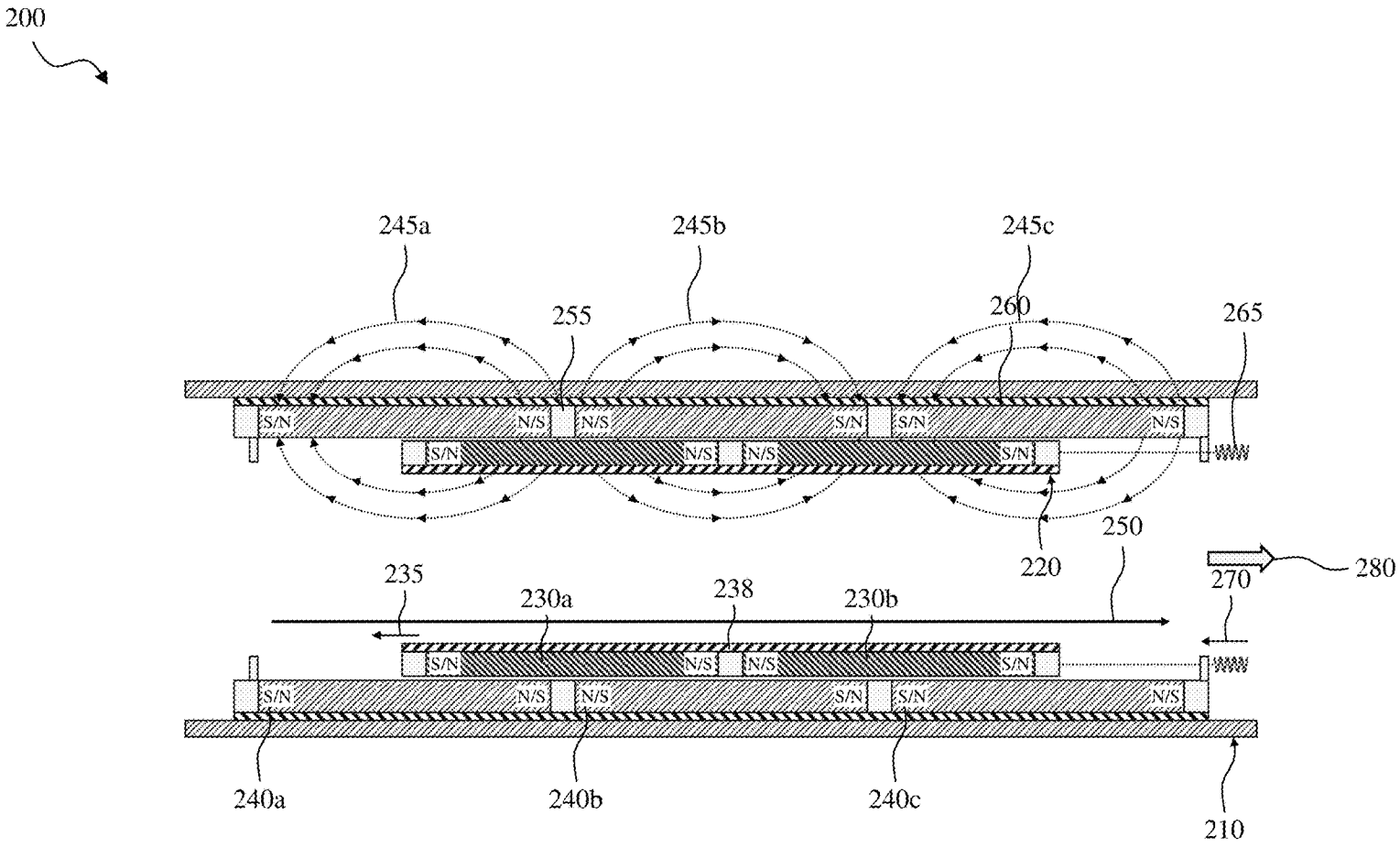
Figure 2E:
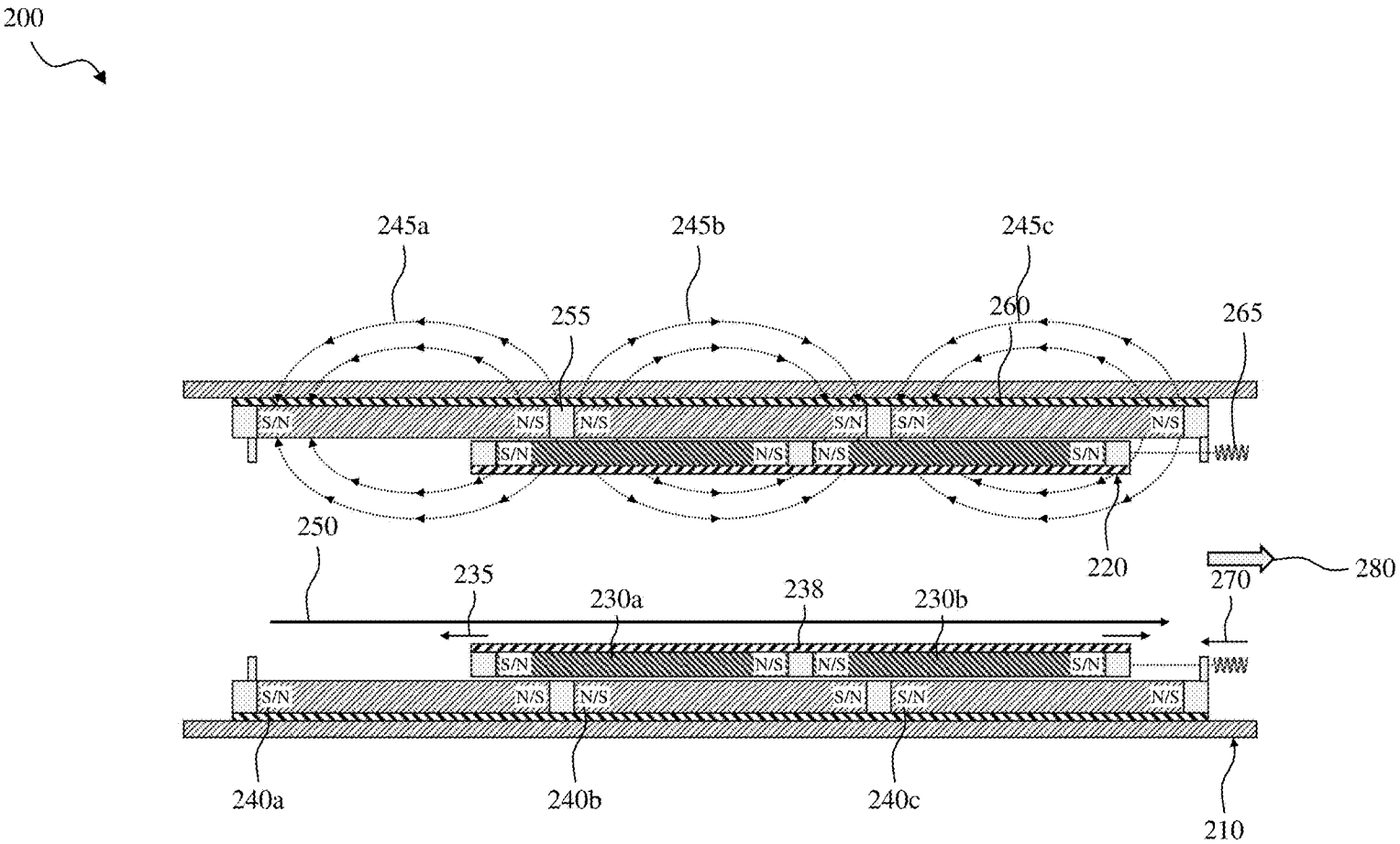
Figure 2F:
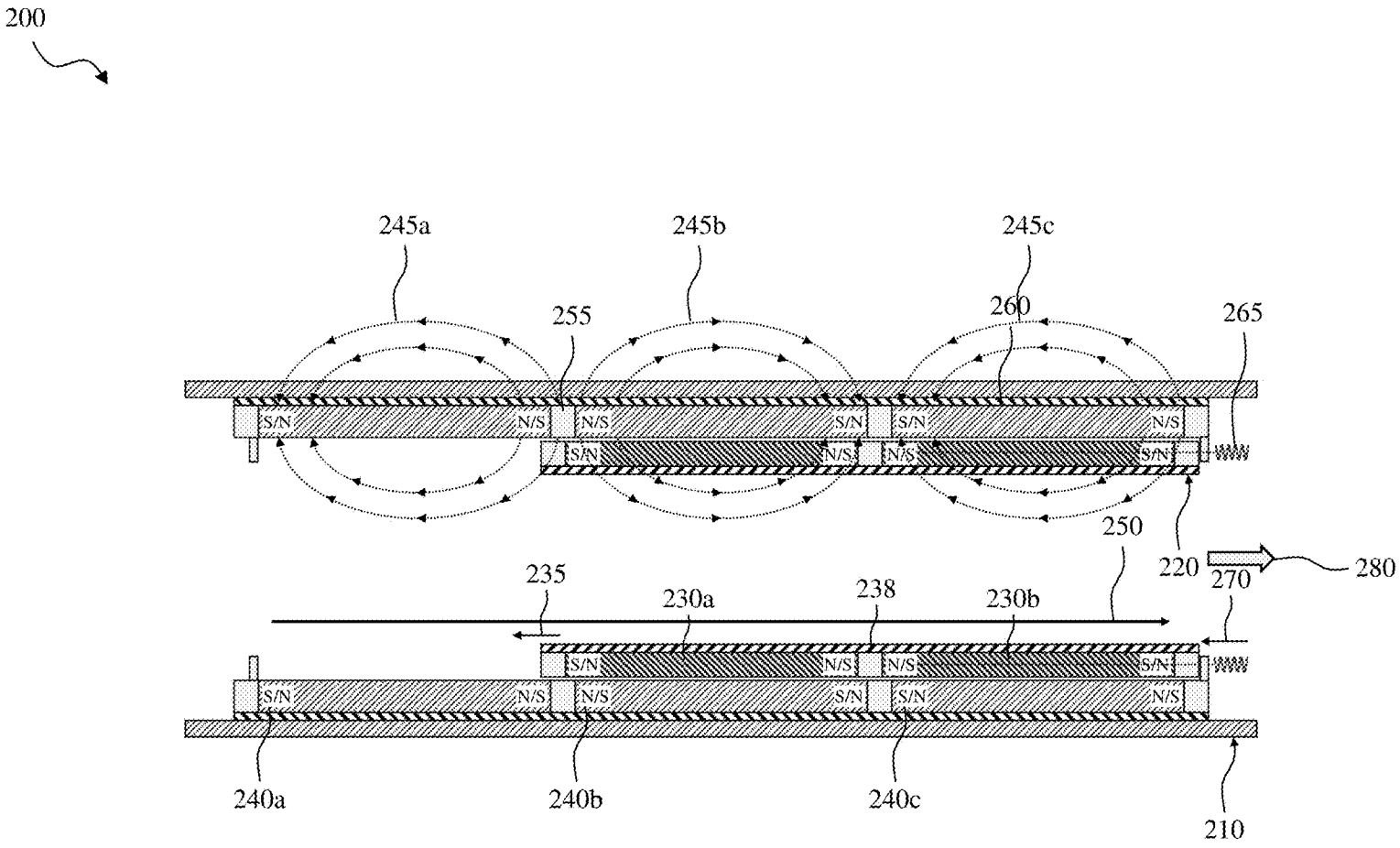
Figure 2G:
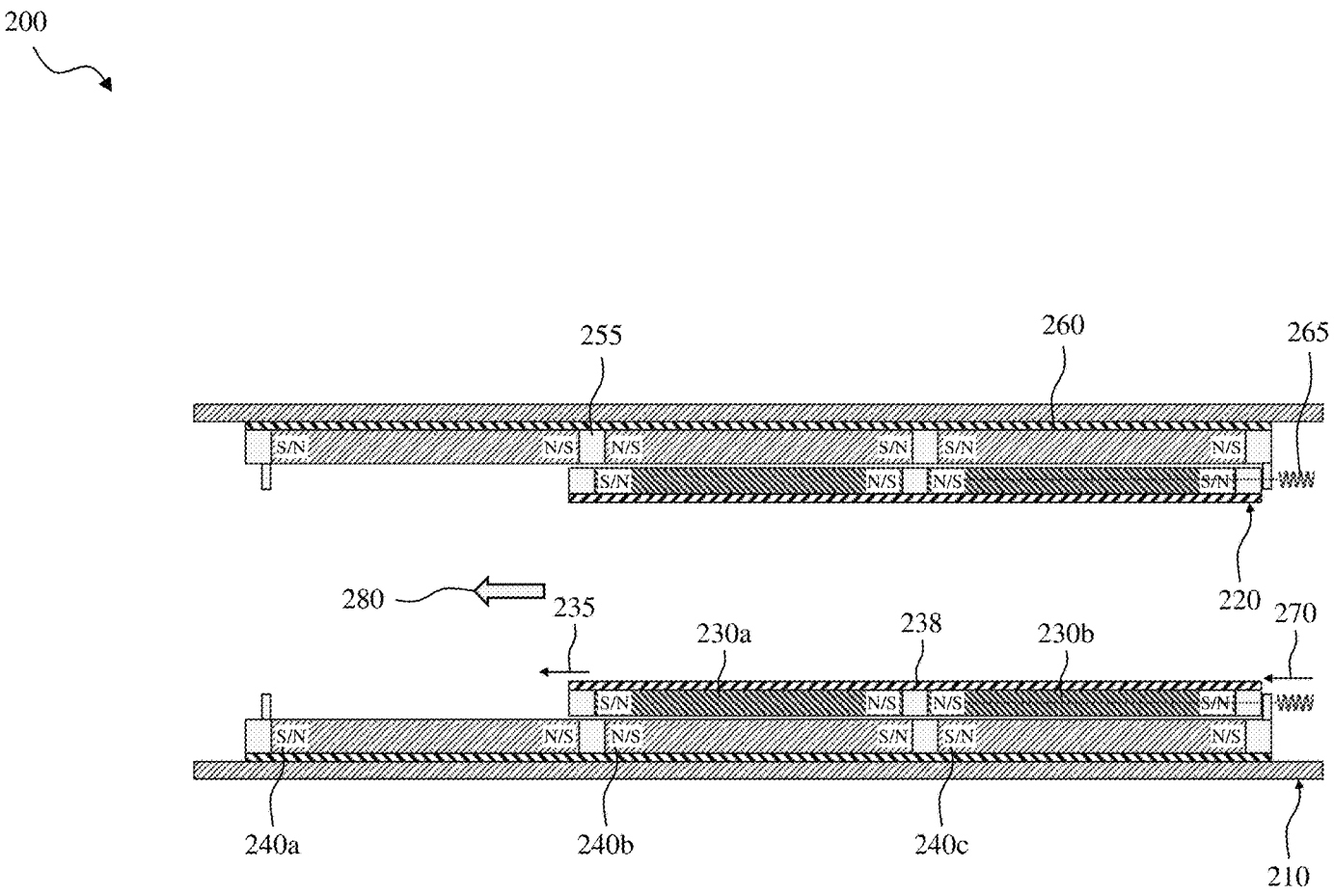

In the illustrated embodiments of FIGS. 2A through 2K, the movable element 220 is configured to move a stroke distance (D) from a first position (e.g., that shown in FIGS. 2A, 2B and 2H) to a second position (e.g., that shown in FIGS. 2F and 2G). The term "stroke distance," as used herein with regard to this feature, equates to a movement distance, and includes, without limitation, both a linear movement distance and a rotational movement distance. In at least one embodiment, shoulders of the movable element 220 may engage with shoulders of another feature, such as the stops 212 coupled (e.g., directly or indirectly coupled) to the member 210, to set the stroke distance (D).

The downhole device 200 of FIGS. 2A through 2K, in one or more embodiments, may further include a ferromagnet assembly 230*a* fixed to one of the member 210 or the movable element 220. In the illustrated embodiment, the ferromagnet assembly 230*a* is coupled to the movable element 220. In an alternative embodiment, the ferromagnet assembly 230*a* is coupled to the member 210. Furthermore, while not necessary for the downhole device 200 to operate as intended, in the illustrated embodiment of FIGS. 2A through 2K, the ferromagnet assembly 230*a* is a permanent magnet assembly producing an inherent magnetic field having a magnetic polarity (X). In this embodiment, the ferromagnet assembly 230*a* comprising the permanent magnet assembly generates a magnetic coupling force 235 that inherently biases the movable element 220 toward the first position, for example regardless of whether electric power is being supplied to the downhole device 200, and more particularly any electromagnet assemblies that the downhole device 200 may employ. In the illustrated embodiment of FIGS. 2A through 2K, the magnetic polarity (X) is represented by the pole of the ferromagnet assembly 230*a* comprising the permanent magnet assembly most near the first member end 215*a* being the S-pole, and the pole of the ferromagnet assembly 230*a* comprising the permanent magnet assembly further from the first member end 215*a* being the N-pole. While represented in this manner, the opposite could hold true, as shown by the slash between S/N and N/S.

Accordingly, in such an embodiment, the pole of the ferromagnet assembly 230*a* comprising the permanent magnet assembly most near the first member end 215*a* would be the N-pole, and the pole of the ferromagnet assembly 230*a* comprising the permanent magnet assembly further from the first member end 215*a* would be the S-pole In at least one embodiment, the ferromagnet assembly 230*a* comprising the permanent magnet assembly is a single permanent magnet having the magnetic polarity (X). In at least one other embodiment, the ferromagnet assembly 230*a* comprising the permanent magnet assembly is a series of stacked permanent magnets collectively having the magnetic polarity (X).

Further to the embodiment of FIGS. 2A through 2K, the downhole device 200 may additionally have one or more additional ferromagnet assemblies 230*b*, 230*c* . . . 230*m*, for example fixed to the one of the member 210 or the movable element 220 (e.g., sequentially further from the first member end 215*a* than the first ferromagnet assembly 230*a*). In the illustrated embodiment, the one or more additional ferromagnet assemblies 230*b*, 230*c* . . . 230*m* are one or more additional permanent magnet assemblies that each produce additional inherent magnetic fields that alternate between having a second magnetic polarity (X') opposite in direction of the magnetic polarity (X), and the magnetic polarity (X). Thus, in the embodiment of FIGS. 2A through 2K, the magnetic polarity (X') is represented by the pole of the permanent magnet assembly more near the first member end 215*a* being the N-pole, and the pole of the permanent magnet assembly further from the first member end 215*a* being the S-pole. Again, if a third ferromagnet assembly were employed, it would likely revert back to the magnetic polarity (X). When multiple ferromagnet assemblies 230*a*, 230*b* . . . 230*m* are employed, and particularly when the multiple ferromagnet assemblies 230*a*, 230*b* . . . 230*m* are multiple permanent magnet assemblies, they may be separated by individual ferromagnetic rings 238 (e.g., surrounded by individual ferromagnetic rings 238), among other structures.

In at least one embodiment, the ferromagnet assemblies 230*a*, 230*b* . . . 230*m* (e.g., permanent magnet assemblies) include a width ($W_{FM}$). In one or more embodiments, widths ($W_{FM}$) of the ferromagnet assemblies 230*a*, 230*b* . . . 230*m* (e.g., permanent magnet assemblies) are within 20%, if not 15%, if not 10%, if not 5%, if not 3%, if not 1% of each other. Further to the embodiment of FIGS. 2A through 2K, the ferromagnet assemblies 230*a*, 230*b* . . . 230*m* (e.g., permanent magnet assemblies) may include a pitch ($P_{FM}$), which is based upon the width ($W_{FM}$) of one of the given ferromagnet assemblies 230*a*, 230*b* . . . 230*m* (e.g., permanent magnet assemblies) and one of its individual ferromagnetic rings 238. In at least one embodiment, a distance ($D_{FM}$) between the ferromagnet assemblies 230*a*, 230*b* . . . 230*m* (e.g., permanent magnet assemblies) (e.g., represented by the individual ferromagnetic rings 238 in this embodiment) is less than the widths ($W_{FM}$) of the ferromagnet assemblies 230*a*, 230*b* . . . 230*m* (e.g., permanent magnet assemblies), if not at least 10% less, if not at least 20% less, if not at least 30% less, if not at least 40% less, if not at least 50% less, if not at least 60% less, if not at least 70% less, if not at least 80% less, if not at least 90% less, if not at least 95% less.

The downhole device 200 of FIGS. 2A through 2K, in one or more embodiments, may further include an electromagnet assembly 240*a* fixed to an other of the movable element 220 or the member 210. Again, as the ferromagnet assembly 230*a* is coupled to the movable element 220 in the embodiments of FIGS. 2A through 2K, the electromagnet assembly 240*a* would then be coupled to the member 210. Obviously, certain other embodiments exist wherein the opposite holds true, and thus the ferromagnet assembly 230*a* is coupled to the member 210 and the electromagnet assembly 240*a* coupled to the movable element 220. In the embodiment of FIGS. 2A through 2K, the electromagnet assembly 240*a* is operable to receive electric power to produce an electromagnetic field 245*a* having an electromagnetic polarity (Y) similar in direction (e.g., exactly similar in direction in one embodiment) to the magnetic polarity (X), the electromagnetic field 245*a* configured to generate an opposite electromagnetic coupling force 250 greater than the magnetic coupling force 235 to actuate the movable element 220 from the first position towards the second position when the electromagnet assembly 240*a* receives the electric power. In the illustrated embodiment of FIGS. 2A through 2K, the electromagnetic polarity (Y) is represented by the pole of the electromagnet assembly 240*a* most near the first member end 215*a* being the S-pole, and the pole of the electromagnet assembly 240*a* further from the first member end 215*a* being the N-pole. Again, the poles of the electromagnet assembly 240*a* show up when it is powered.

Further to the embodiment of FIGS. 2A through 2K, the downhole device 200 may additionally have one or more additional electromagnet assemblies 240*b*, 240*c* . . . 240*n*, for example fixed to one of the movable element 220 or the member 210 (e.g., sequentially further from the first member end 215*a* than the first electromagnet assembly 240*a*). In the illustrated embodiment, the one or more additional electromagnet assemblies 240*b*, 240*c* . . . 240*n* are operable to receive additional electric power and each produce additional electromagnetic fields electromagnetic field 245*b*, 245*c* . . . 245*n* that alternate between having a second electromagnetic polarity (Y') opposite in direction to the electromagnetic polarity (Y), and the electromagnetic polarity (Y). Thus, in the embodiment of FIGS. 2A through 2K, the electromagnetic polarity (Y') is represented by the pole of the electromagnet assembly more near the first member end 215*a* being the N-pole, and the pole of the electromagnet assembly further from the first member end 215*a* being the S-pole. Again, if a third electromagnet assembly were employed, it would likely revert back to the electromagnetic polarity (Y). Again, the electromagnetic fields 245*a*, 245*b* . . . 245*n* of the electromagnet assemblies 240*a*, 240*b* . . . 240*n*, and the poles of the multiple electromagnet assemblies 240*a*, 240*b* . . . 240*n*, do not exist until electric power is supplied. When multiple electromagnet assemblies 240*a*, 240*b* . . . 240*n* are employed, they may be separated and/or surrounded by individual ferromagnetic rings 255, as shown. The electromagnet assemblies 240*a*, 240*b* . . . 240*n*, in one or more embodiments, may include one or more backing plates 260 (e.g., one or more ferromagnetic backing plates).

In at least one embodiment, the additional electric powers being provided to one or more additional electromagnet assemblies 240*b*, 240*c* . . . 240*n* are the same as the electric power being provided to the electromagnet assembly 240*a*. For example, in at least one embodiment, the electromagnet assembly 240*a* and the one or more additional electromagnet assemblies 240*b*, 240*c* . . . 240*n* are wired in series (e.g., all having the same handedness for their coils) to provide the alternating electromagnetic polarity (Y) and second electromagnetic polarity (Y'), as specifically shown in FIG. 2I. In at least this one embodiment, the electric power supplied to the electromagnet assembly 240*a* and the additional electric power supplied to the one or more additional electromagnet assemblies 240*b*, 240*c* . . . 240*n* are the same electric power. In yet another embodiment, such as that shown in FIG. 2J, the direction of the handedness for the coils of the adjacent electromagnet assemblies 240*a*, 240*c* . . . 240*n* alternate, thereby achieving the same with shorter wiring paths. Accordingly, a single electric power source, such as a single TEC, could power all of the electromagnet assemblies 240*a*, 240*b* . . . 240*n*. In other embodiments, the electromagnet assemblies 240*a*, 240*b* . . . 240*n* are wired in parallel, which would likely require that the parallel connections be made locally or the electric power and additional electric powers to be different electric powers, and possibly different electric power sources, for example different TECs extending from the wellbore surface, as shown in FIG. 2K. Those skilled in the art, given the details in the present disclosure, understand how one might manufacture and/or position and/or wire the electromagnet assemblies 240*a*, 240*b* . . . 240*n*, including wrapping a conductive wire about a ferromagnetic material, sometimes using different handedness.

In at least one embodiment, the electromagnet assemblies 240*a*, 240*b* . . . 240*n* include a width ($W_{EM}$). In one or more embodiments, widths ($W_{EM}$) of the electromagnet assemblies 240*a*, 240*b* . . . 240 *n* are within 10%, if not 15%, if not 10%, if not 5%, if not 3%, if not 1% of each other. Further to the embodiment of FIGS. 2A through 2K, the electromagnet assemblies 240*a*, 240*b* . . . 240*n* may include a pitch ($P_{EM}$), which is based upon the width ($W_{EM}$) of one of the given electromagnet assemblies 240*a*, 240*b* . . . 240*n* and one of its individual ferromagnetic rings 255. In at least one embodiment, a distance ($D_{EM}$) between the electromagnet assemblies 240*a*, 240*b* . . . 240*n* is less than the widths ($W_{EM}$) of the electromagnet assemblies 240*a*, 240*b* . . . 240*n*, if not at least 10% less, if not at least 20% less, if not at least 30% less, if not at least 40% less, if not at least 50% less, if not at least 60% less, if not at least 70% less, if not at least 80% less, if not at least 90% less, if not at least 95% less.

Further to one or more embodiments, the pitch ($P_{EM}$) of the electromagnet assemblies 240*a*, 240*b* . . . 240*n* is within 10%, if not 5%, if not 3%, if not 1% of the pitch ($P_{FM}$) of the ferromagnet assemblies 230*a*, 230*b* . . . 230*m* (e.g., permanent magnet assemblies). Similarly, in one or more embodiments, the width ($W_{EM}$) of the electromagnet assemblies 240*a*, 240*b* . . . 240*n* is within 10%, if not 5%, if not 3%, if not 1% of the width ($W_{FM}$) of the ferromagnet assemblies 230*a*, 230*b* . . . 230*m* (e.g., permanent magnet assemblies). Further to the embodiment of FIGS. 2A through 2K, in at least one embodiment, the width ($W_{EM}$) of the electromagnet assemblies 240*a*, 240*b* . . . 240*n*, is no more than 200% of the stroke distance (D). In yet another embodiment, the width ($W_{EM}$) of the electromagnet assemblies 240*a*, 240*b* . . . 240*n*, is no more than 180% of the stroke distance, if not no more than 160%, if not no more than 140%, if not no more than 120%, if not no more than 100%. In even yet another embodiment, the width ($W_{EM}$) of the electromagnet assemblies 240*a*, 240*b* . . . 240*n* ranges from 150% to 50% of the stroke distance (D). In one or more other embodiments, the width ($W_{EM}$) of the electromagnet assemblies 240*a*, 240*b* . . . 240*n* ranges from 125% to 75% of the stroke distance (D), if not from 120% to 80%, if not from 110% to 90%, if not from 105% to 95%, if not from 102% to 98%. It is noted that keeping the width ($W_{EM}$) of the electromagnet assemblies 240*a*, 240*b* . . . 240*n* somewhat near the stroke distance (D), but no more than 200% of the stroke distance (D), provides unexpected results as compared to greater differences between the two. In fact, doing so allows the manufacture and/or operation of the downhole device 200 to be configured in such a way as to operate more efficiently.

In at least one embodiment, such as that shown, a combined number (n) of the multiple electromagnet assemblies 240*a*, 240*b* . . . 240*n* is greater than a combined number (m) of the ferromagnet assemblies 230*a*, 230*b* . . . 230*m* (e.g., permanent magnet assemblies). In even yet another embodiment, n=m+1, including any of the optional values listed below. In at least one embodiment, n is at least 3, if not at least 4, if not at least 5, if not at least 6, if not at least 7, if not at least 8, if not at least 9, if not at least 10. In yet another embodiment, n ranges from 3 to 10, if not from 4 to 8, if not from 5 to 6.

Further to the embodiment of FIGS. 2A through 2K, the downhole device 200 may additionally have a separate energy storage element 265 coupled with the movable element 220, the separate energy storage element 265 generating a return force 270 that also biases the movable element 220 toward the first position. The term "energy storage element", as used herein with regard to this feature, includes any component that stores energy, for example by being deformed, and covers many devices, such as: springs (coil, leaf, torsion, etc.), elastomer bands or rubber elements, gas springs/pneumatic springs, hydraulic accumulators, Belleville washers and flexures, foam or compliant materials used as return mechanisms, etc.

Per the discussions above, in at least one or more embodiments, the magnetic coupling force 235 and relative positions of the ferromagnet assemblies 230*a*, 230*b* . . . 230*m* (e.g., permanent magnet assemblies) and the electromagnet assemblies 240*a*, 240*b* . . . 240*n*, may be set along the stroke distance (D) such that a required electric power needed to generate the opposite electromagnetic coupling force 250 greater than the magnetic coupling force 235 to actuate the movable element 220 decreases as the movable element 220 moves from the first position to the second position. In the embodiment wherein the separate energy storage element 265 is used, the magnetic coupling force 235, return force 270, and relative positions of the ferromagnet assemblies 230*a*, 230*b* . . . 230*m* (e.g., permanent magnet assemblies) and the electromagnet assemblies 240*a*, 240*b* . . . 240*n*, may be set along the stroke distance (D) such that a required electric power needed to generate the opposite electromagnetic coupling force 250 greater than the magnetic coupling force 235 and the return force 270 to actuate the movable element 220 decreases as the movable element 220 moves from the first position to the second position.

Turning specifically to FIG. 2A, the downhole device 200 is in a first position (e.g., first closed position in an embodiment wherein the downhole device is a fluid flow control valve). At this stage of operation, the electromagnet assemblies 240*a*, 240*b* . . . 240*n* are unpowered, and thus have yet to generate their electromagnetic fields 245*a*, 245*b* . . . 245*n*. Similarly, at this stage of operation, the ferromagnet assemblies 230*a*, 230*b* . . . 230*m* (e.g., permanent magnet assemblies and their magnetic fields) are looking for a natural position, and thus attempting to align the ferromagnet assemblies 230*a*, 230*b* . . . 230*m* (e.g., permanent magnet assemblies) with the ferromagnetic features thereabout (e.g., the ferromagnetic features of the electromagnet assemblies 240*a*, 240*b* . . . 240*n*), and thus create the magnetic coupling force 235 that biases the movable element 220 toward the first position. The magnetic coupling force 235 and the return force 270 (e.g., when used) collectively result in a net force 280 toward the first position.

Turning specifically now to FIG. 2B, illustrated is the downhole device 200 of FIG. 2A an instant electric power (e.g., DC electric power in this embodiment, however, embodiments exist wherein AC electric power is employed)

is supplied to the electromagnet assemblies 240*a*, 240*b* . . . 240*n*. As shown, the powered electromagnet assemblies 240*a*, 240*b* . . . 240*n* generate the electromagnetic fields 245*a*, 245*b* . . . 245*n*, which in turn act upon the ferromagnet assemblies 230*a*, 230*b* . . . 230*m* (e.g., permanent magnet assemblies) with the opposite electromagnetic coupling force 250. The opposite electromagnetic coupling force 250, magnetic coupling force 235 and the return force 270 collectively result in a net force 280 toward the second position.

Turning specifically now to FIG. 2C, illustrated is the downhole device 200 of FIG. 2B after continuing to supply electric power to the electromagnet assemblies 240*a*, 240*b* . . . 240*n*. As the opposite electromagnetic coupling force 250 is greater than the magnetic coupling force 235 (e.g., and the return force 270 in the illustrated embodiment), the movable element 220 moves to about 25% of the way between the first position and the second position. Again, the opposite electromagnetic coupling force 250, the magnetic coupling force 235 and the return force 270 collectively result in the net force 280 toward the second position.

Turning specifically now to FIG. 2D, illustrated is the downhole device 200 of FIG. 2C after continuing to supply electric power to the electromagnet assemblies 240*a*, 240*b* . . . 240*n*. As the opposite electromagnetic coupling force 250 is still greater than the magnetic coupling force 235 (e.g., and the return force 270 in the illustrated embodiment), the movable element 220 moves to about 50% of the way between the first position and the second position. Again, the opposite electromagnetic coupling force 250, the magnetic coupling force 235 and the return force 270 collectively result in a net force 280 toward the second position.

Turning specifically now to FIG. 2E, illustrated is the downhole device 200 of FIG. 2D after continuing to supply electric power to the electromagnet assemblies 240*a*, 240*b* . . . 240*n*. As the opposite electromagnetic coupling force 250 is still greater than the magnetic coupling force 235 (e.g., and the return force 270 in the illustrated embodiment), the movable element 220 moves to about 75% of the way between the first position and the second position. Again, the opposite electromagnetic coupling force 250, the magnetic coupling force 235 and the return force 270 collectively result in a net force 280 toward the second position.

Turning specifically now to FIG. 2F, illustrated is the downhole device 200 of FIG. 2E after continuing to supply electric power to the electromagnet assemblies 240*a*, 240*b* . . . 240*n*. As the opposite electromagnetic coupling force 250 is still greater than the magnetic coupling force 235 (e.g., and the return force 270 in the illustrated embodiment), the movable element 220 moves 100% of the way between the first position and the second position, and thus moved the entire stroke distance (D). Again, the opposite electromagnetic coupling force 250, the magnetic coupling force 235 and the return force 270 collectively result in a net force 280 toward the second position. As the movable element 220 now engages the downhole stop 212, as shown, the movable element completes the stroke distance (D).

Turning specifically now to FIG. 2G, illustrated is the downhole device 200 of FIG. 2F an instant after discontinuing to supply electric power to the electromagnet assemblies 240*a*, 240*b* . . . 240*n*. As the opposite electromagnetic coupling force 250 no longer exists, the magnetic coupling force 235 (e.g., and the return force 270 in the illustrated embodiment) is able to return the movable element 220 from the second position back to the first position. The magnetic coupling force 235 and the return force 270, once again collectively result in a net force 280 toward the first position. In an alternative embodiment, as opposed to discontinuing electric power, a polarity of the voltage is reversed, thereby using the electromagnet assemblies 240*a*, 240*b* . . . 240*n* and associated opposite electromagnetic fields to drive the movable element 220 back toward the first position.

Figure 2H:
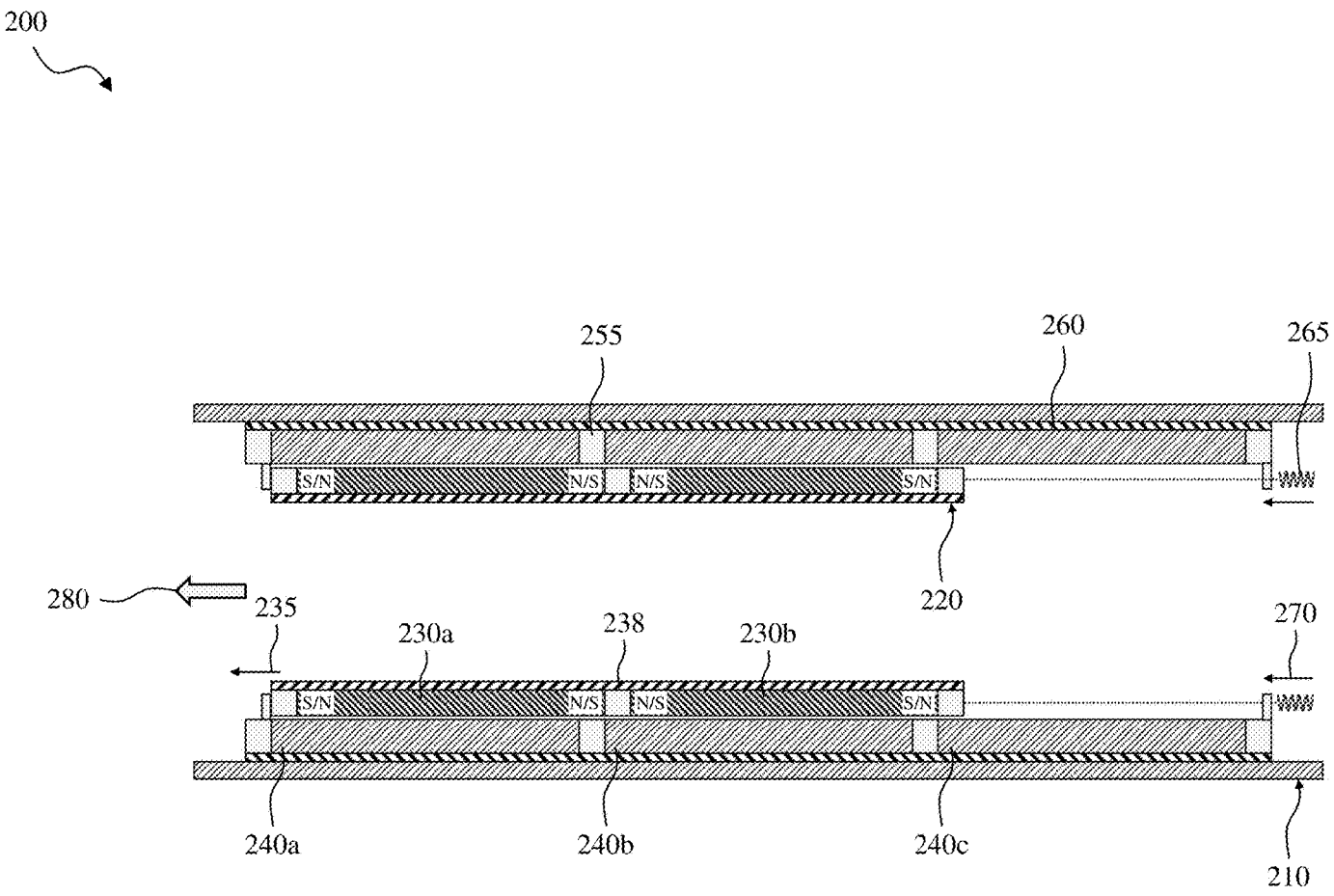
Figure 21:
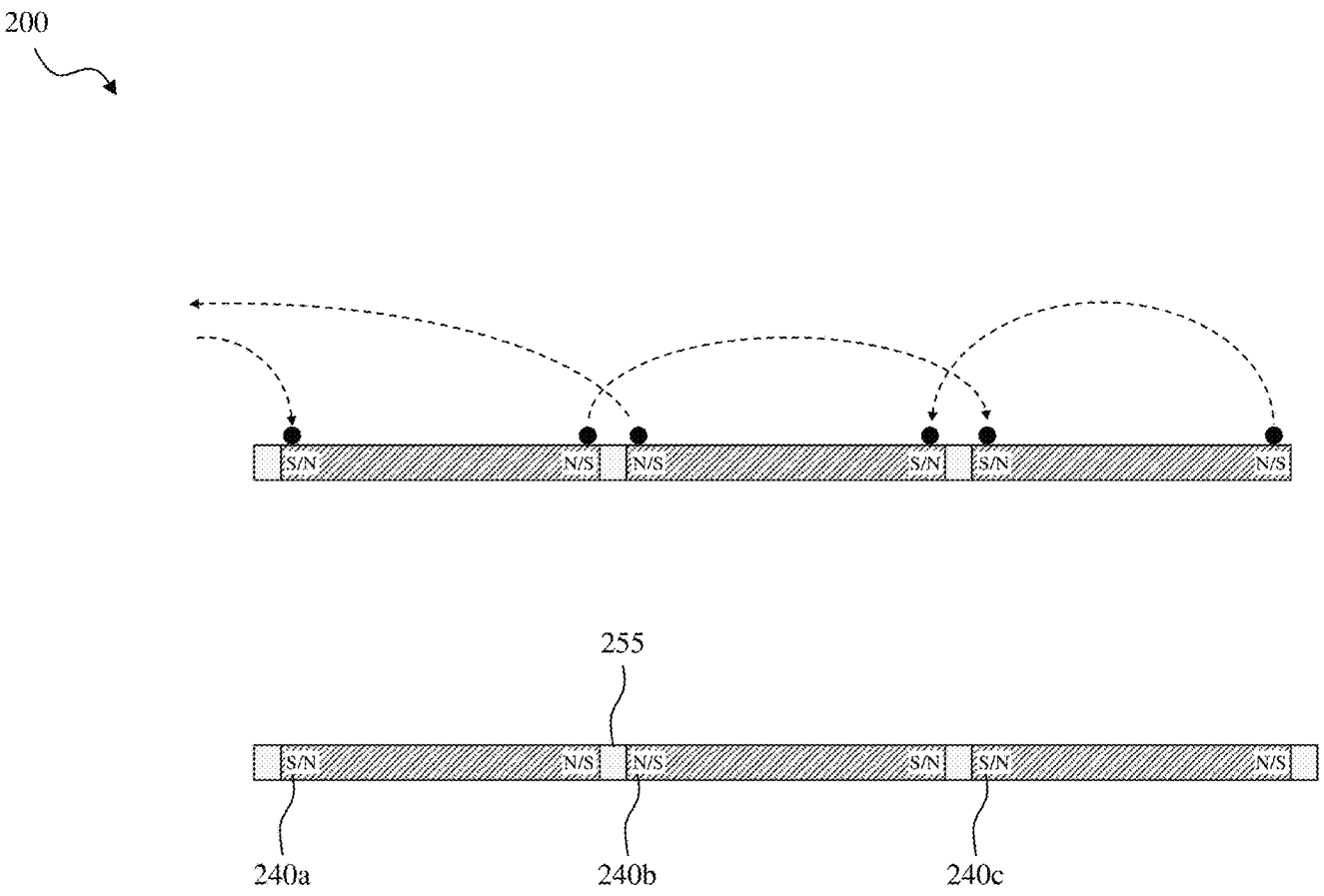
Figure 2J:
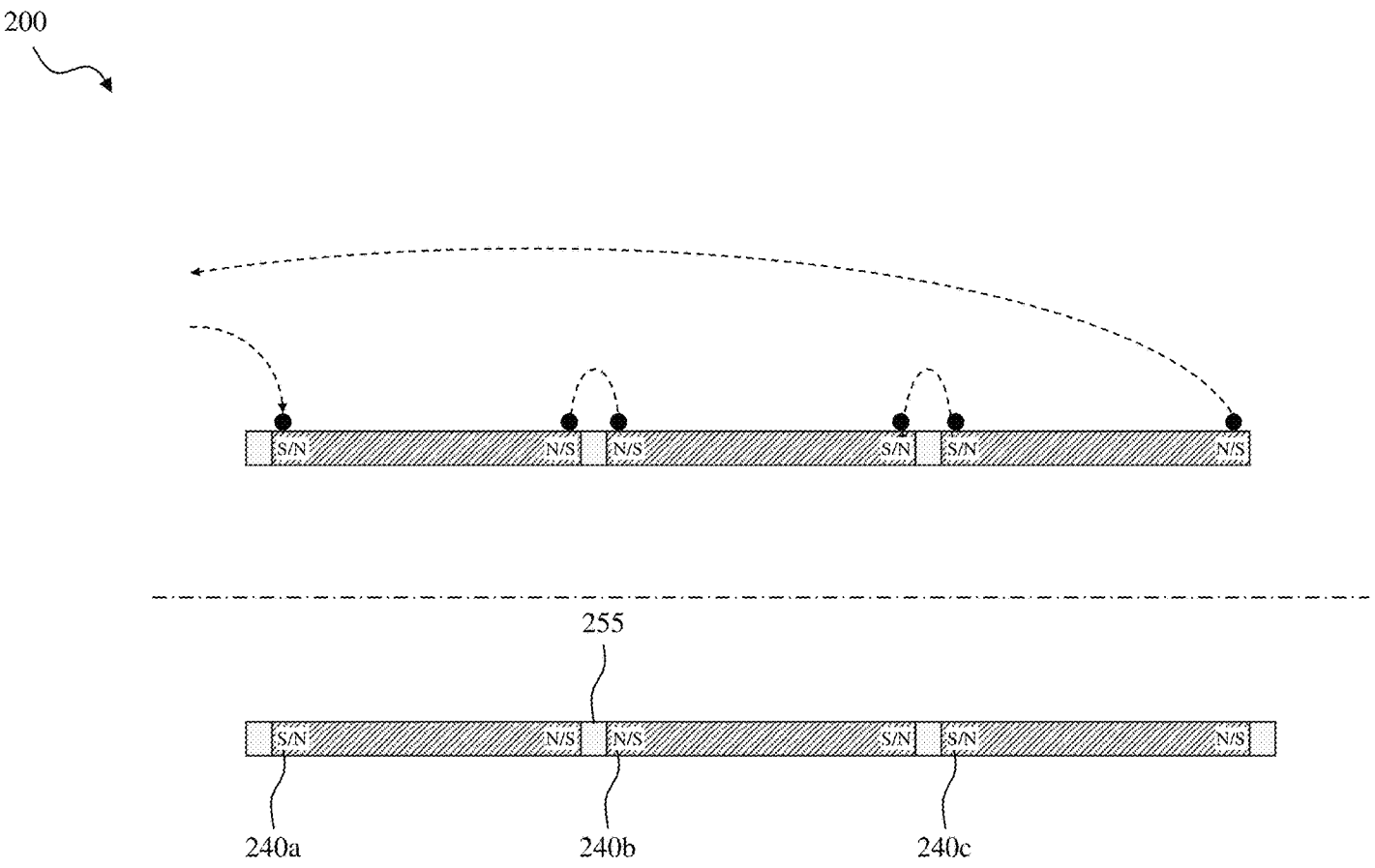
Figure 2K:
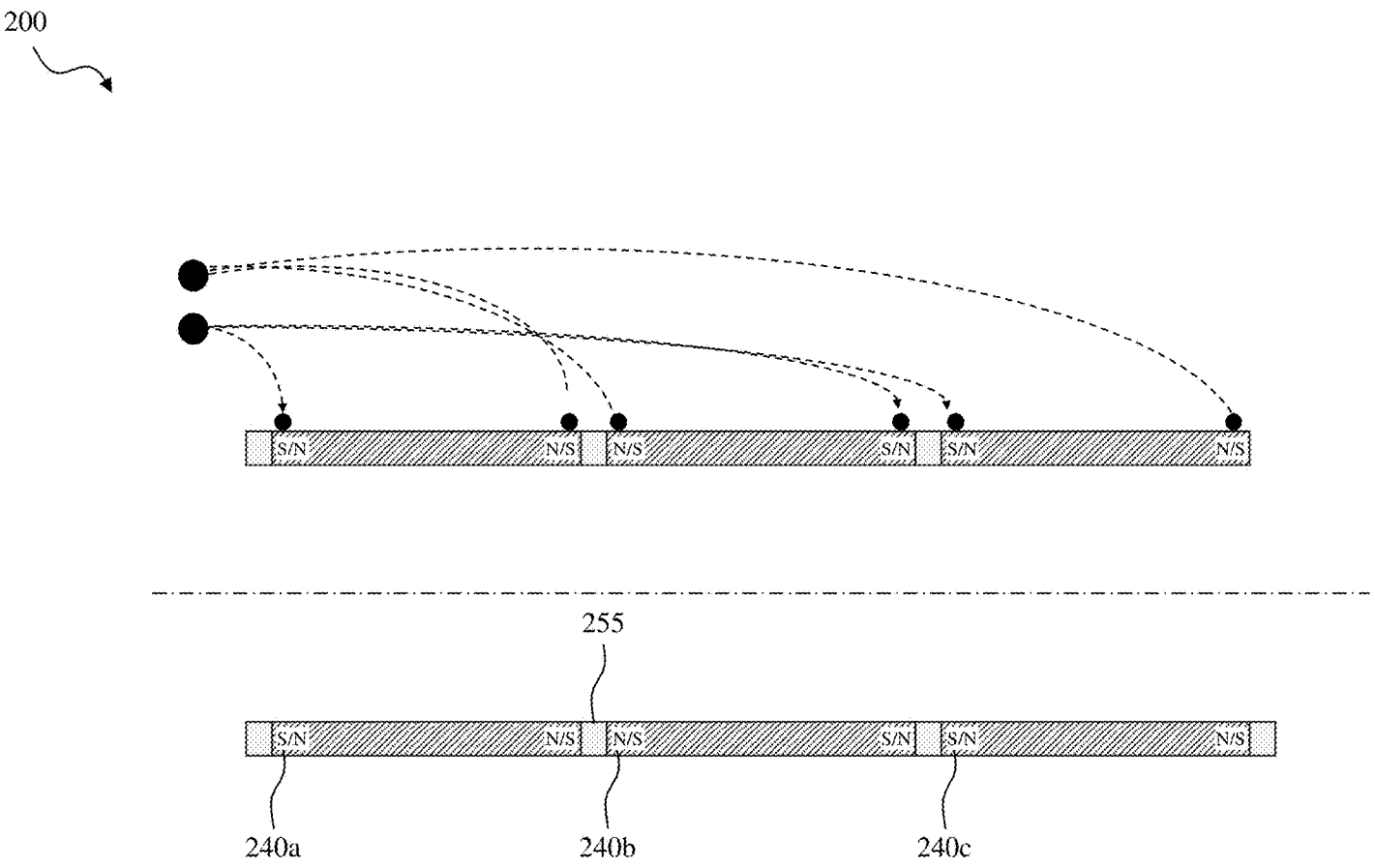

Turning specifically now to FIG. 2H, illustrated is the downhole device 200 of FIG. 2G a period of time after discontinuing supplying electric power to the electromagnet assemblies 240*a*, 240*b* . . . 240*n*, (e.g., or reversing the polarity of the voltage) such that the movable element 220 is fully back in the first position (e.g., has engaged the uphole stop 212 to complete the stroke distance (D)). The magnetic coupling force 235 and the return force 270 (e.g., and the opposite electromagnetic fields when used), once again collectively result in a net force 280 toward the first position.

Figure 3A:
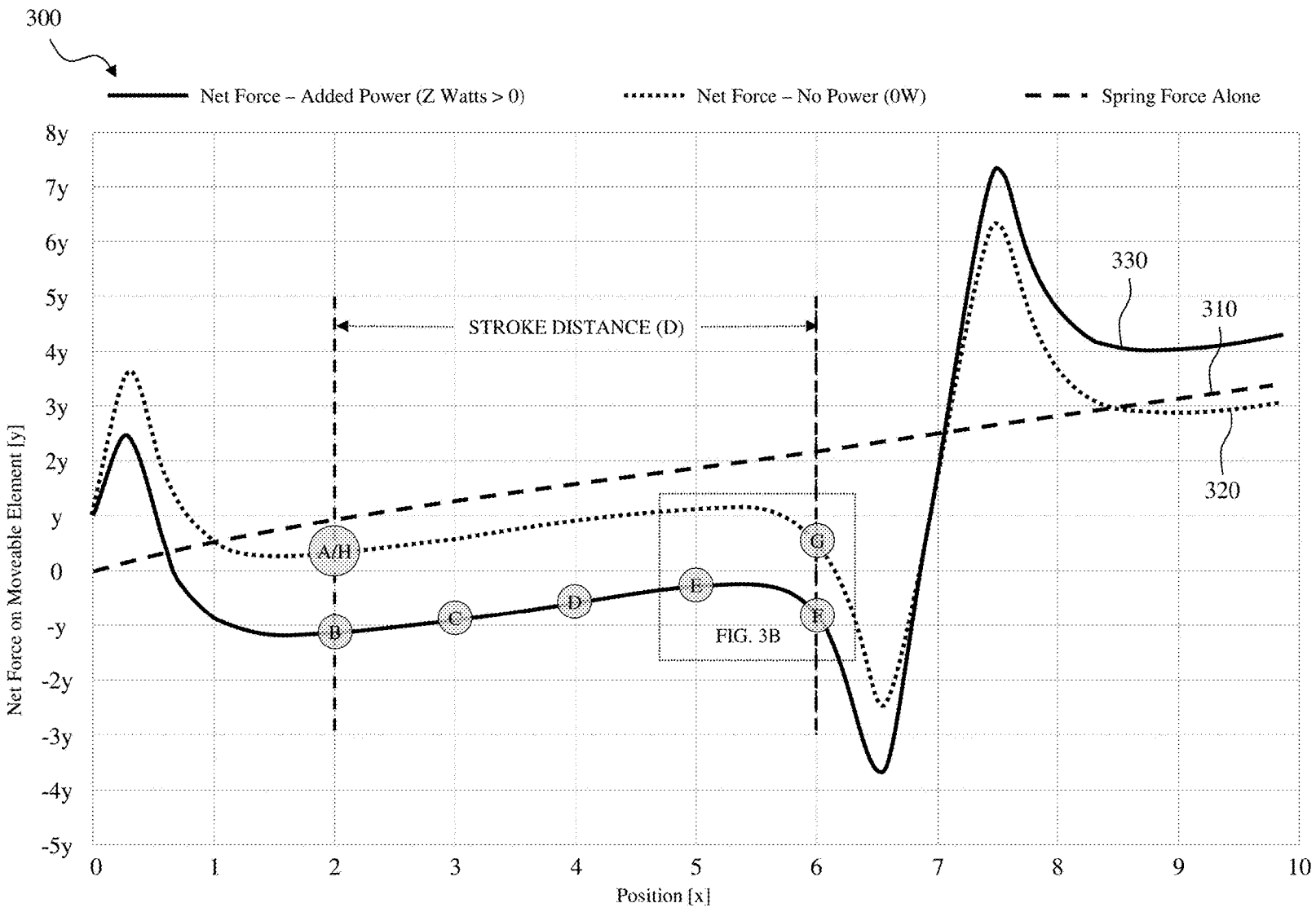
FIGS. 3A and 3B illustrate various views of a graph, the graph illustrating where the different operational states of the downhole device of FIGS. 2A through 2K reside in relation to the second and third data sets illustrated in the graph.
Figure 3B:
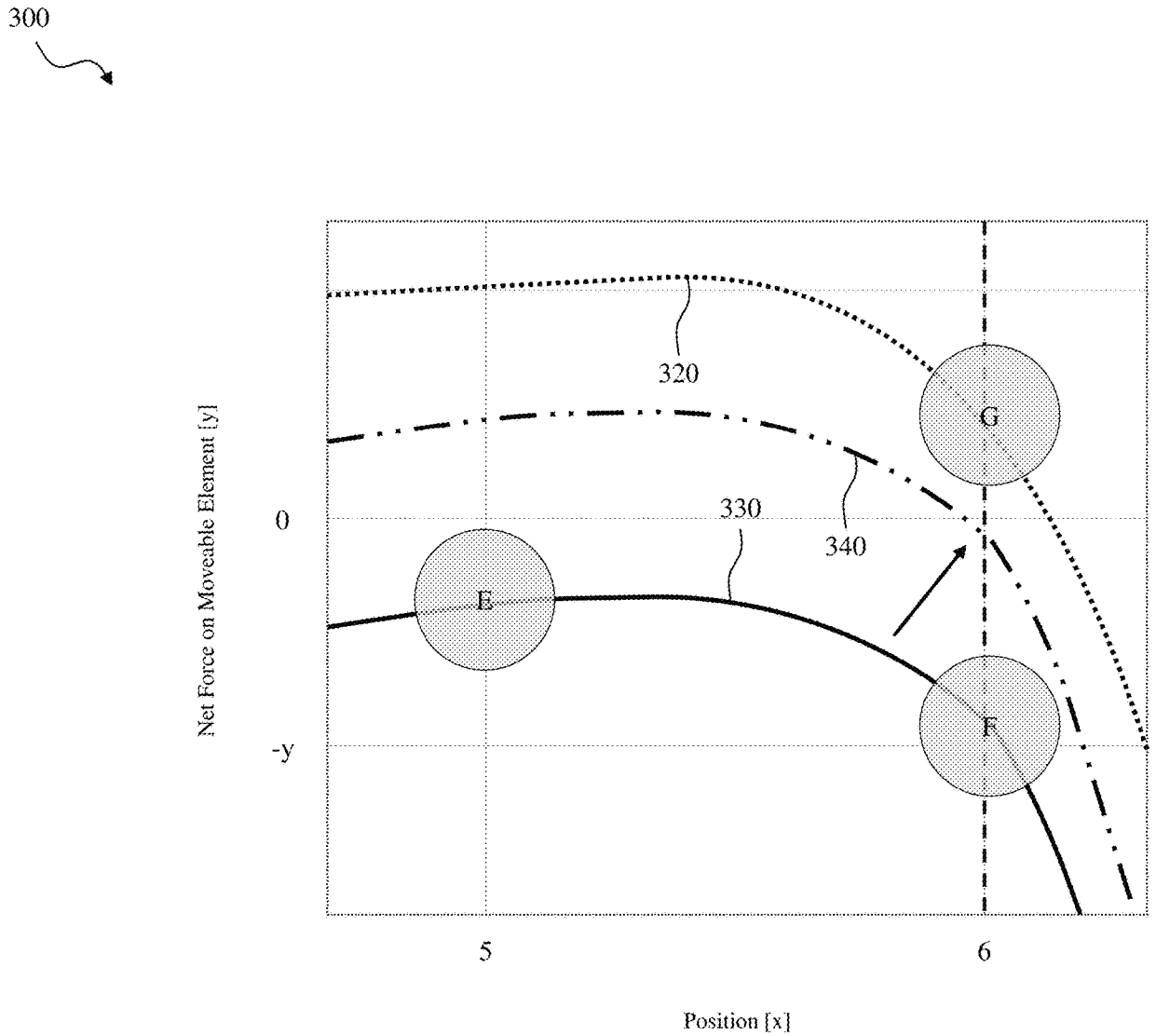

Turning now to FIGS. 3A and 3B, illustrated is a graph 300 comparing the force versus position (e.g., net force) for one embodiment of a downhole device designed, manufactured, and/or operated according to one or more embodiments of the disclosure, such as the downhole device 200 of FIGS. 2A through 2K. It should be noted that individual positive forces urge the movable element 220 toward position 0, whereas individual negative forces urge the movable element 220 toward position 6. Accordingly, the sum of all of the individual forces (e.g., sum of all individual positive forces and individual negative forces), also called the net force, if positive will urge the movable element 220 toward position 0, but if negative will urge the movable element 220 toward position 6. The graph 300 includes a first data set 310 that compares the net force versus position for the separate energy storage element 265 of the downhole devices 200 (e.g., exclusive of the magnetic coupling force 235 of the ferromagnet assemblies 230*a*, 230*b* . . . 230*m* (e.g., permanent magnet assemblies) and the opposite electromagnetic coupling force of the electromagnet assemblies 240*a*, 240*b* . . . 240*n*), a second data set 320 that compares the net force versus position for the downhole device 200 with no electric power being provided to the electromagnet assemblies 240*a*, 240*b* . . . 240*n* (e.g., inclusive of the magnetic coupling force 235 of the ferromagnet assemblies 230*a*, 230*b* . . . 230*m* (e.g., permanent magnet assemblies) and the return force 270 of the separate energy storage element 265, but exclusive of the opposite electromagnetic coupling force of the electromagnet assemblies 240*a*, 240*b* . . . 240*n*), and a third data set 330 that compares the net force versus position for the downhole device 200 with Z Watts of electric power being provided to the electromagnet assemblies 240*a*, 240*b* . . . 240*n* (e.g., inclusive of the magnetic coupling force 235 of the ferromagnet assemblies 230*a*, 230*b* . . . 230*m* (e.g., permanent magnet assemblies), the return force 270 of the separate energy storage element 265, and the opposite electromagnetic coupling force of the electromagnet assemblies 240*a*, 240*b* . . . 240*n*).

The graph 300 of FIGS. 3A and 3B additionally illustrates where the different operational states of the downhole device 200 of FIGS. 2A through 2K reside in relation to the second and third data sets 320, 330. Thus, at the operational state of FIG. 2A, the downhole device 200 is at a net positive force, and thus the movable element 220 is being biased to the left (e.g., position A/H of FIG. 3A). The instant the electric power (e.g., Z Watts of electric power>0) is supplied to the electromagnet assemblies 240*a*, 240*b* . . . 240*n*, the downhole device 200 is at a net negative force, and thus the movable element 220 is being actuated to the right, as shown in the operational states of FIGS. 2B through 2F (e.g., positions B, C, D, E, and F of FIG. 3A). The instant the electric power is discontinued to the electromagnet assemblies 240*a*, 240*b* . . . 240*n* (e.g., or alternatively the voltage of the electric power is reversed), the downhole device 200 is again at a net positive force, and thus the movable element 220 is again being biased to the left, as shown in the operational states of FIGS. 2G and 2H (e.g., positions G and H of FIG. 3A).

The graph 300 additionally illustrates that electric powers less than Z Watts may be used for the downhole device 200 of FIGS. 2A through 2K and still actuate the movable element 220. The graph 300, very importantly, further illustrates that the magnetic coupling force, the return force, and the relative positions of the ferromagnet assemblies 230*a*, 230*b* . . . 230*m* (e.g., permanent magnet assemblies) and the electromagnet assemblies 240*a*, 240*b* . . . 240*n* may be set along the stroke distance (D) such that the required electric power needed to generate the opposite electromagnetic coupling force greater than the magnetic coupling force and the return force (e.g., to actuate the movable element 220) decreases as the movable element 220 moves from the first position to the second position. With this illustration, it becomes clear that the electric power being supplied to the electromagnet assemblies 240*a*, 240*b* . . . 240*n* may be reduced when the movable element 220 is at or near the point when it reaches the second position, for example to a value such that the net force is just slightly negative, as shown by the modified fourth data set 340 of FIG. 3B. Once the movable element 220 has reached (e.g., or nearly reached) the second position, the amount of electric power required for acceleration is reduced, and thus the electric power supplied may be reduced. In doing such, the movable element 220 would be held in the second position, but the electric power required to do so would be greatly reduced. In the illustrated embodiment, the electric power required to hold the movable element 220 in the second position might be reduced by at least 10%, if not by at least 20%, if not by at least 30%, if not by at least 40%, if not by at least 50%, if not by at least 60%, if not by at least 70%, if not by at least 80%, if not by at least 90%, if not by at least 100%, if not by at least 125%, if not by at least 150%, if not by at least 175%, if not by at least 200% of more. The graph 300 lastly illustrates that the downhole device 200 may be redesigned, for example by simply changing the location of a few no go shoulders (e.g., the stops 212) associated with the movable element 220, to shift a location of the stroke distance (D) of the movable element 220 left or right along the graph 300. Doing so may be used to adjust an amount of electric power that may be needed/saved between the actuation of the movable element 220 toward the second position, and the holding of the movable element 220 at the second position. Heretofore, nobody has recognized this important energy saving feature.

The graph 300 of FIGS. 3A and 3B is being discussed employing a nominal value of Z Watts>0 for creating the net negative force sufficient to move the movable element 220 from position 2 to position 6. Those skilled in the art understand that the value of Z required to begin movement and/or continue movement may vary greatly based upon the design of the downhole device 200, and more particularly the design of the ferromagnet assemblies 230*a*, 230*b* . . . 230*m* (e.g., permanent magnet assemblies), design of the electromagnet assemblies 240*a*, 240*b* . . . 240*n*, design of the separate energy storage element 265, as well as any friction or other forces. In at least one embodiment, Z is at least 50 Watts to begin movement of the moveable element 220 from position 2 to position 6. In yet another embodiment, Z is at least 100 Watts, if not at least 150 Watts, if not at least 200 Watts, if not at least 250 Watts, if not at least 300 Watts, if not at least 350 Watts, if not at least 400 Watts, to begin movement of the moveable element 220 from position 2 to position 6. In yet another embodiment, Z ranges from 75 Watts to 525 Watts, to begin movement of the moveable element 220 from position 2 to position 6. In even yet another embodiment, Z ranges from 125 Watts to 475 Watts, if not from 175 Watts to 425 Watts, if not from 225 Watts to 375 Watts, if not from 275 Watts to 325 Watts, to begin movement of the movable element 220 from position 2 to position 6. Notwithstanding the foregoing, the present disclosure should not be limited to any specific Wattage, unless otherwise required.

Figure 4A:
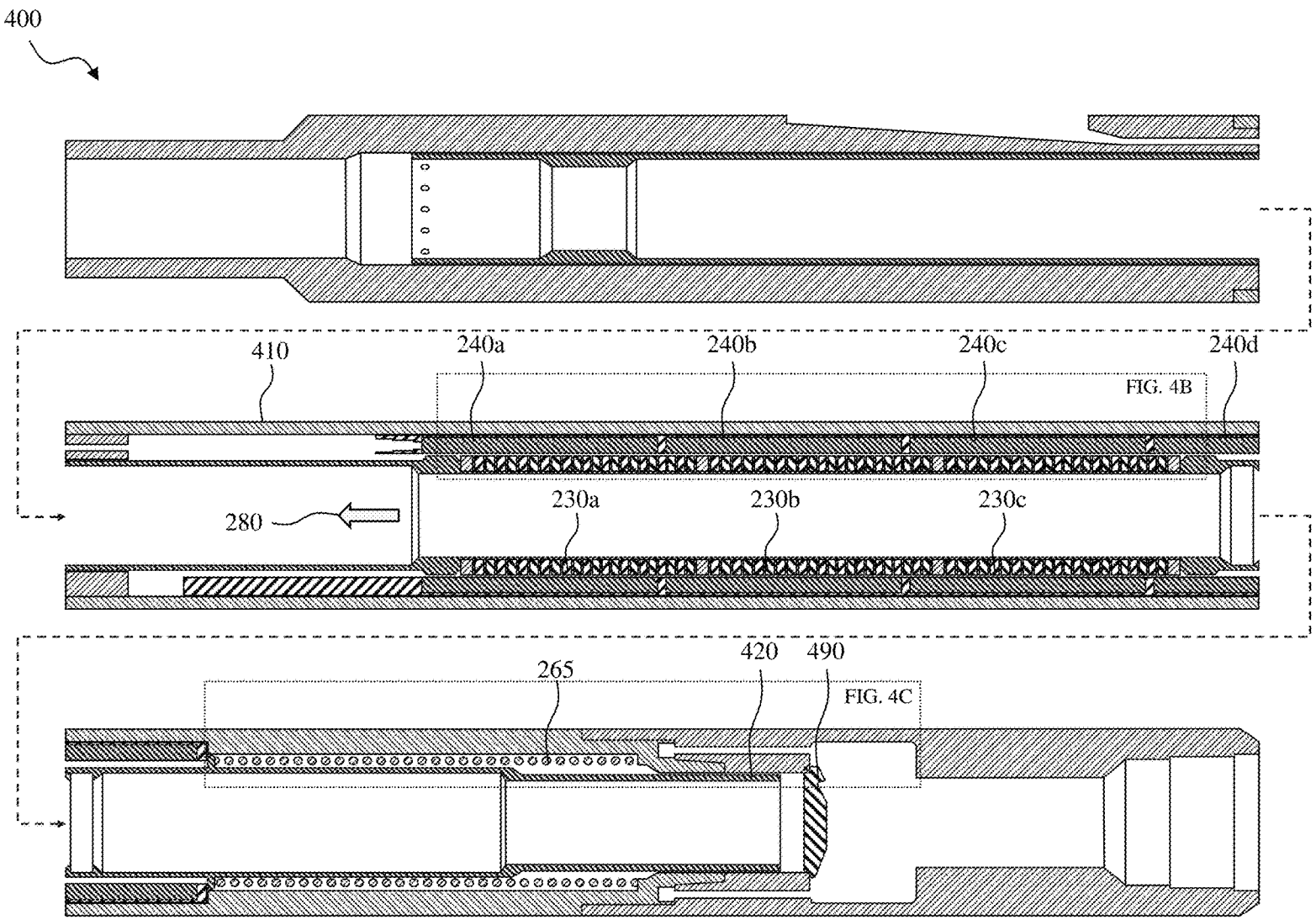
FIGS. 4A through 4X illustrate different cross-sectional views of a downhole device designed, manufactured and/or operated according to one or more alternative embodiments of the disclosure during different operational states.
Figure 4B:
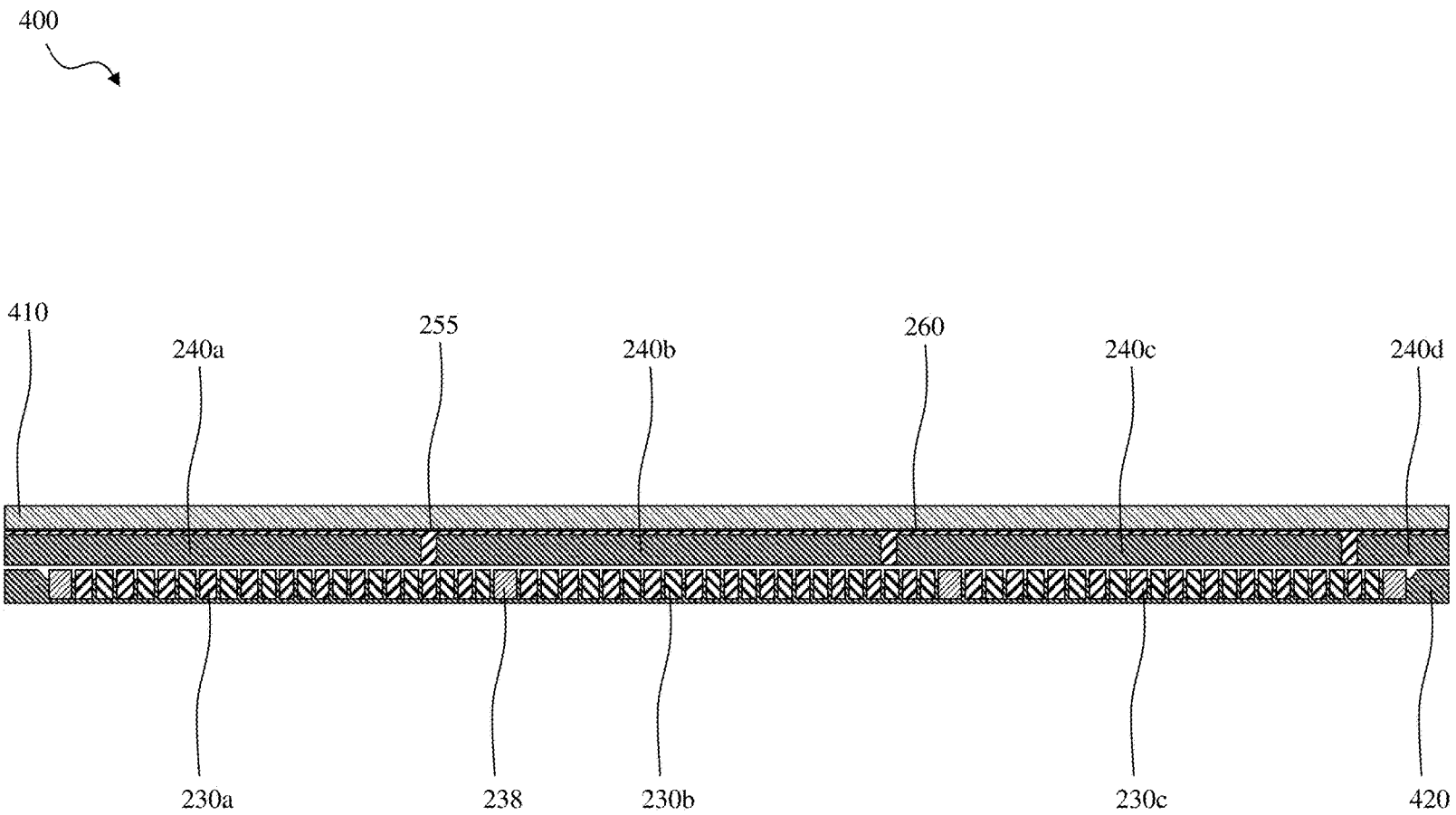
Figure 4C:
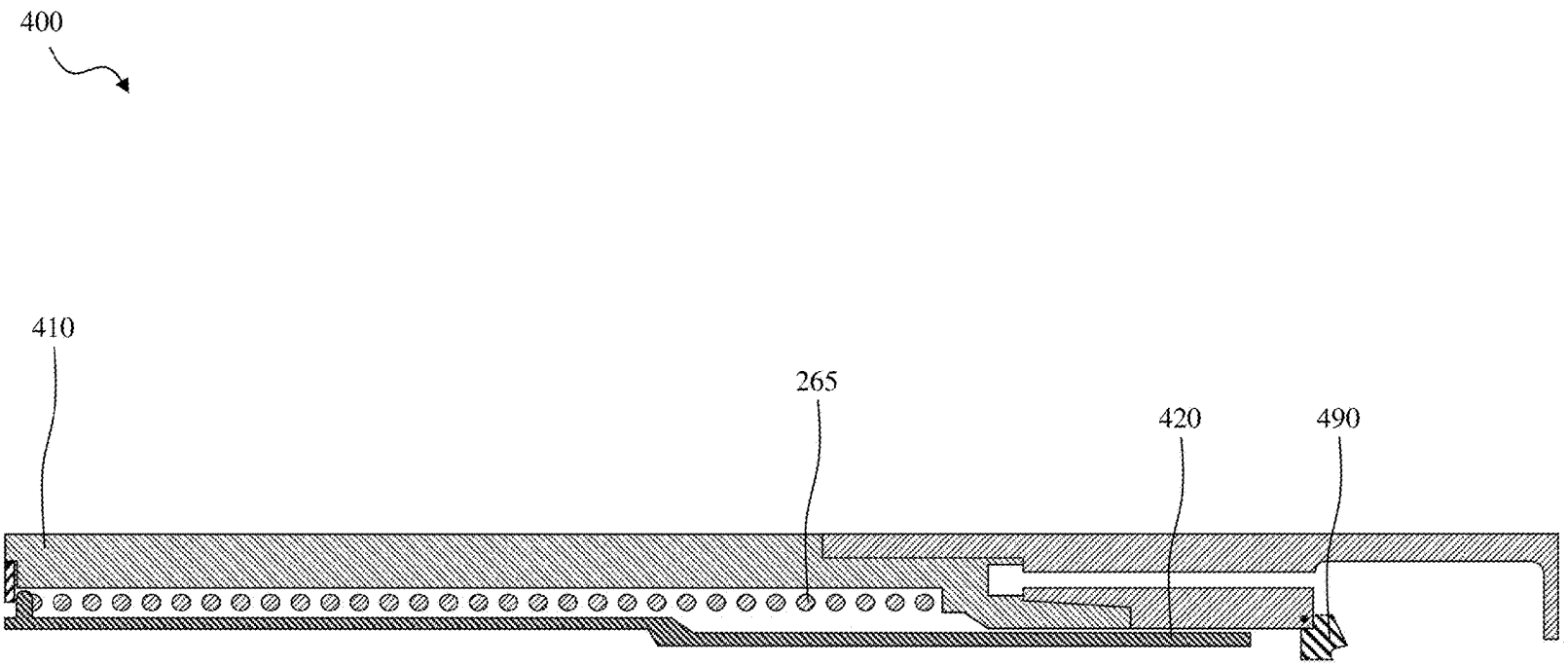
Figure 4D:
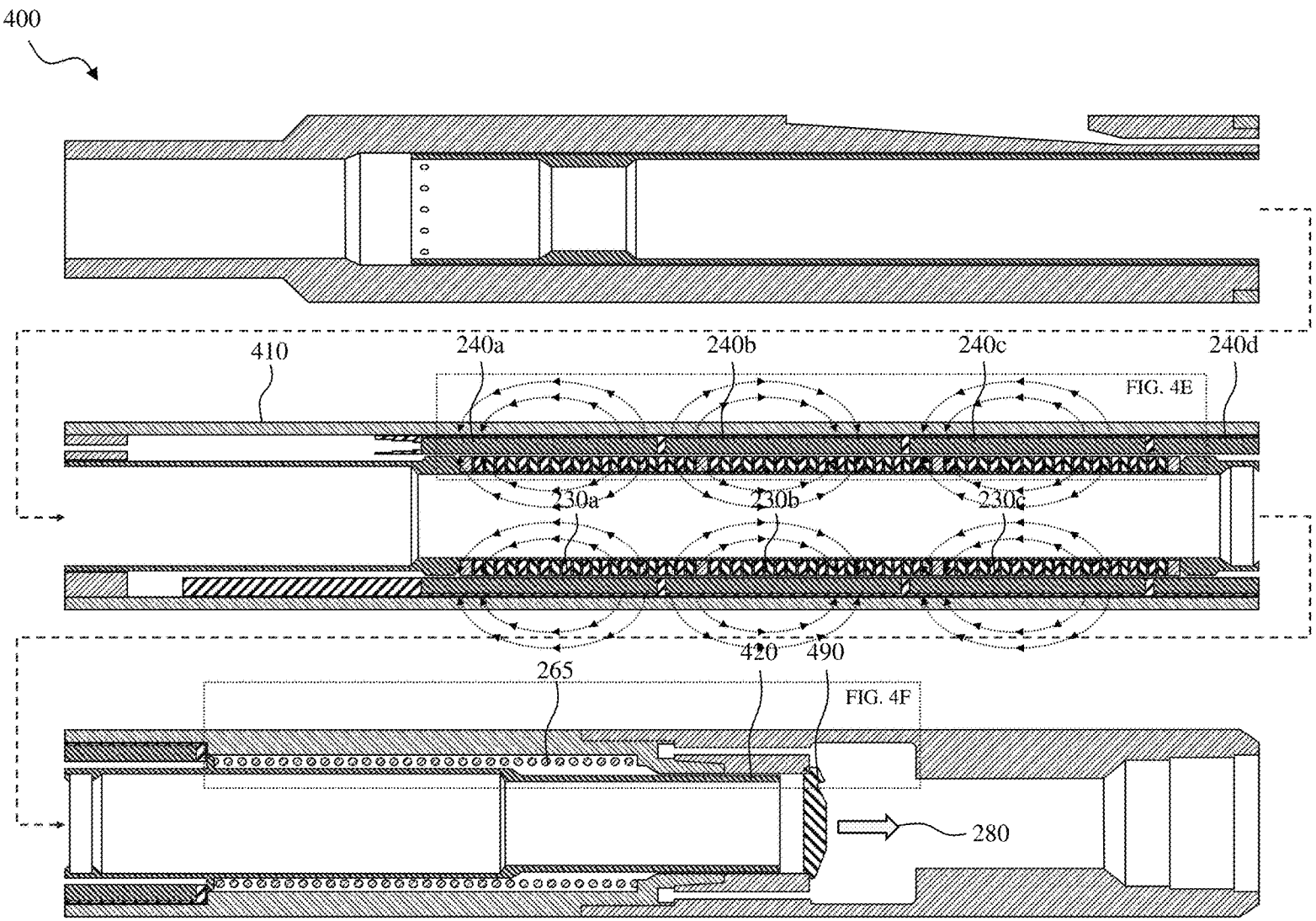
Figure 4E:
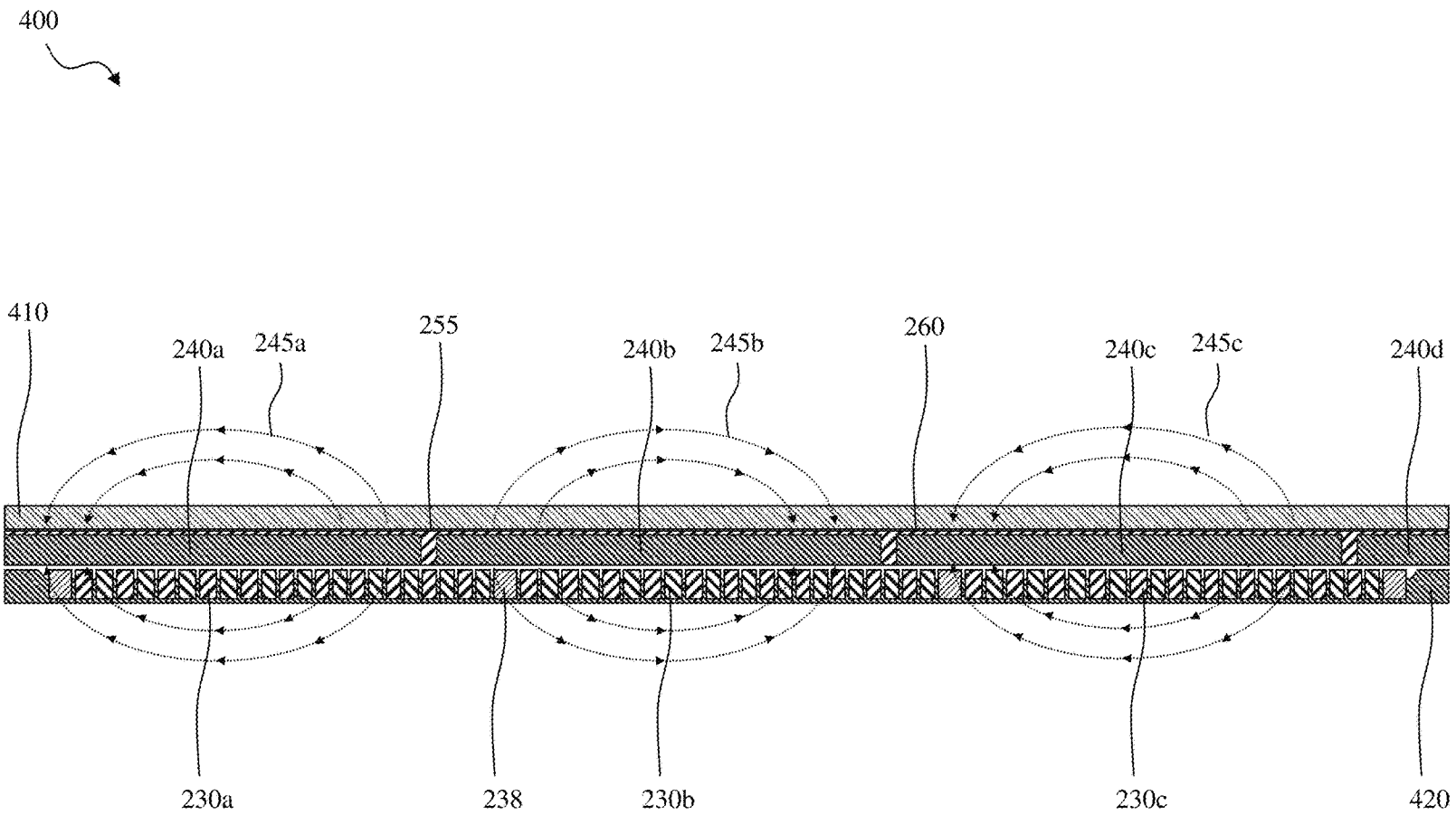
Figure 4F:
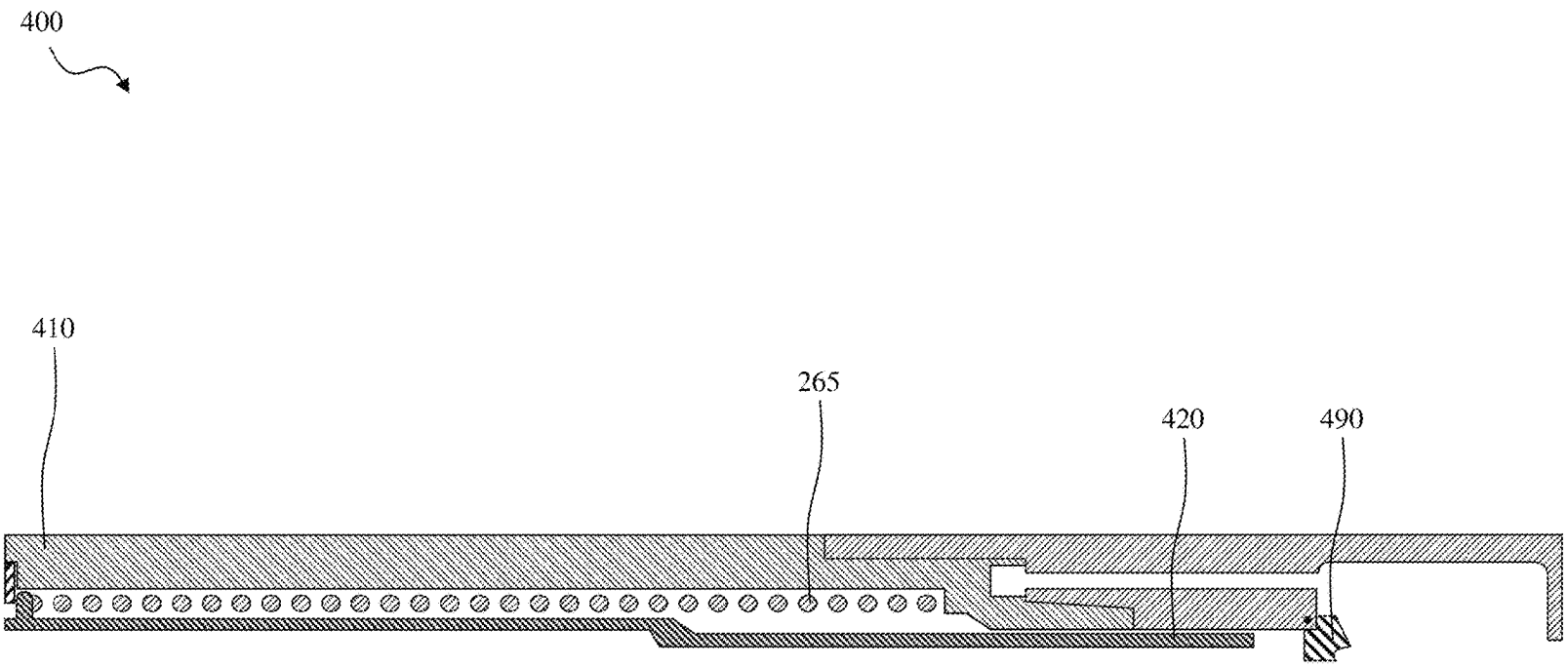
Figure 4G:
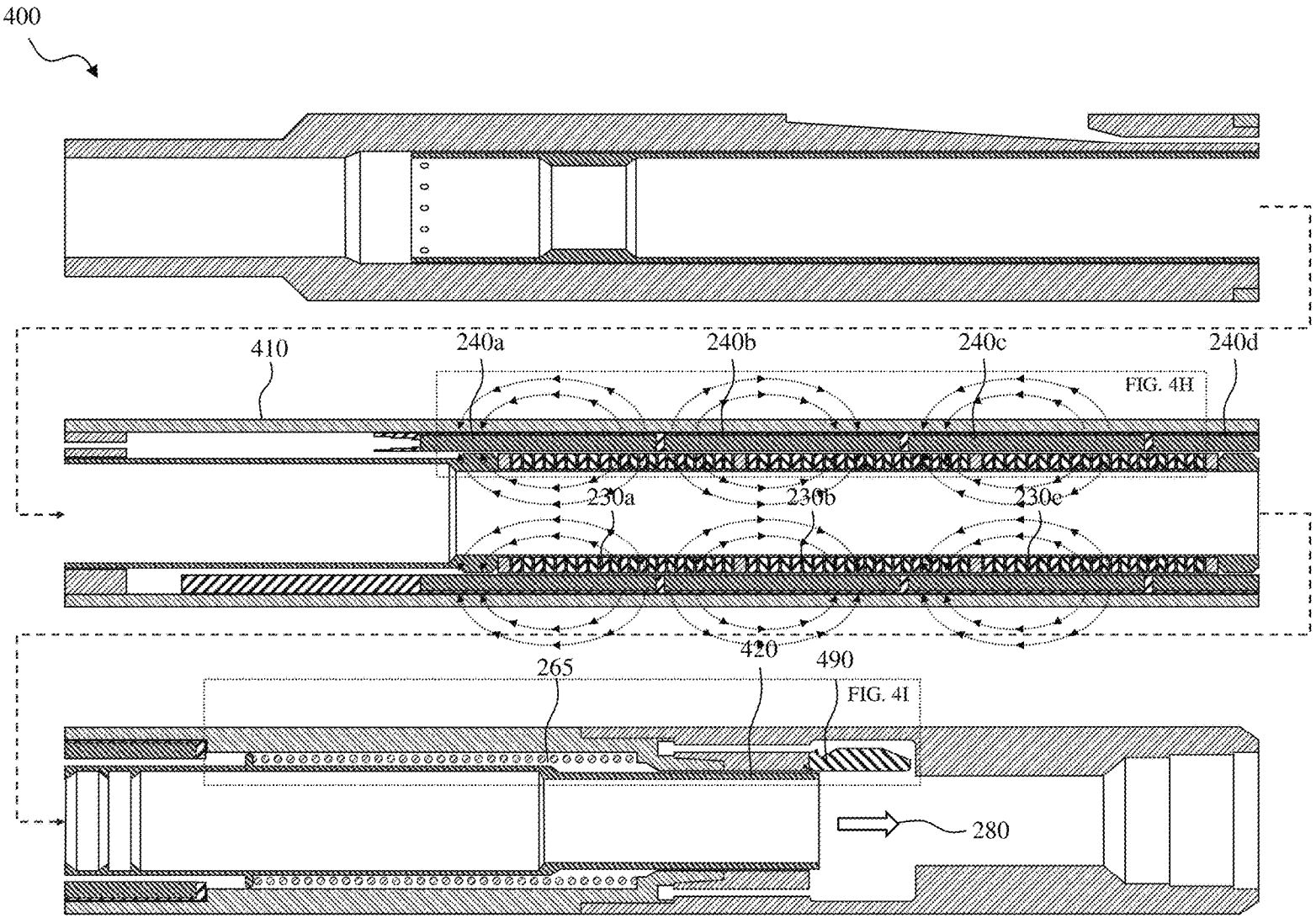
Figure 4H:
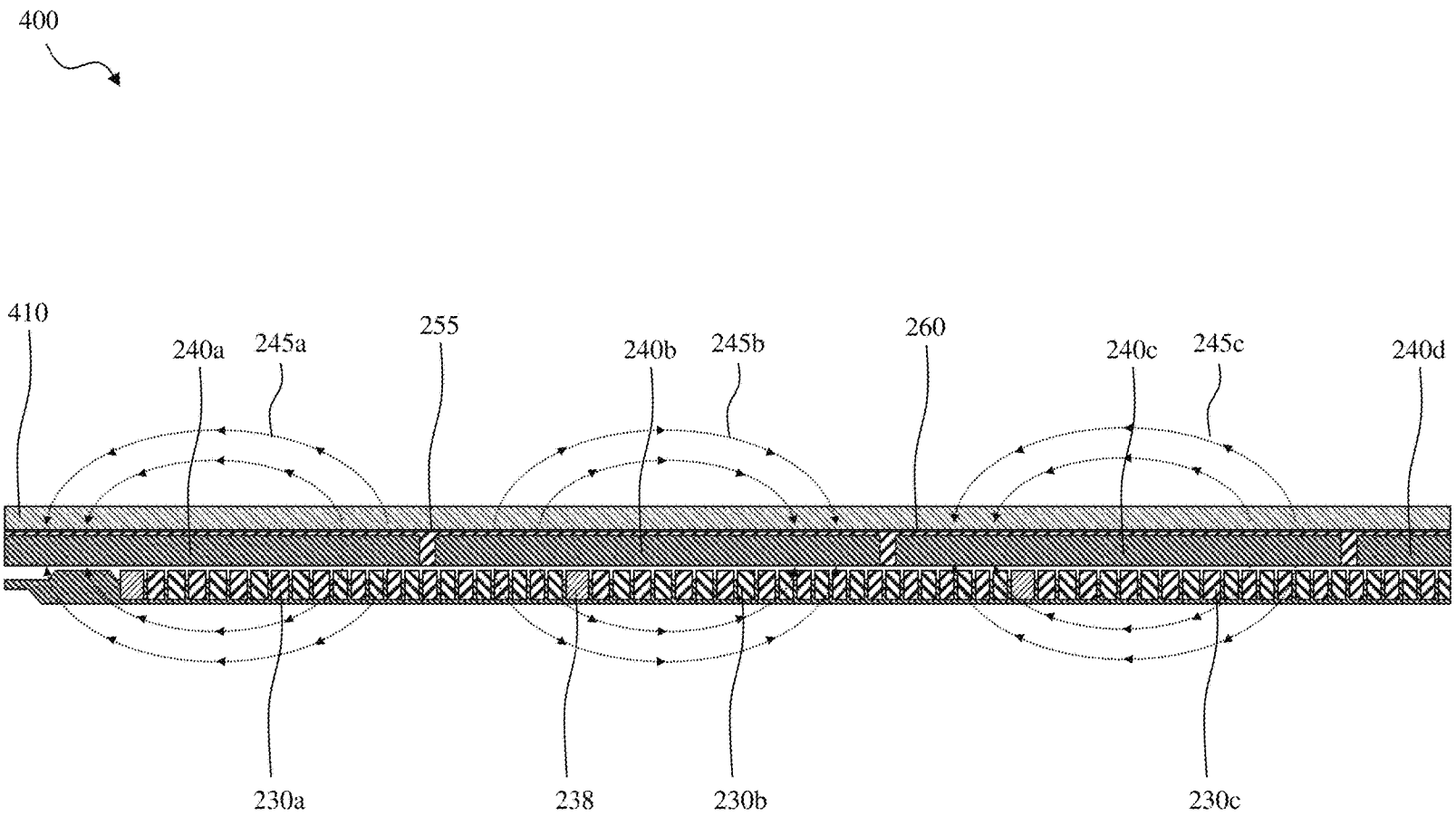
Figure 4I:
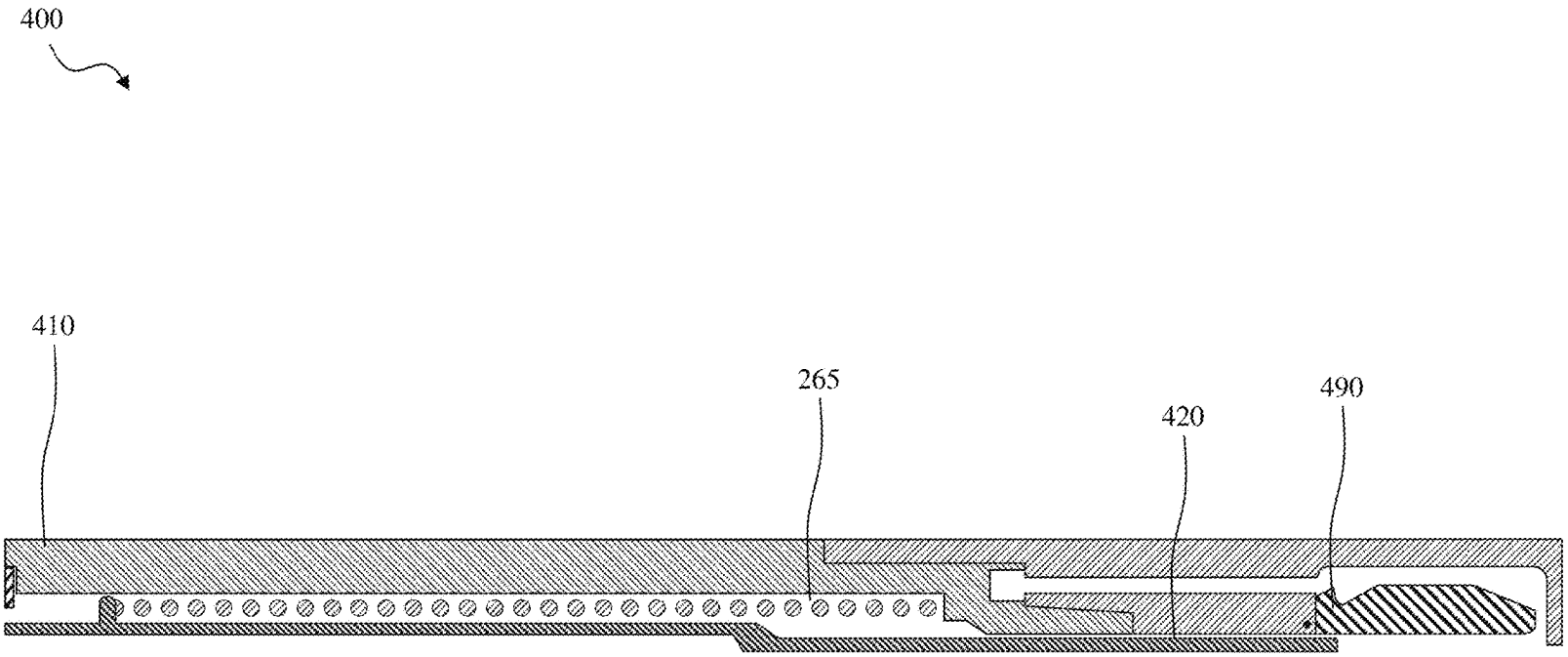
Figure 4J:
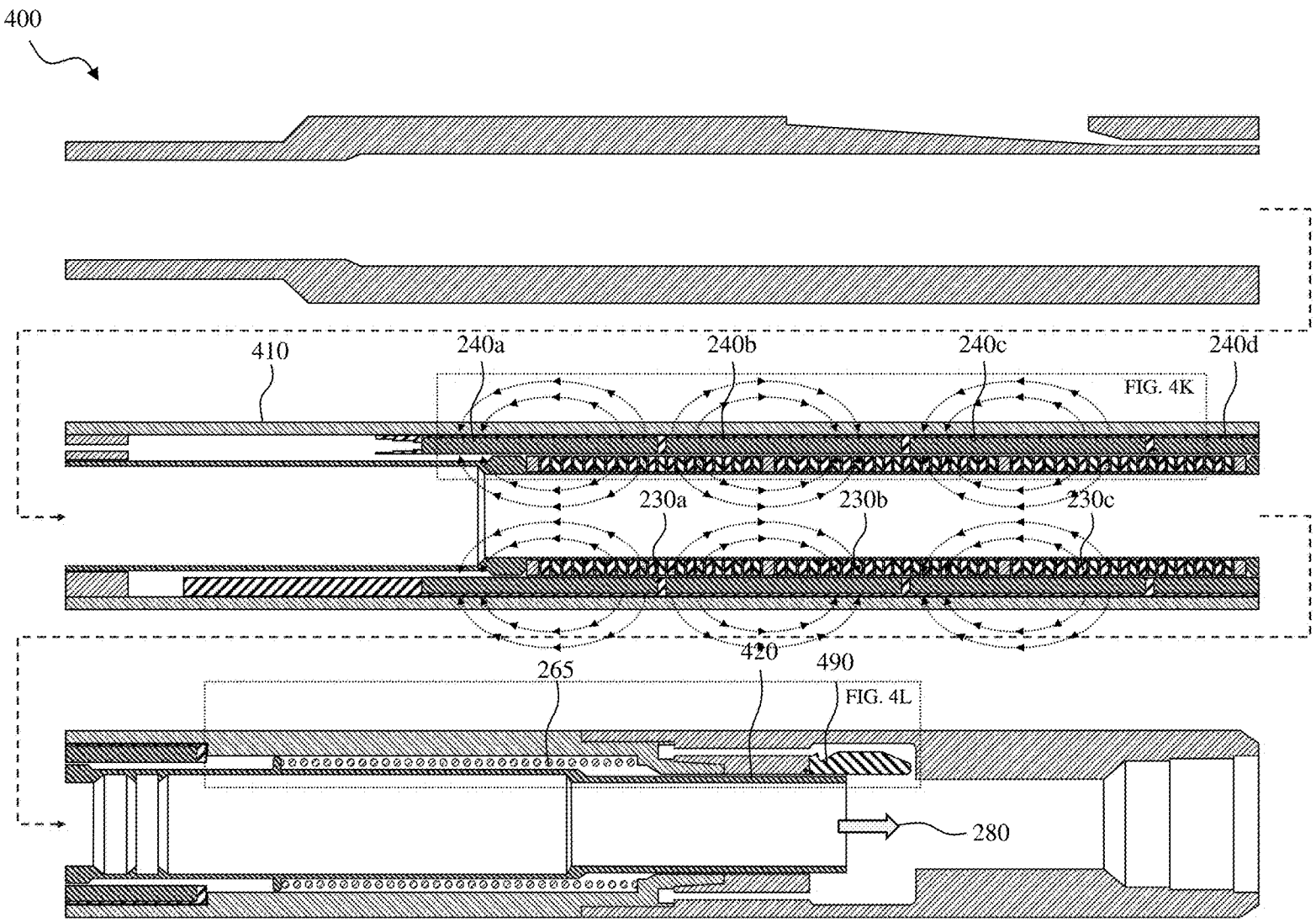
Figure 4K:
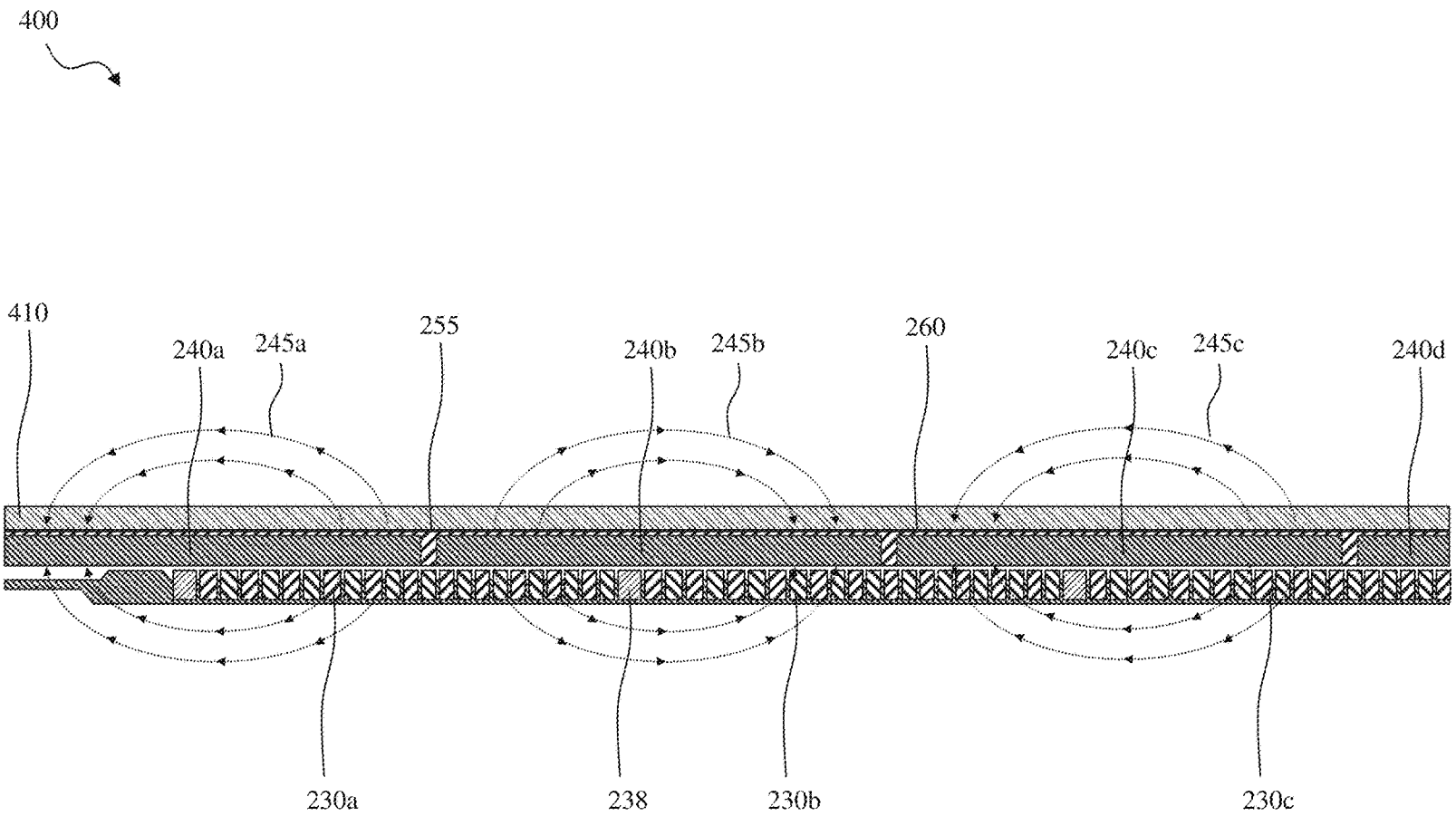
Figure 4L:
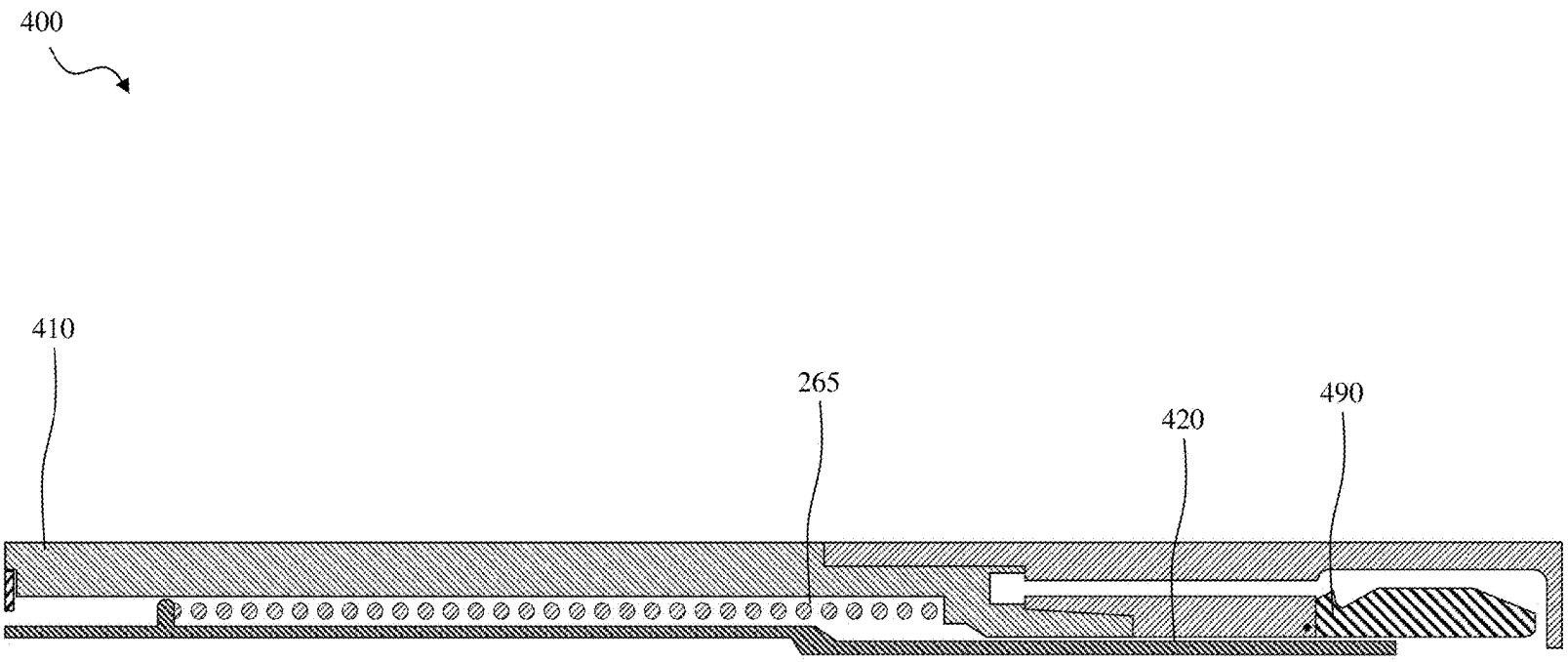
Figure 4M:
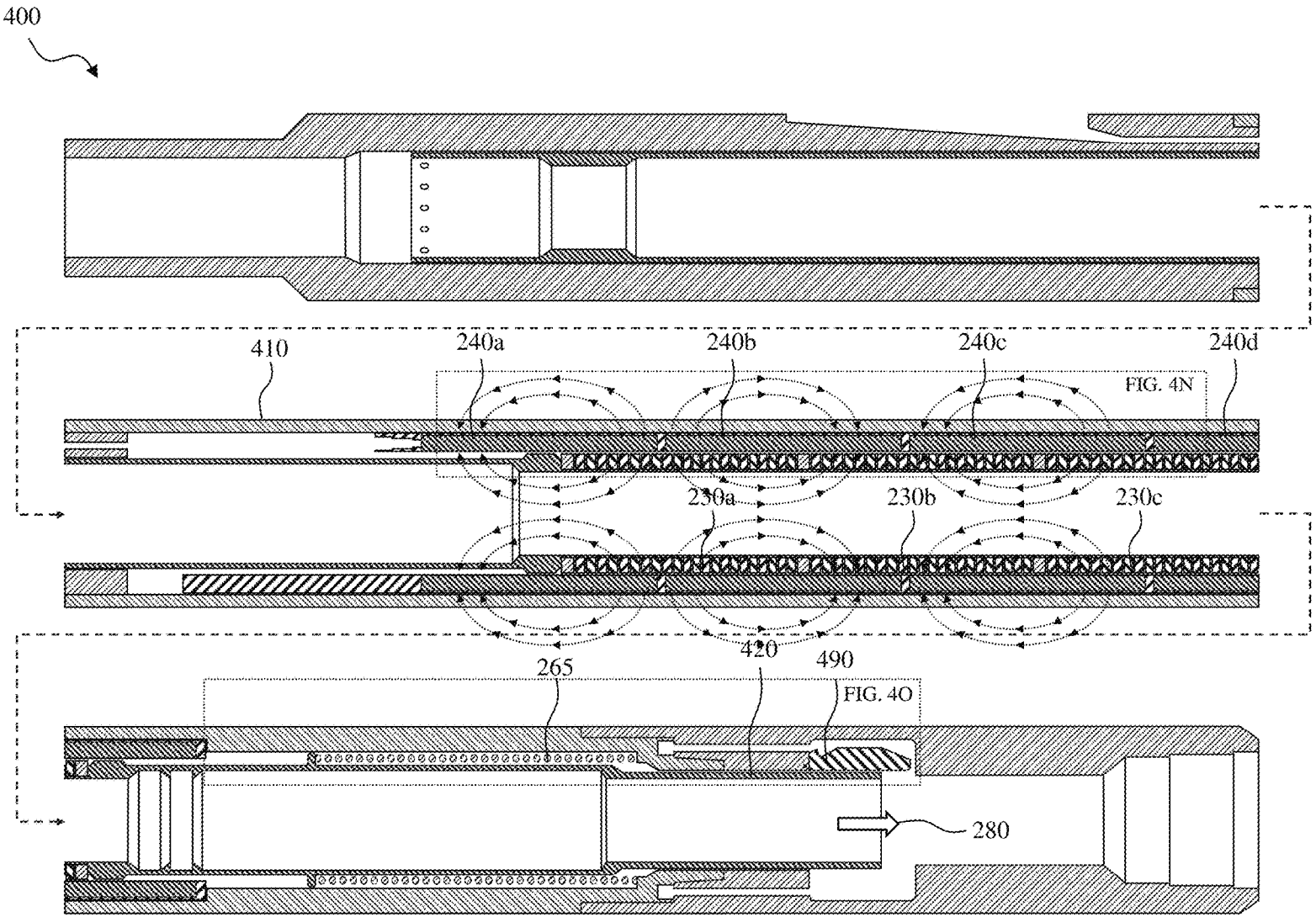
Figure 4N:
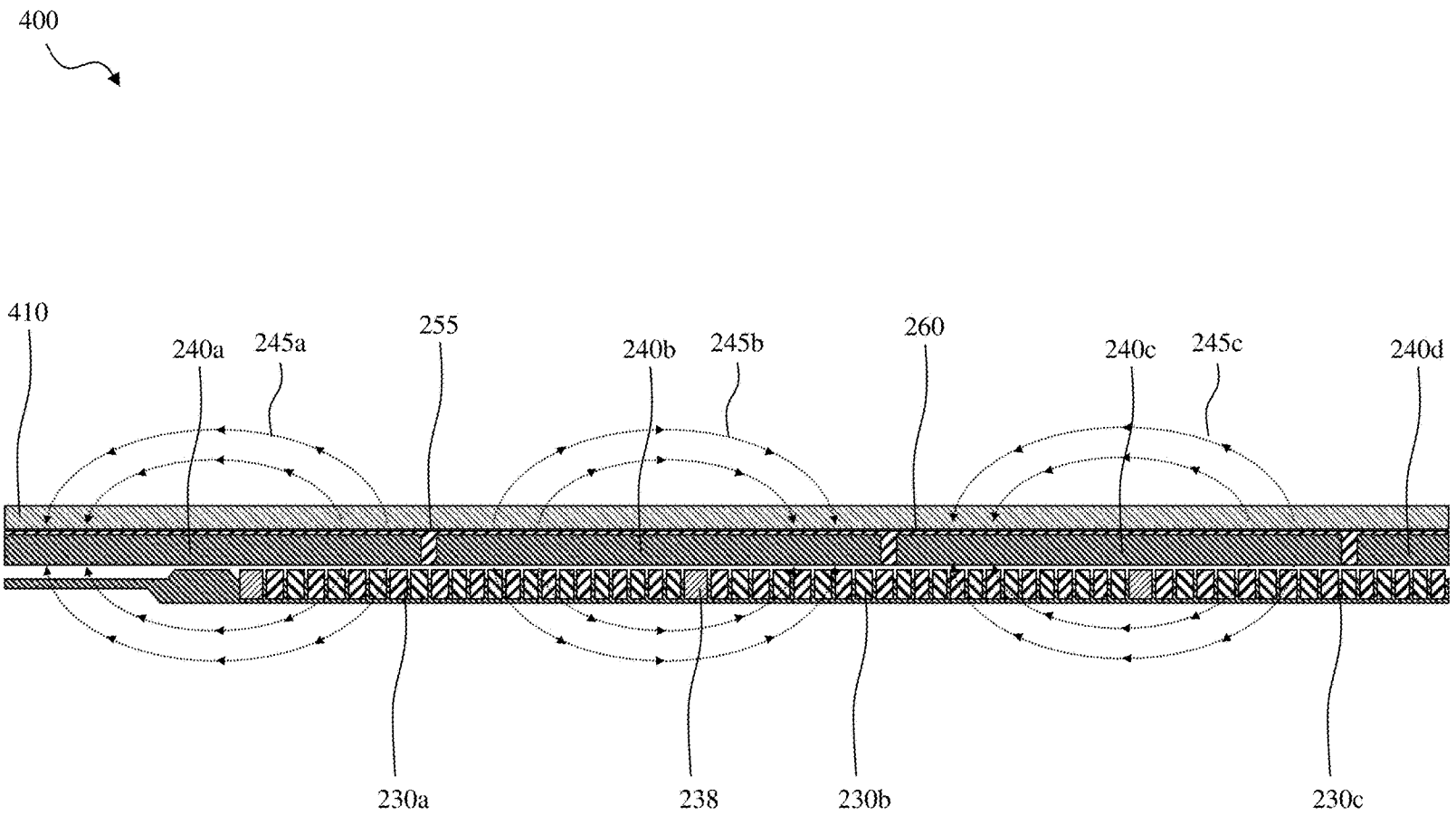
Figure 4O:
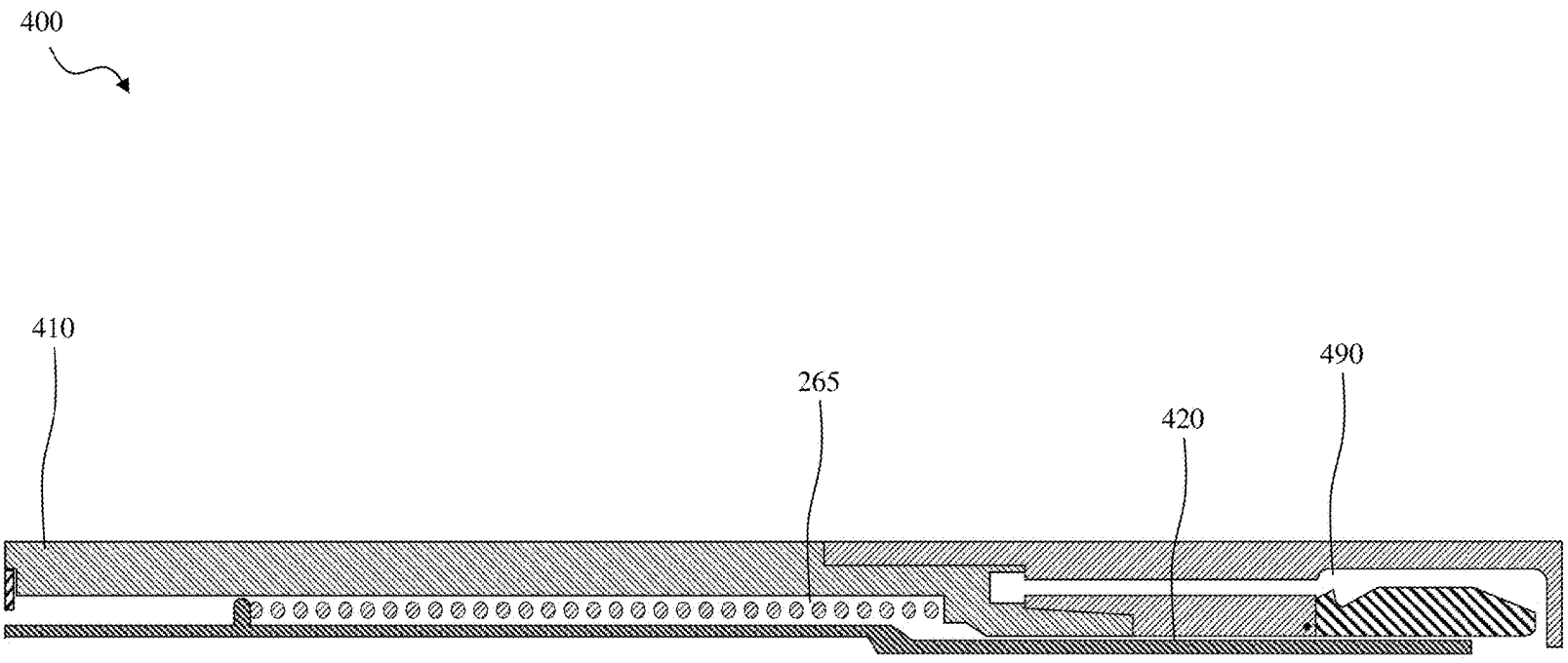
Figure 4P:
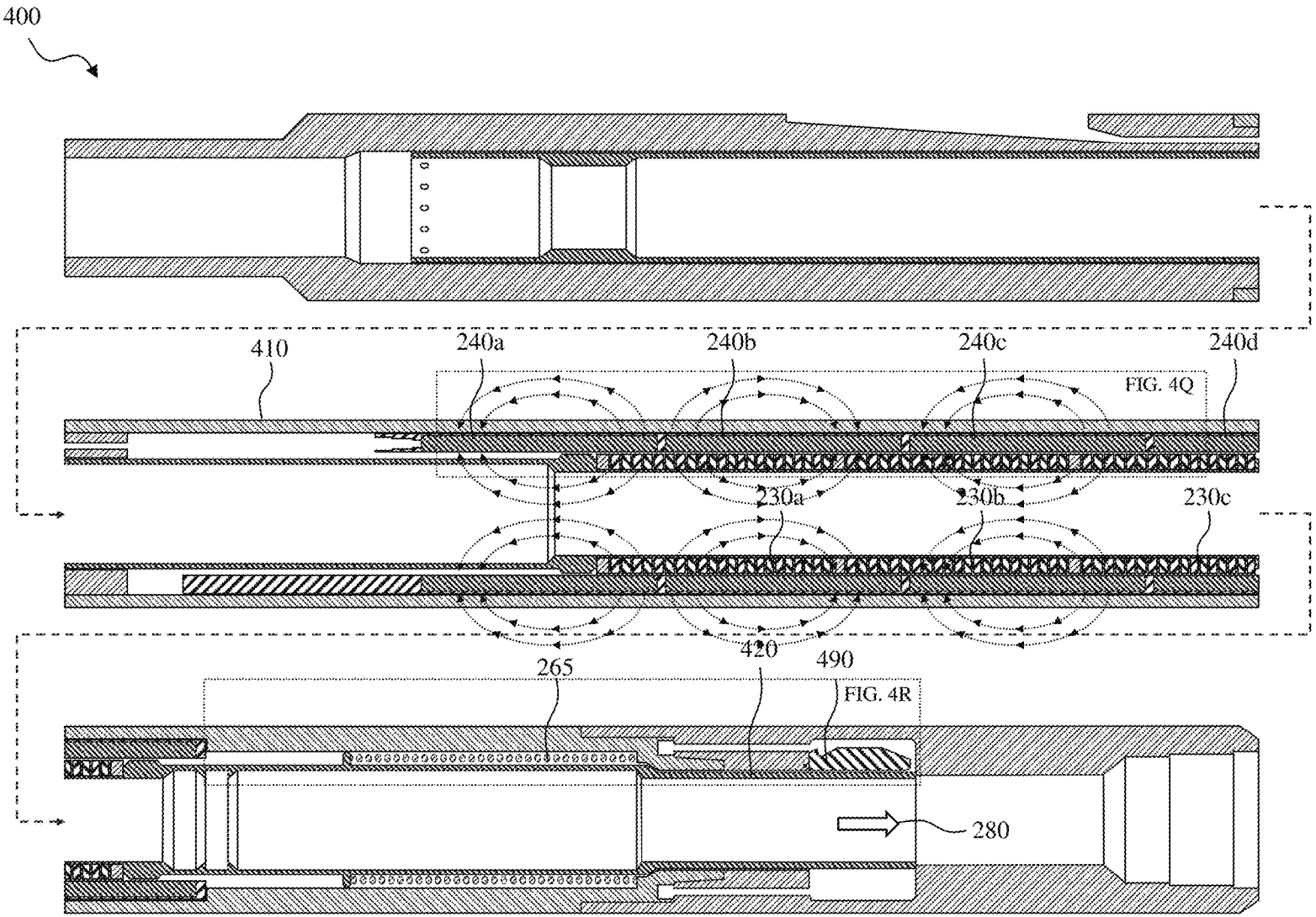
Figure 4Q:
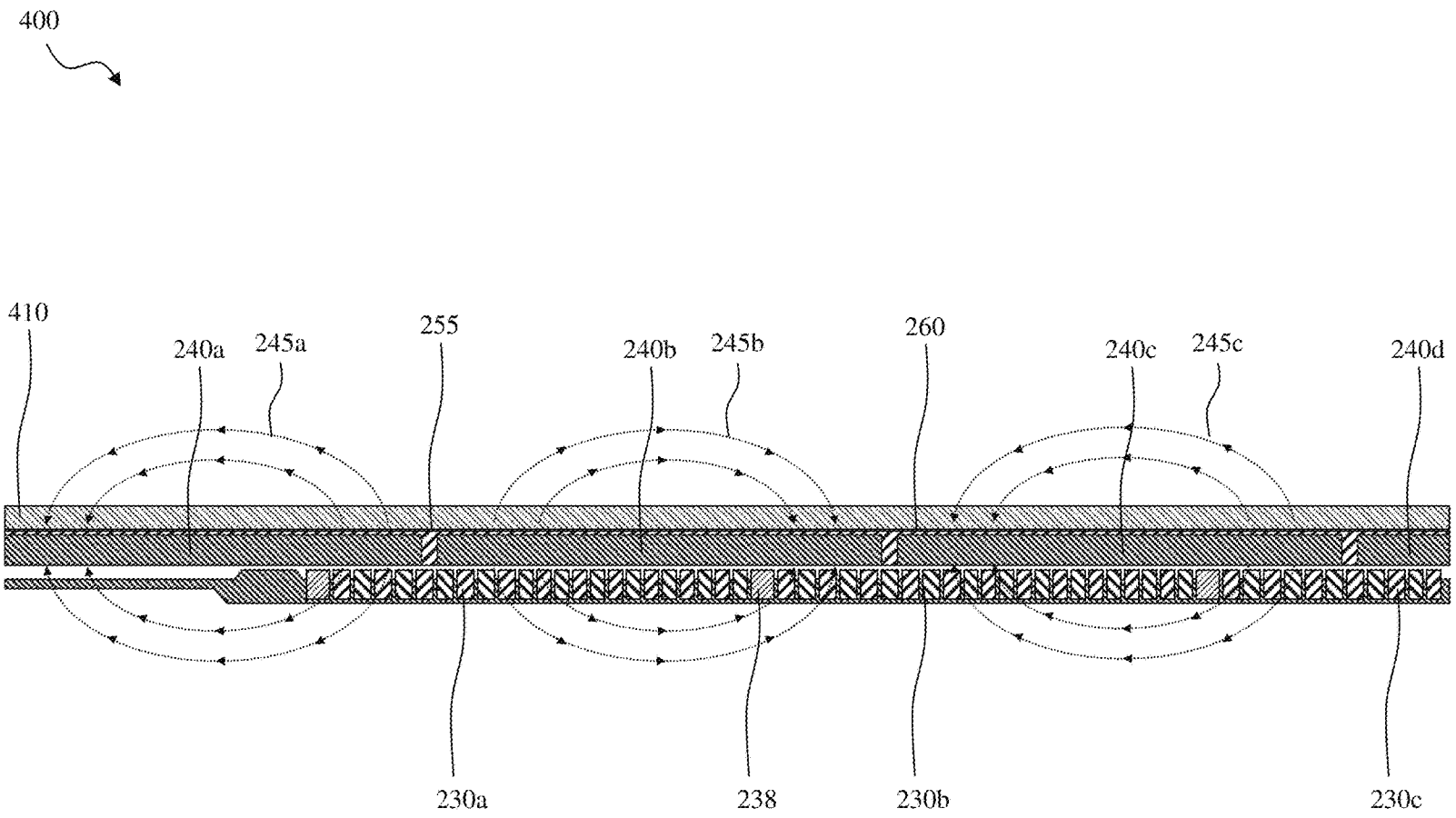
Figure 4R:
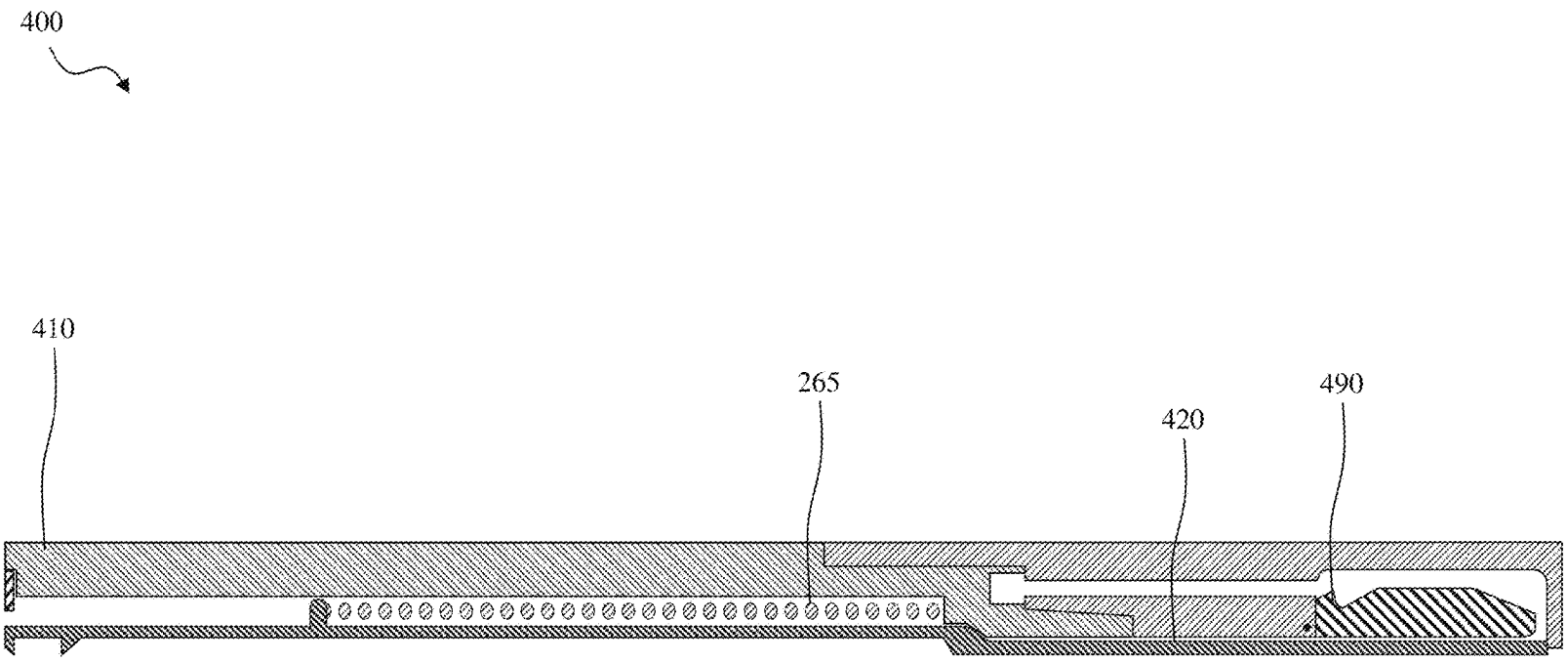
Figure 4S:
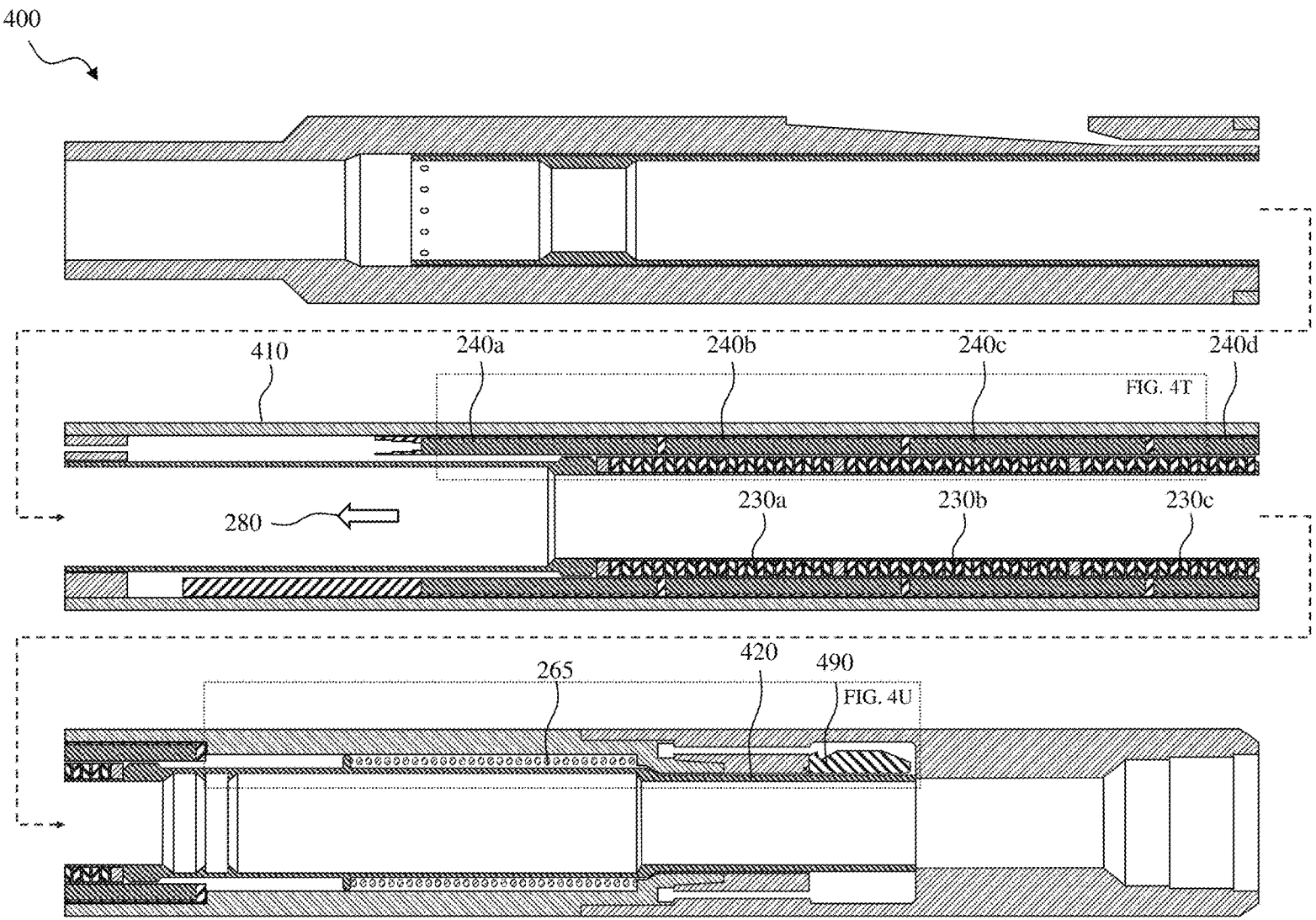
Figure 4T:
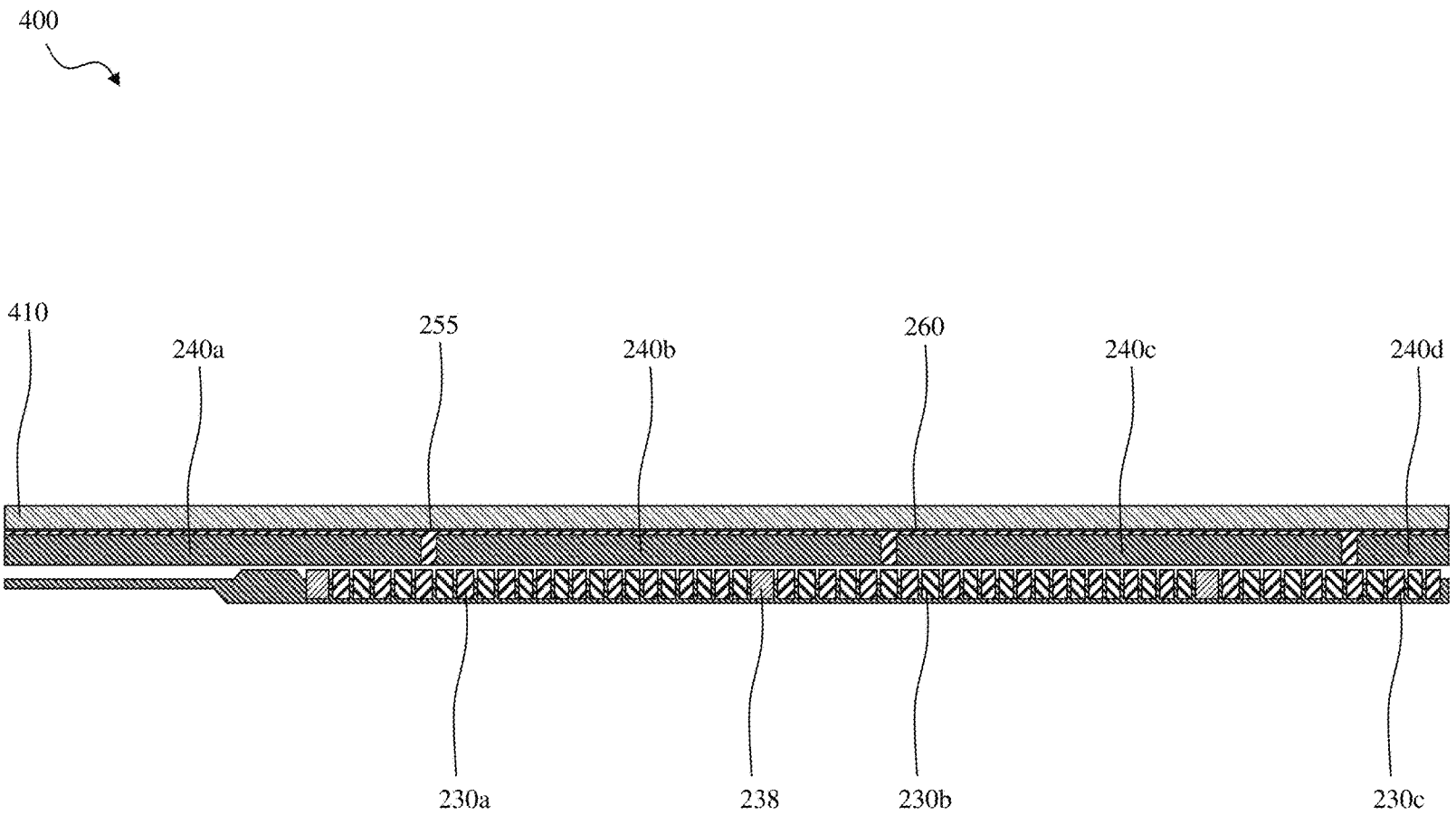
Figure 4U:
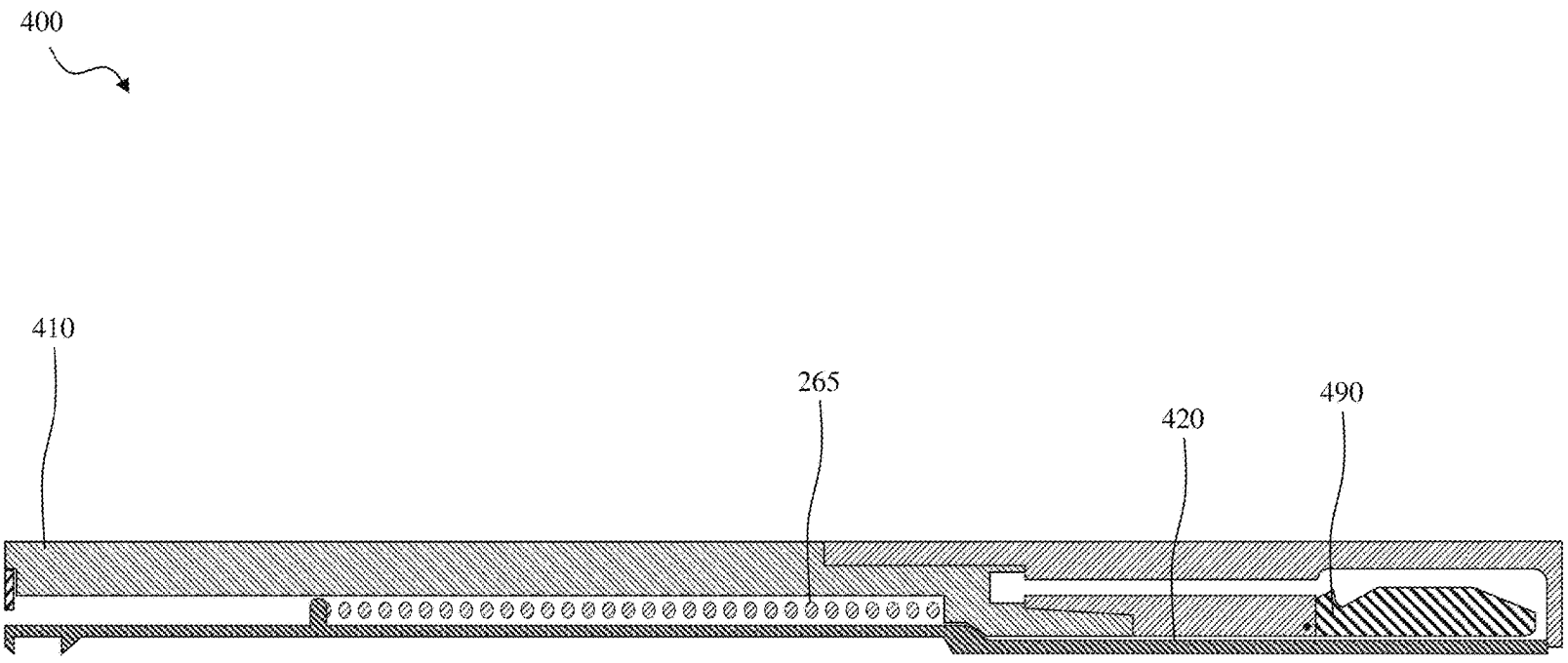
Figure 4V:
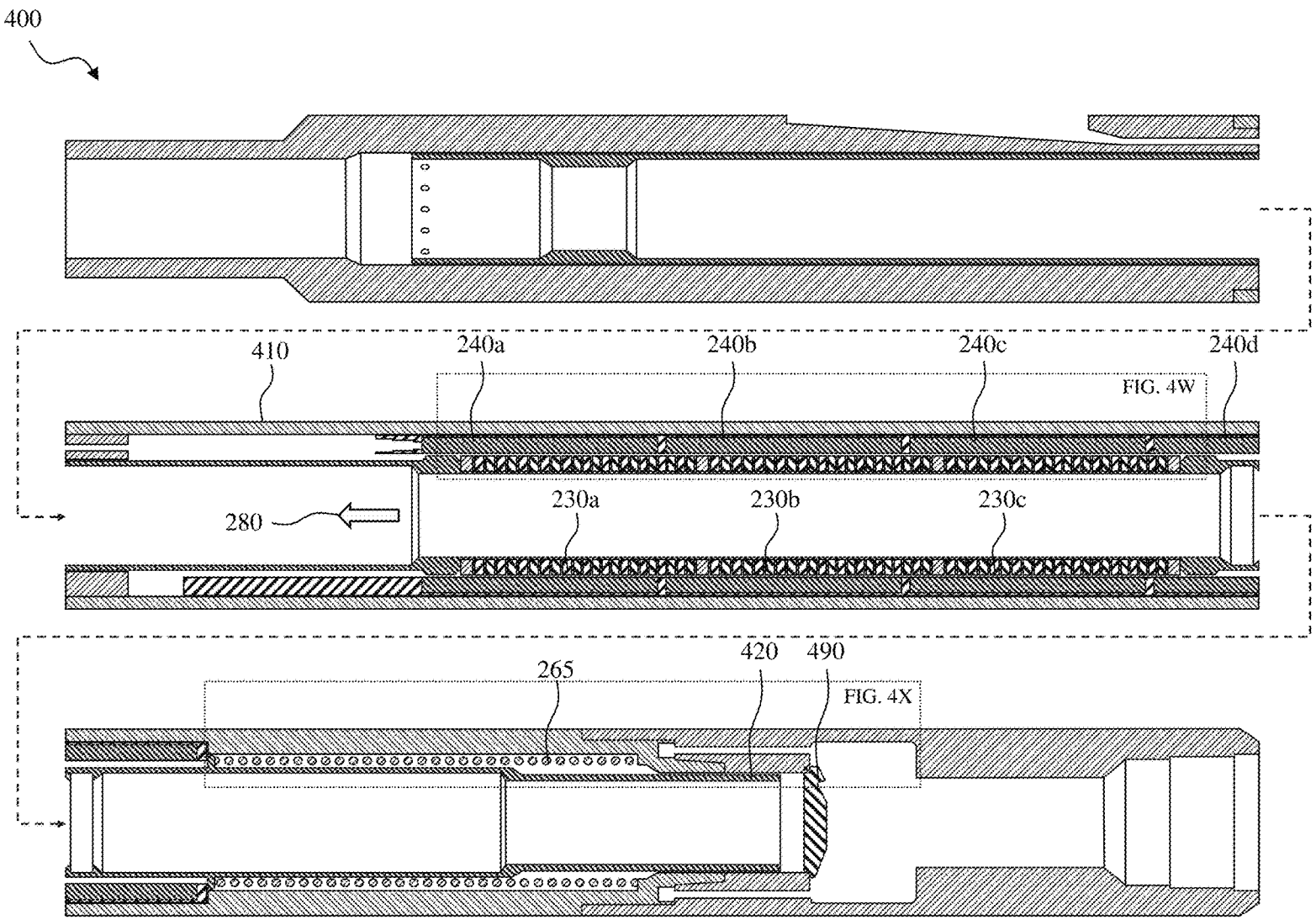
Figure 4W:
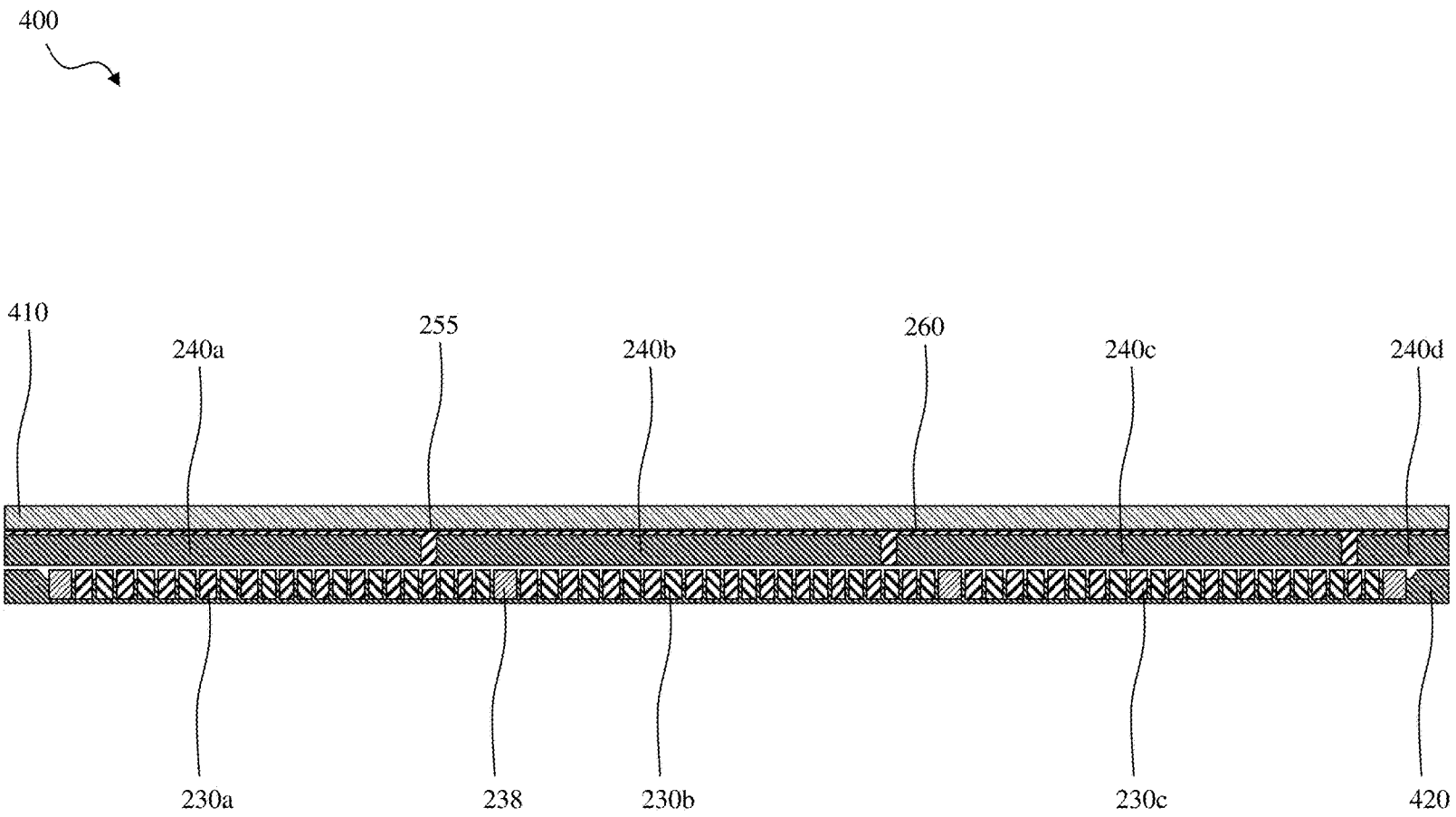
Figure 4X:
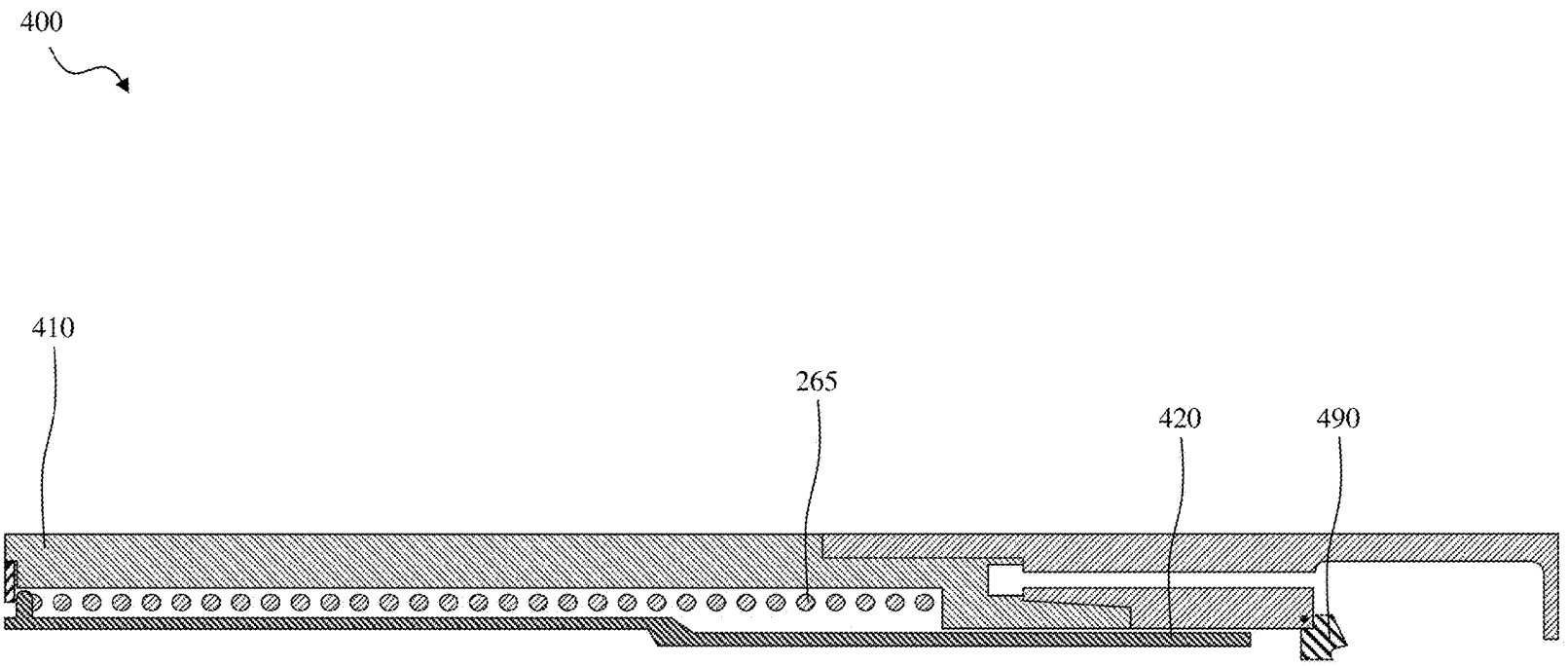
Figure 5A:
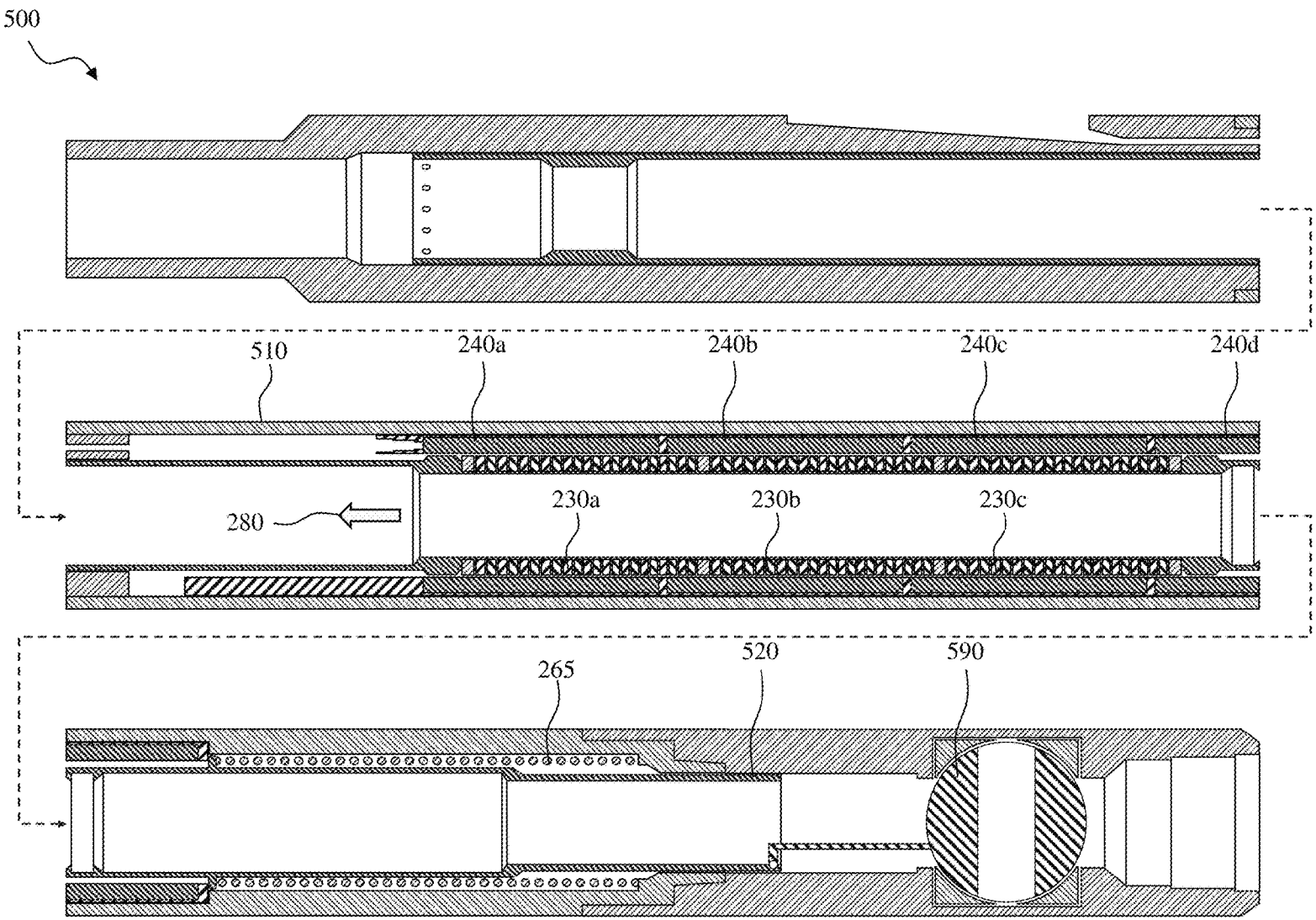
Figure 5B:
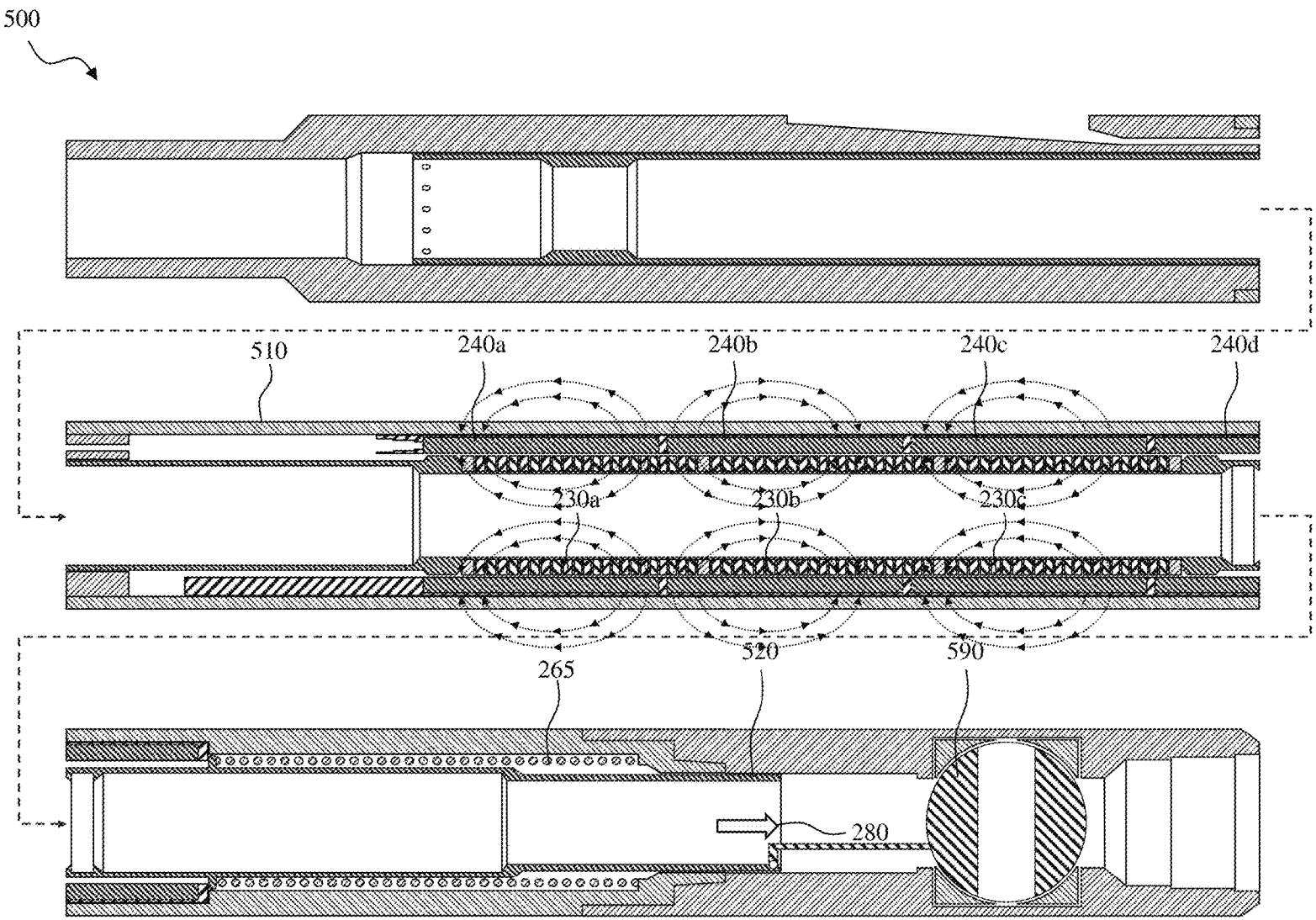
Figure 5C:
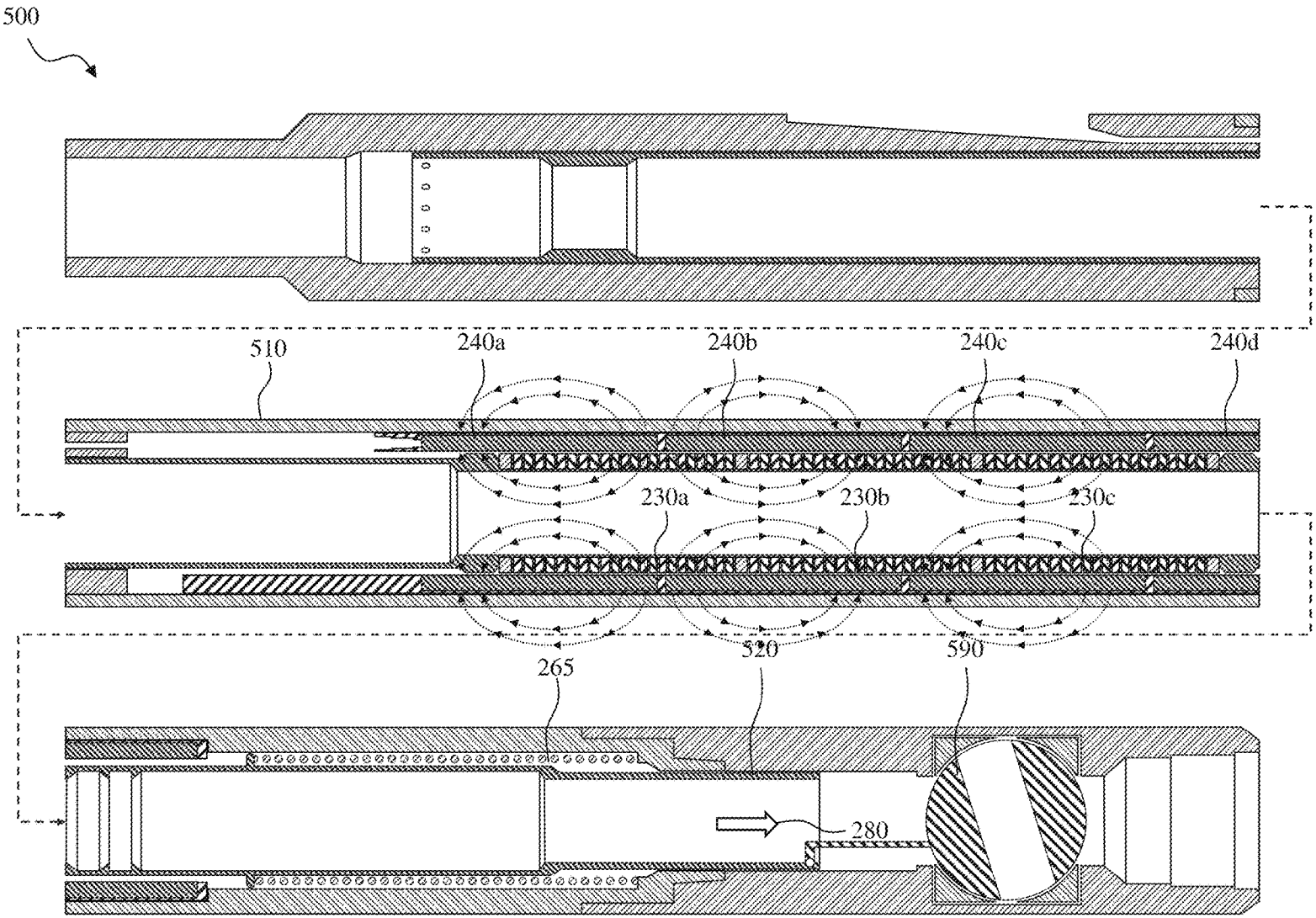
Figure 5D:
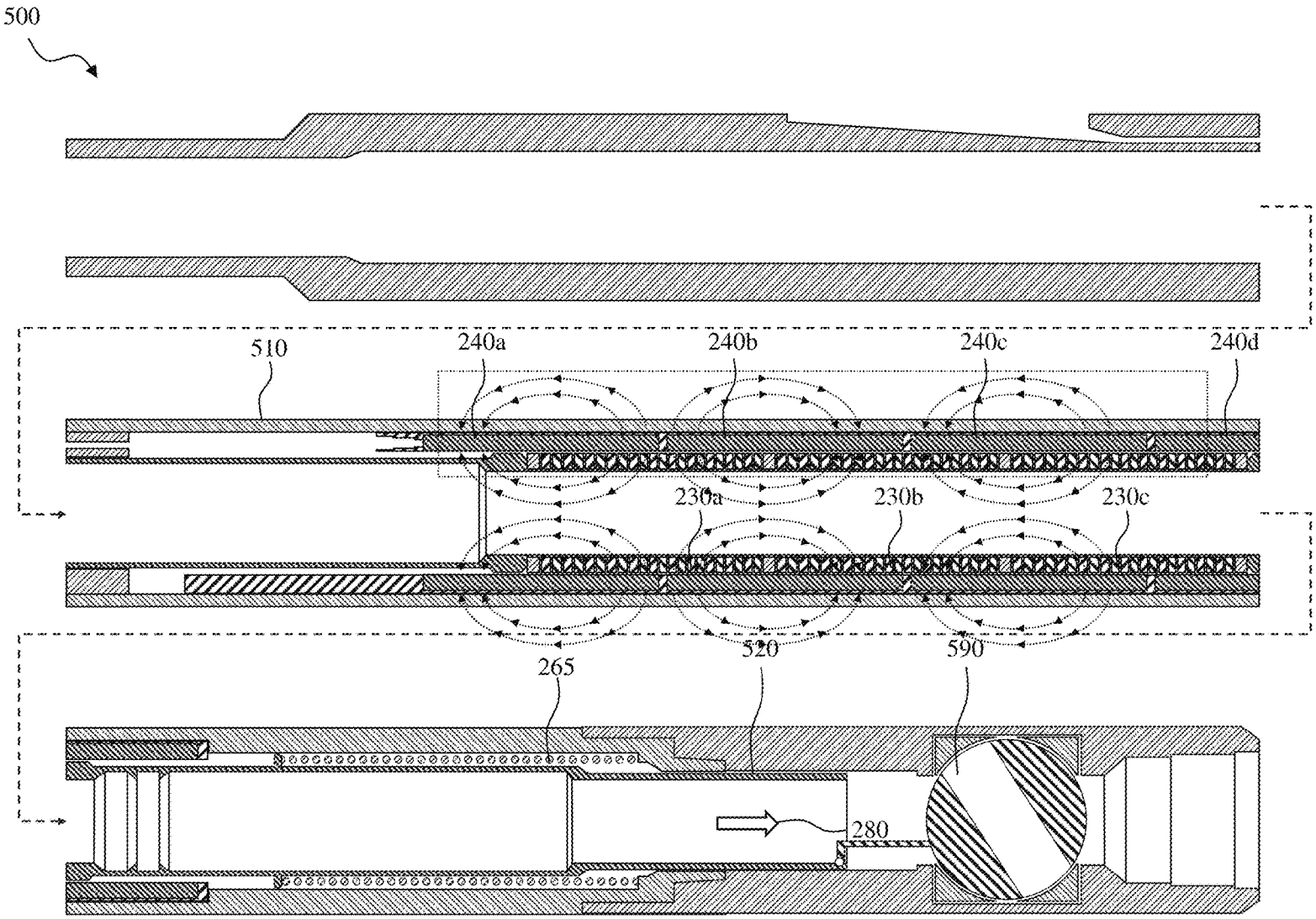
Figure 5E:
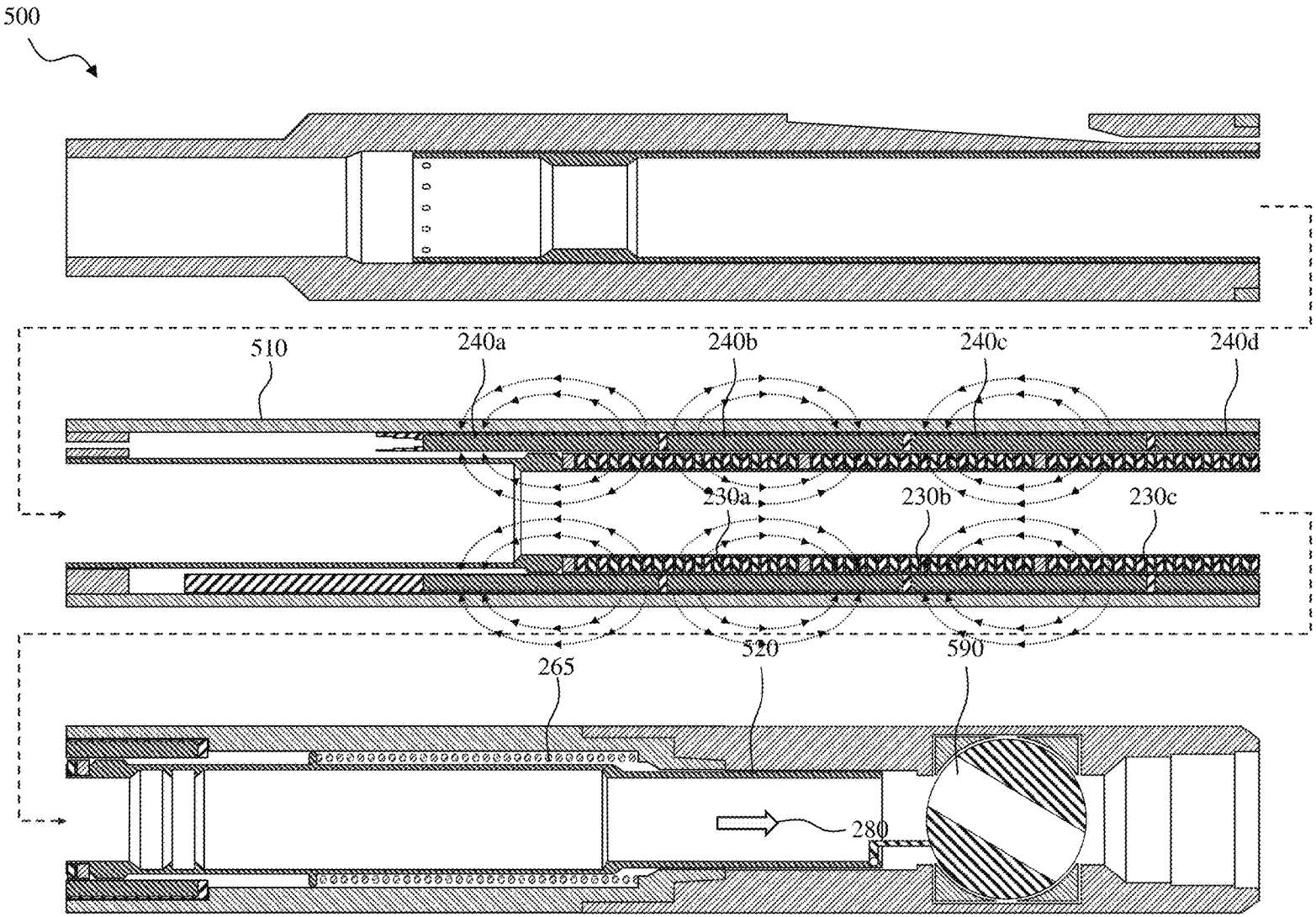
Figure 5F:
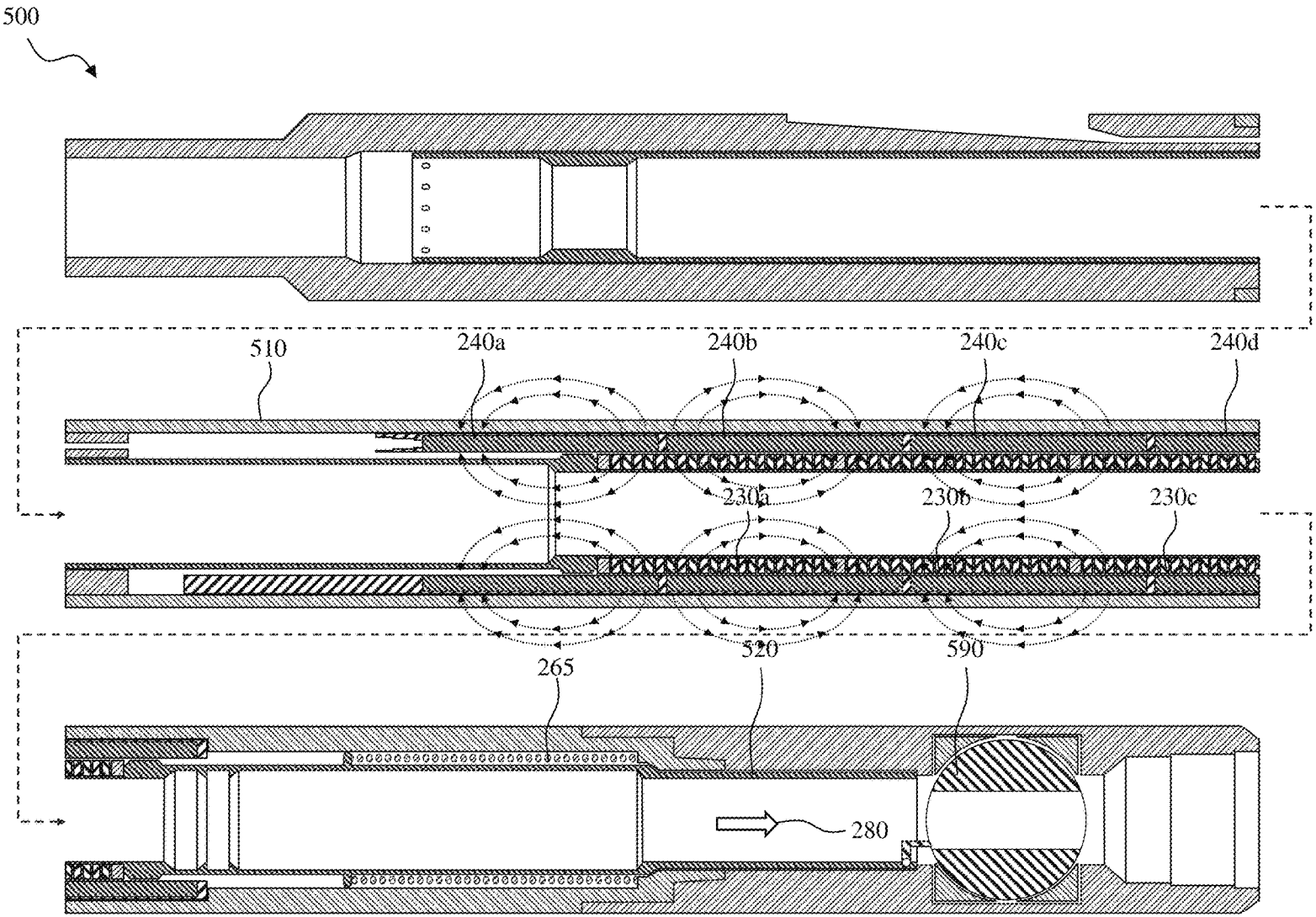
Figure 5G:
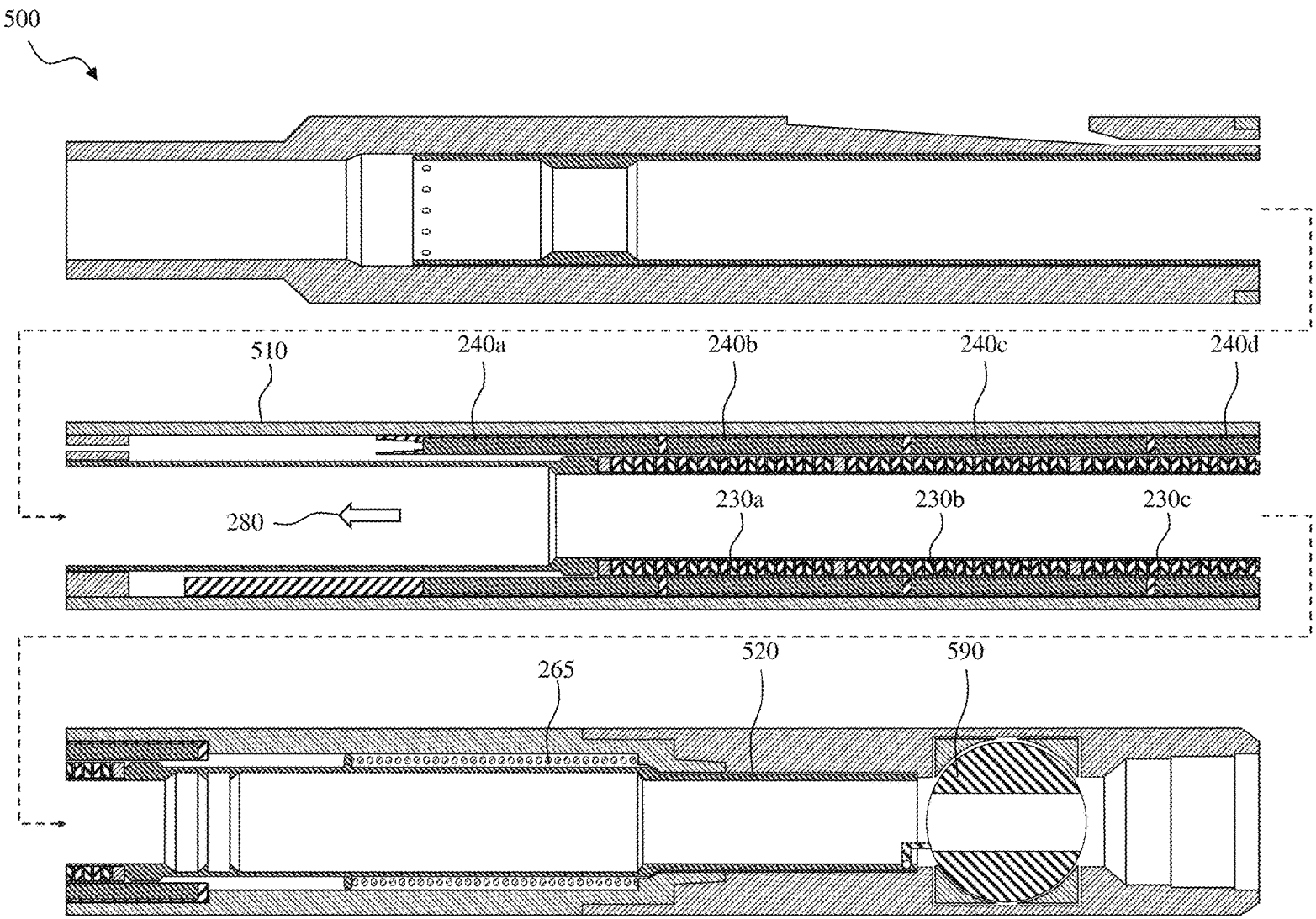
Figure 5H:
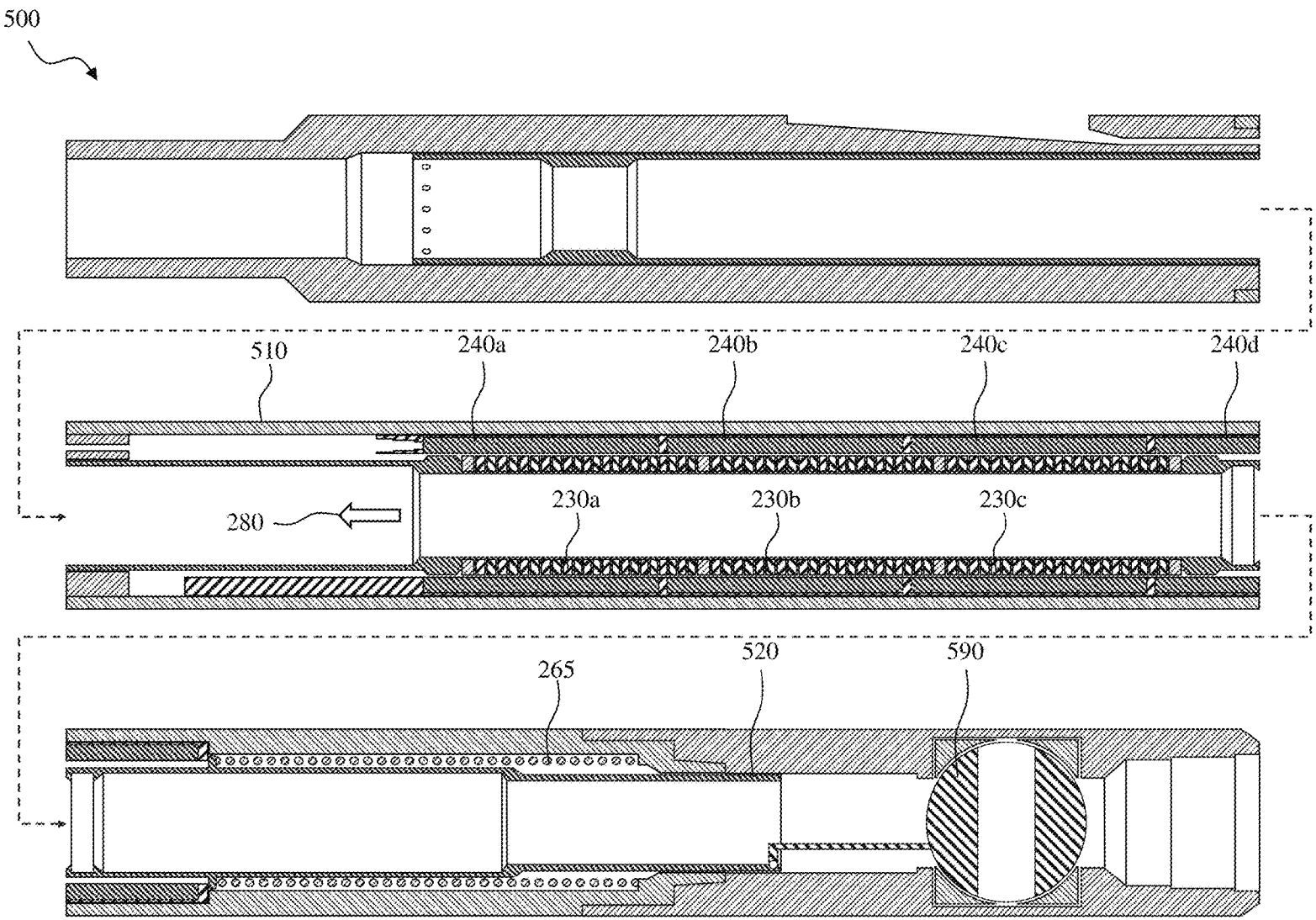
Figure 6A:
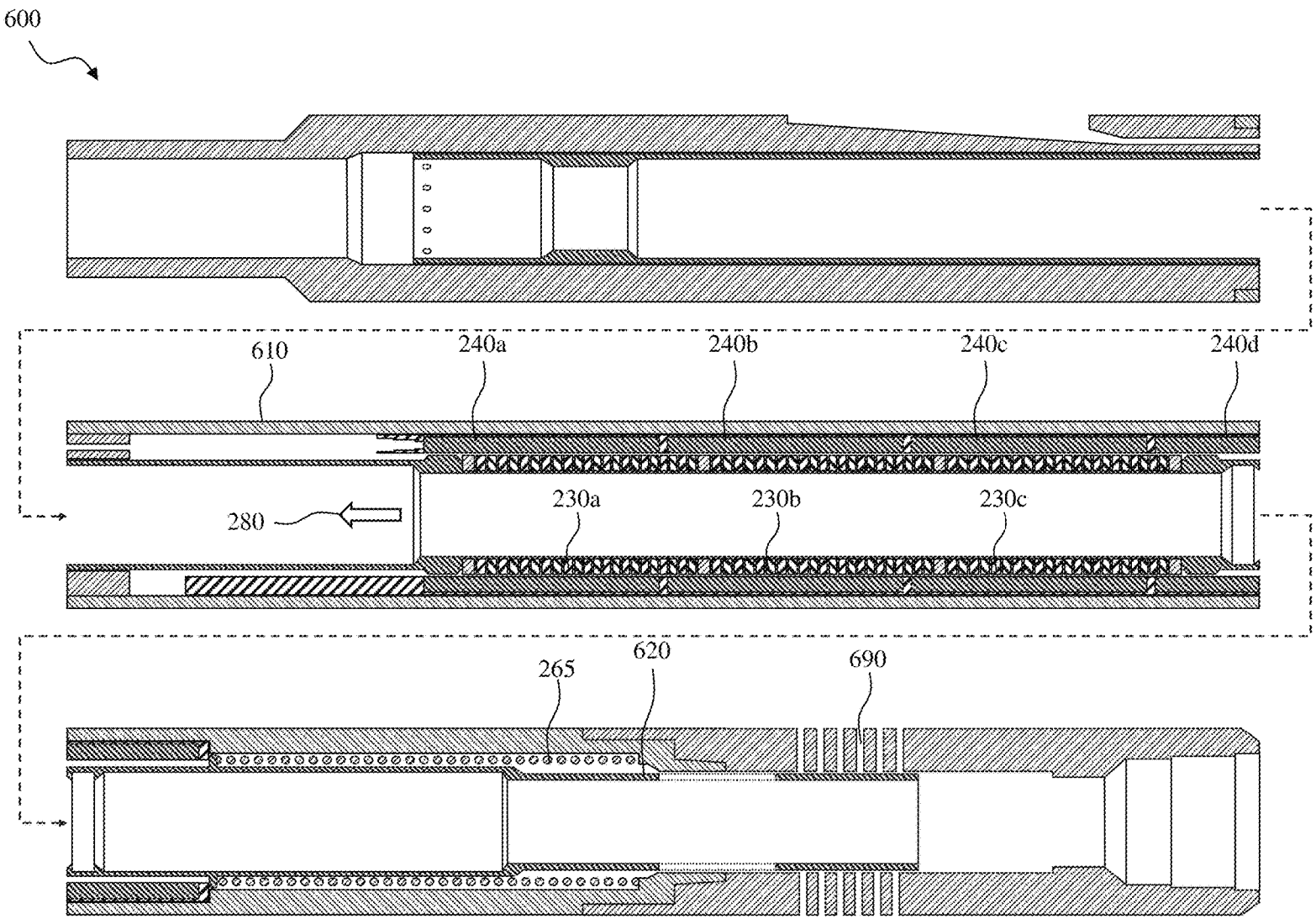
Figure 6B:
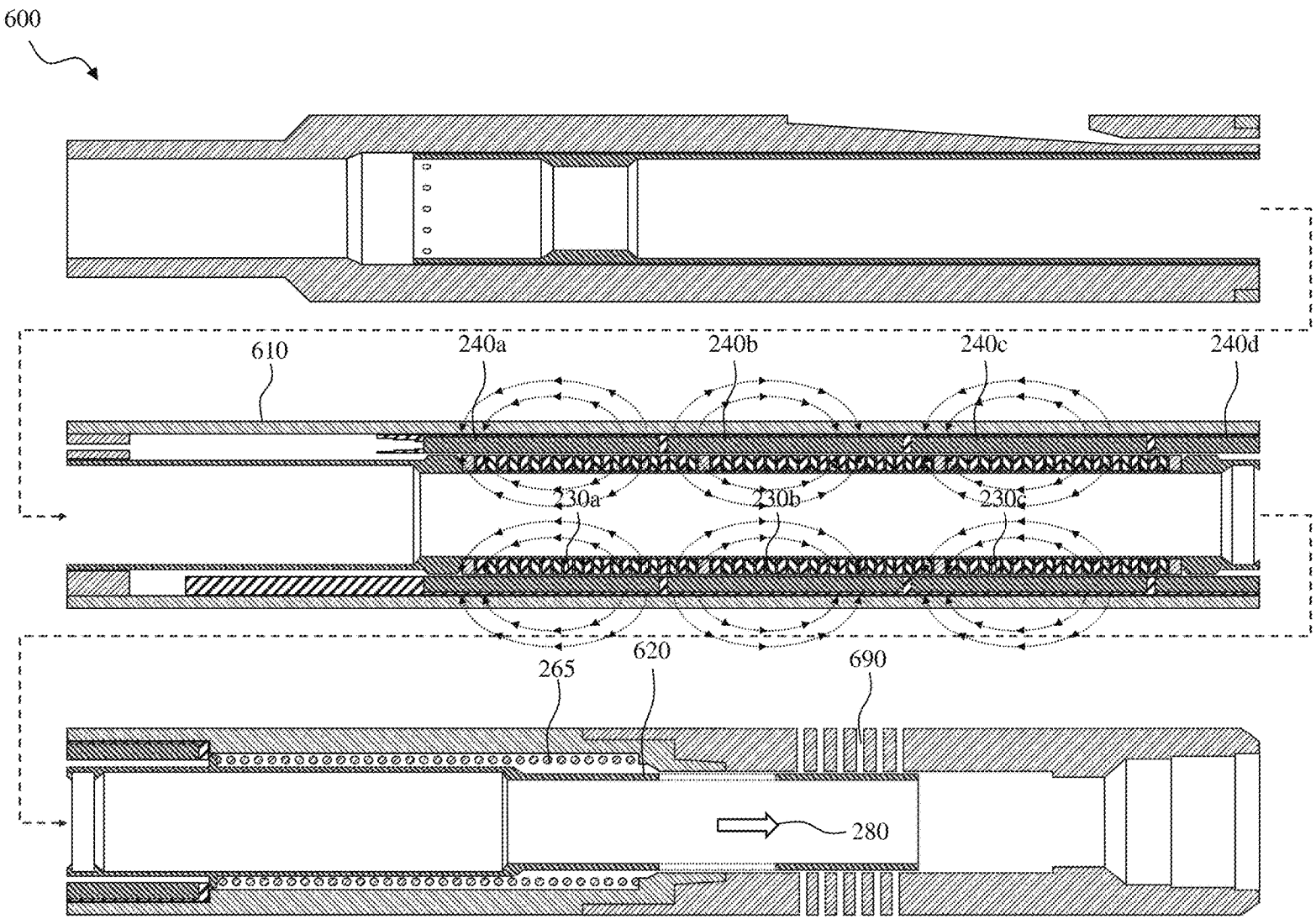
Figure 6C:
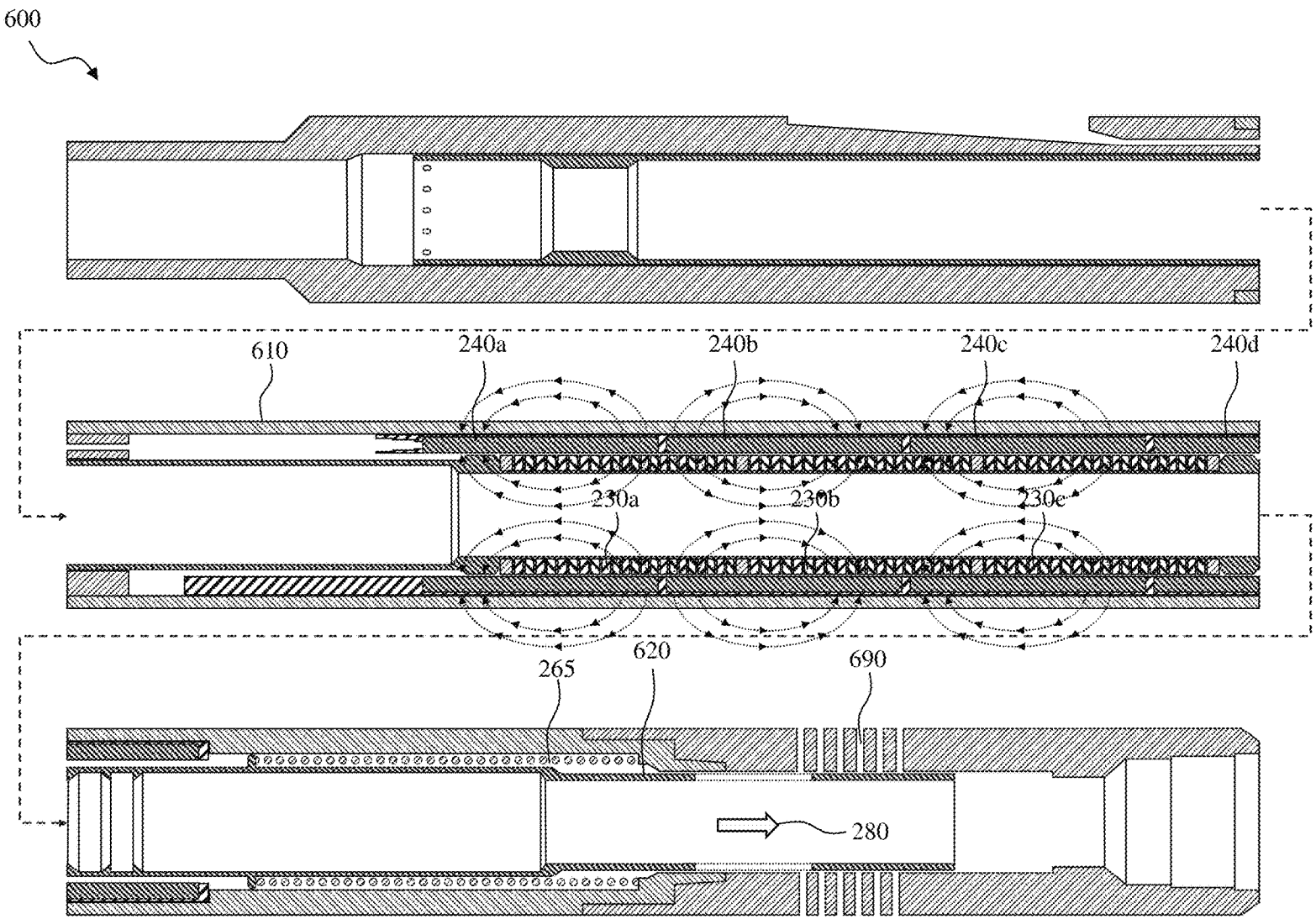
Figure 6D:
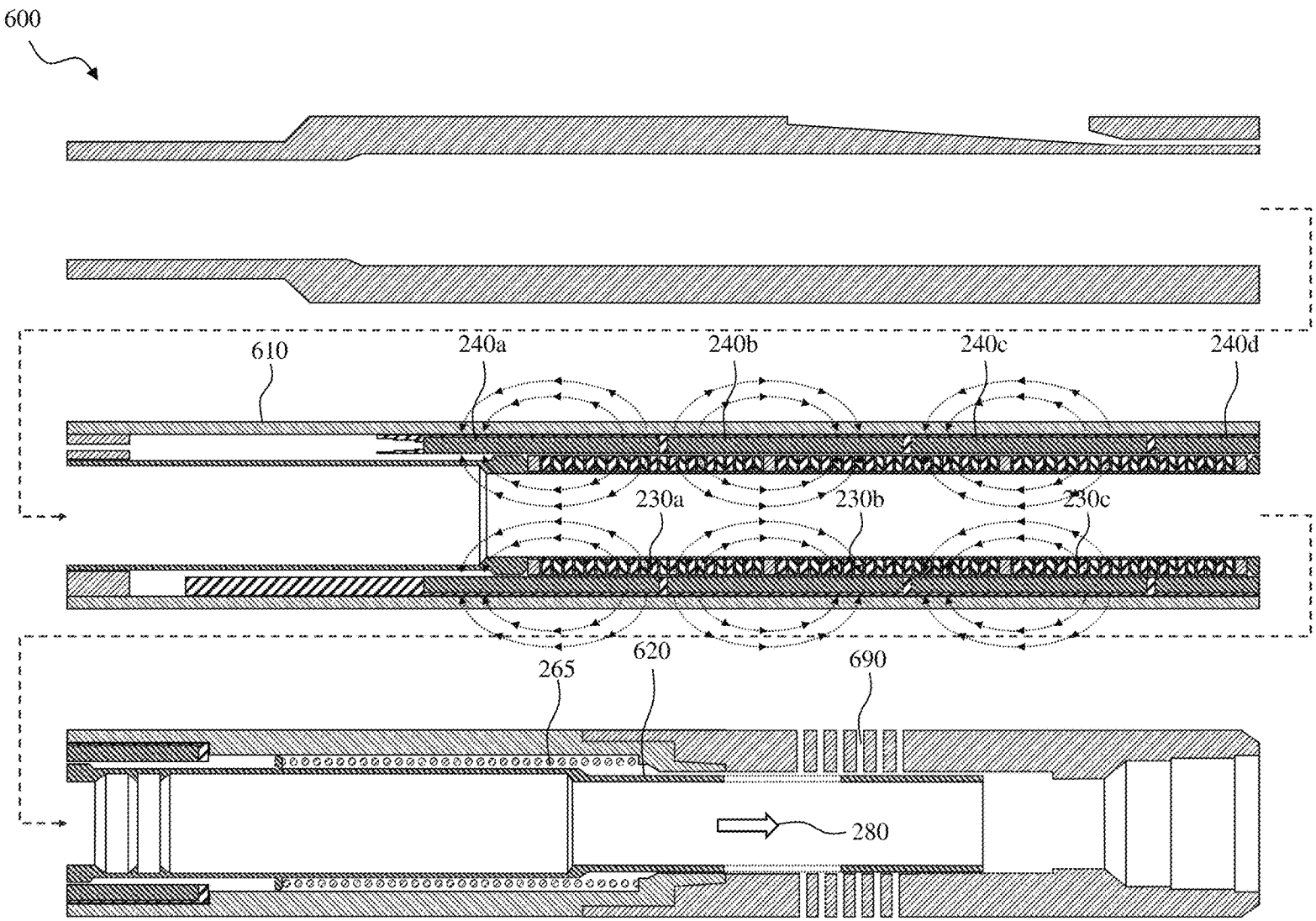
Figure 6E:
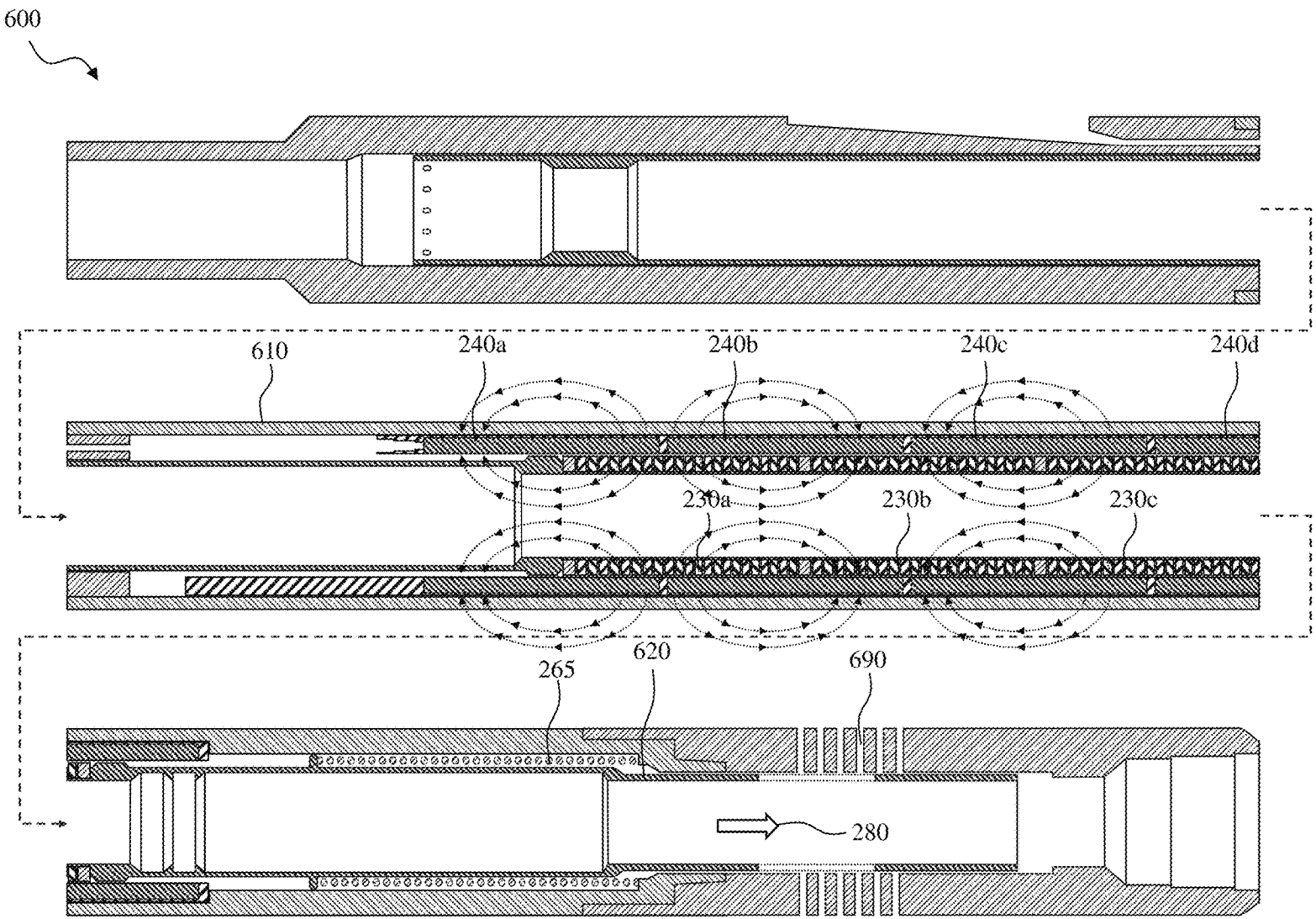
Figure 6F:
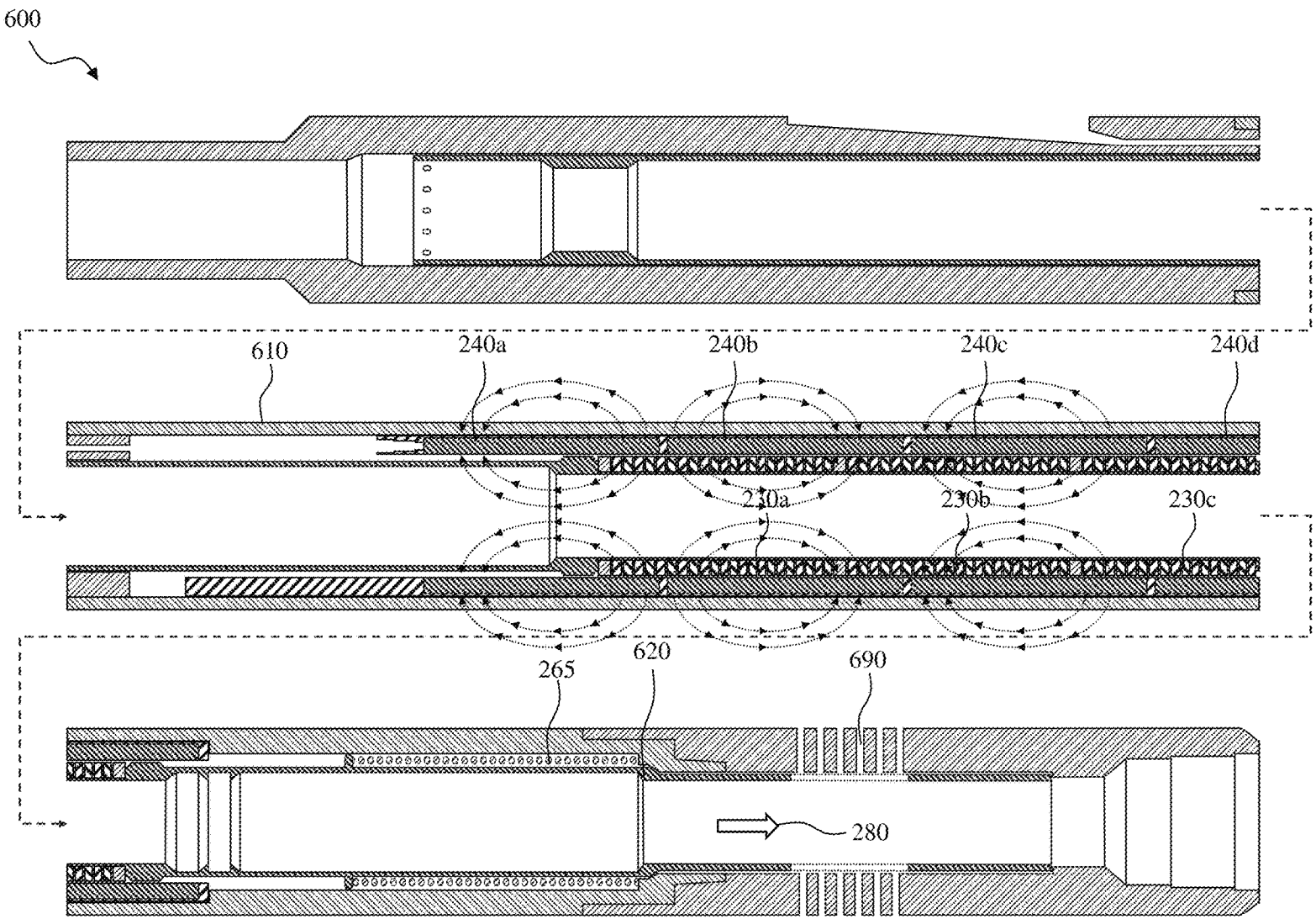
Figure 6G:
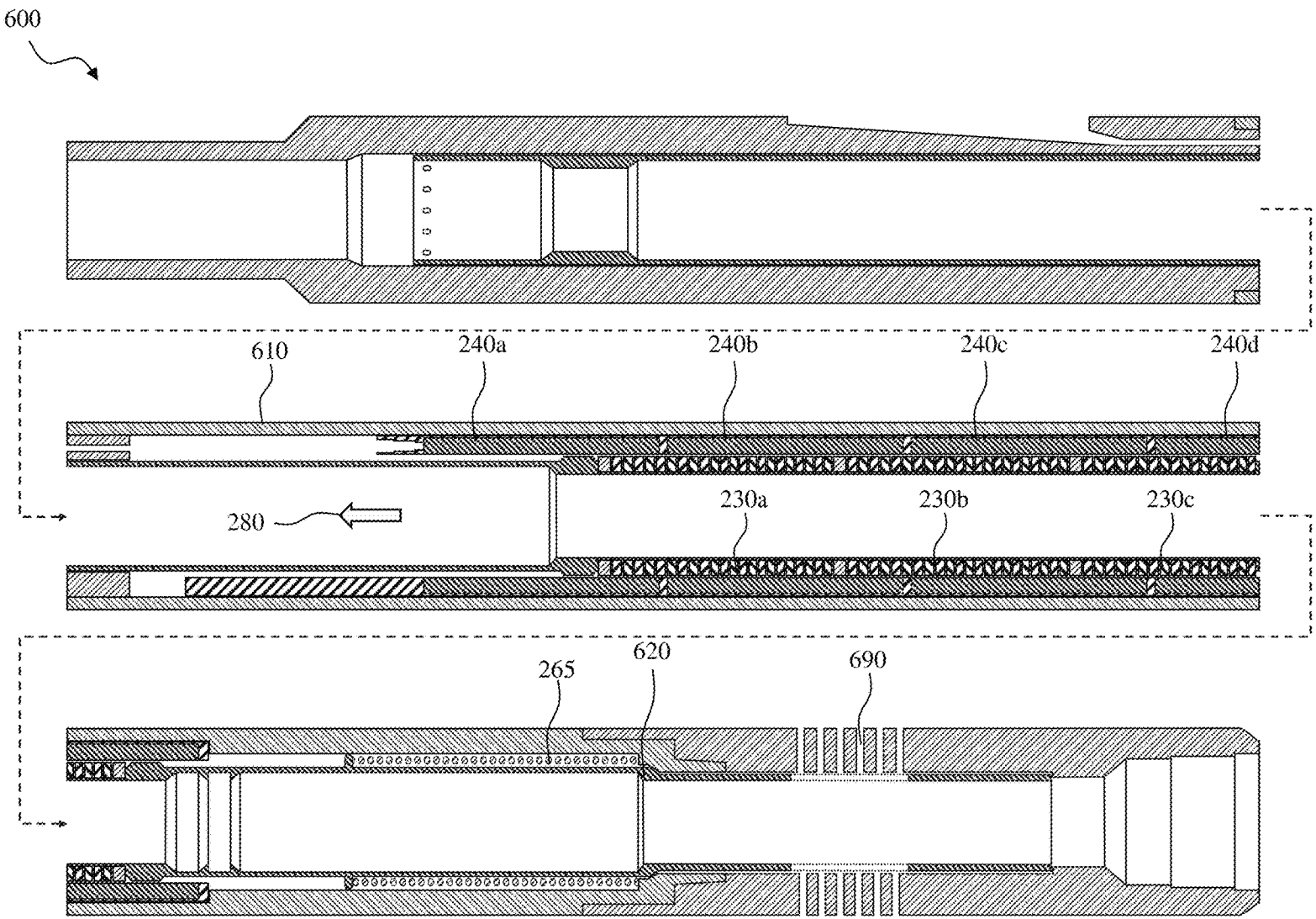
Figure 6H:
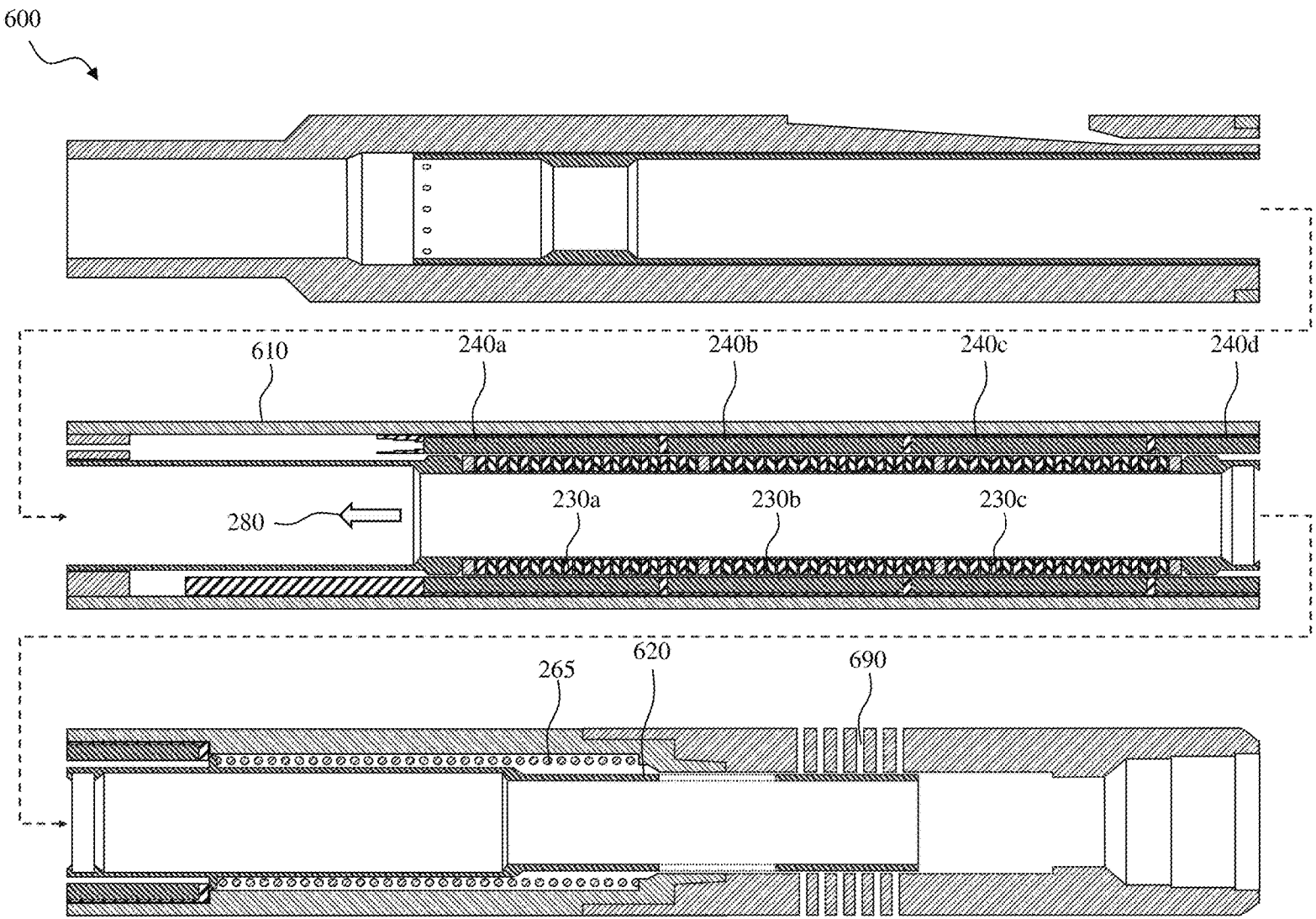

Turning now to FIGS. 4A through 4X, illustrated are different cross-sectional views of a downhole device 400 designed, manufactured and/or operated according to one or more alternative embodiments of the disclosure during different operational states. The downhole device 400 is similar in many respects to the downhole device 200 of FIGS. 2A through 2K. Accordingly, like reference numbers have been used to indicate similar features. The downhole device 400 differs, for the most part, from the downhole device 200, in that the downhole device 400 includes at least four electromagnet assemblies 240*a*, 240*b*, 240*c*, 240*d* . . . 240*n*, and furthermore is specifically configured as a fluid flow control valve, and more specifically a fluid safety valve. Accordingly, in the embodiment of FIGS. 4A through 4X, the member 210 is a flow control valve housing 410, the movable element 220 is a movable flow control element 420, in this embodiment a movable flow control tube. Further to the embodiment of FIGS. 4A through 4X, the downhole device 400 further includes a valve closure mechanism 490 coupled with the flow control valve housing 410, the movable flow control element 420 configured to actuate between the first position and the second position and thereby move the valve closure mechanism 490 between a closed state and an open state. In the embodiment of FIGS. 4A through 4X, the valve closure mechanism 490 is a flapper-type valve configured to rotate between the closed state and the open state as the movable flow control element 420 moves between the first position and the second position. Thus, the inventive aspects of the present disclosure are being applied to a fluid safety valve in FIGS. 4A through 4X.

The information shared above with regard to the operation of the downhole device 200 of FIGS. 2A through 2K may be applied to understanding the operation of the downhole device 400 of FIGS. 4A through 4W. In the embodiment of FIGS. 4A through 4X, FIGS. 4A through 4C align with the operational state of FIG. 2A, FIGS. 4D through 4F align with the operational state of FIG. 2B, FIGS. 4G through 4I align with the operational state of FIG. 2C, FIGS. 4J through 4L align with the operational state of FIG. 2D, FIGS. 4M through 4O align with the operational state of FIG. 2E, FIGS. 4P through 4R align with the operational state of FIG. 2F, FIGS. 4S through 4U align with the operational state of FIG. 2G, and FIGS. 4V through 4X align with the operational state of FIG. 2H. With the foregoing, one skilled in the art would fully understand how to operate the downhole device 400.

Turning now to FIGS. 5A through 5H, illustrated are different cross-sectional views of a downhole device 500 designed, manufactured and/or operated according to one or more embodiments of the disclosure during different operational states. The downhole device 500 is similar in many respects to the downhole device 200 of FIGS. 2A through 2K. Accordingly, like reference numbers have been used to indicate similar features. The downhole device 500 differs, for the most part, from the downhole device 200, in that the downhole device 500 is specifically configured as a fluid flow control valve, and more specifically a fluid safety valve. Accordingly, in the embodiment of FIGS. 5A through 5H, the member 210 is a flow control valve housing 510, and the movable element 220 is a movable flow control element 520. Further to the embodiment of FIGS. 5A through 5H, the downhole device 500 further includes a valve closure mechanism 590 coupled with the flow control valve housing 410, the movable flow control element 520 configured to actuate between the first position and the second position and thereby move the valve closure mechanism 590 between a closed state and an open state. In the embodiment of FIGS. 5A through 5H, the valve closure mechanism 590 is a ball-type valve configured to rotate between the closed state and the open state as the movable flow control element 520 moves between the first position and the second position. Thus, the inventive aspects of the present disclosure are being applied to a fluid safety valve in FIGS. 5A through 5H.

The information shared above with regard to the operation of the downhole device 200 of FIGS. 2A through 2K may be applied to understanding the operation of the downhole device 500 of FIGS. 5A through 5H. In the embodiment of FIGS. 5A through 5H, FIG. 5A aligns with the operational state of FIG. 2A, FIG. 5B aligns with the operational state of FIG. 2B, FIG. 5C aligns with the operational state of FIG. 2C, FIG. 5D aligns with the operational state of FIG. 2D, FIG. 5E aligns with the operational state of FIG. 2E, FIG. 5F aligns with the operational state of FIG. 2F, FIG. 5G aligns with the operational state of FIG. 2G, and FIG. 5H aligns with the operational state of FIG. 2H. With the foregoing, one skilled in the art would fully understand how to operate the downhole device 500.

Turning now to FIGS. 6A through 6H, illustrated are different cross-sectional views of a downhole device 600 designed, manufactured and/or operated according to one or more embodiments of the disclosure during different operational states. The downhole device 600 is similar in many respects to the downhole device 200 of FIGS. 2A through 2K. Accordingly, like reference numbers have been used to indicate similar features. The downhole device 600 differs, for the most part, from the downhole device 200, in that the downhole device 600 is specifically configured as an inflow control device (ICD). Accordingly, in the embodiment of FIGS. 6A through 6H, the member 210 is a flow control valve housing 610, the movable element 220 is a movable flow control element 620, in this embodiment a movable flow control tube. Further to the embodiment of FIGS. 6A through 6H, the downhole device 600 further includes one or more inflow control ports 690 located in the flow control valve housing 610, the movable flow control element 620 configured to actuate between the first position and the second position and thereby cover and/or expose the one or more inflow control ports 690 between a closed state and an open state. Thus, the inventive aspects of the present disclosure are being applied to an inflow control device (ICD) in FIGS. 6A through 6H.

The information shared above with regard to the operation of the downhole device 200 of FIGS. 2A through 2K may be applied to understanding the operation of the downhole device 600 of FIGS. 6A through 6H. In the embodiment of FIGS. 6A through 6H, FIG. 6A aligns with the operational state of FIG. 2A, FIG. 6B aligns with the operational state of FIG. 2B, FIG. 6C aligns with the operational state of FIG. 2C, FIG. 6D aligns with the operational state of FIG. 2D, FIG. 6E aligns with the operational state of FIG. 2E, FIG. 6F aligns with the operational state of FIG. 2F, FIG. 6G aligns with the operational state of FIG. 2G, and FIG. 6H aligns with the operational state of FIG. 2H. With the foregoing, one skilled in the art would fully understand how to operate the downhole device 600.

A method according to one or more embodiments of the disclosure, may include accessing a downhole device located within a wellbore extending through one or more subterranean formations. In at least one embodiment, the downhole device being accessed is similar in part to one or more of the downhole devices 200, 400, 500, 600, disclosed above. The method, in accordance with this embodiment, may further include supplying electric power to the electromagnet assembly to produce an electromagnetic field having an electromagnetic polarity (Y) similar in direction to the magnetic polarity (X), the electromagnetic field generating an opposite electromagnetic coupling force greater than the magnetic coupling force to actuate the movable element from the first position towards the second position. In at least one embodiment, supplying electric power includes supplying a first electric power to actuate the movable element from the first position to the second position, and further includes reducing the first electric power to a second lesser electric power to keep the movable element in the second position, as discussed above.

The present disclosure has additionally acknowledged that offshore wells are being drilled at ever increasing water depths and in environmentally sensitive waters, and thus safety valves (e.g., including subsurface safety valves (SSSVs)) are necessary. The present disclosure has further acknowledged that SSSVs have parts that can wear or erode, and thus from time to time may need servicing and/or replacing. In fact, occasionally the tubing retrievable safety valve (TRSV) (e.g., electrically actuated TRSV) will fail, and then a wireline retrievable safety valve (WLRSV) will be run in hole. Unfortunately, each of the TRSVs and the WLRSVs require their own power source, such as individual tubing encapsulated conductors (TECs). In even yet other embodiments, the WLRSVs are employed apart from TRSVs, and thus even in situations where the TRSV has not been used and/or has not failed.

Accordingly, the present disclosure has further developed an improved WLRSV. In at least one embodiment, the WLRSV includes a first portion that is run-in-hole with the tubing string (e.g., with the TRSV if used) and second and third portions that are run-in-hole at a later point in time (e.g., after the TRSV is no longer working properly and/or has failed). The first portion of the WLRSV, in at least one embodiment, includes a safety valve sub (e.g., WLRSV sub) that would be run-in-hole along with another safety valve sub (e.g., TRSV sub), and for example the tubing string. In at least one embodiment, the safety valve sub would be located above the TRSV sub. In at least one other embodiment, the safety valve sub would include an electromagnet assembly (e.g., including one or more coils) (e.g., coupleable to a primary control line (e.g., single TEC), as well as a fluid isolation sleeve that isolates the electromagnet assembly from fluid and/or debris within the wellbore. In at least one embodiment, the fluid isolation sleeve is a fixed fluid isolation sleeve, and thus does not readily move once positioned downhole.

The WLRSV, in one or more embodiments, further includes the second portion of the WLRSV, which again would be run-in-hole after the first portion (e.g., is run-in-hole after the TRSV is no longer working properly and/or has failed). The second portion of the WLRSV, in accordance with one or more embodiments, may be run-in-hole within the casing string (e.g., within the casing string that the TRSV is deployed, for example if the TRSV is used), for example using a latch mechanism to axially fix the second portion of the WLRSV within the casing string. The second portion of the WLRSV, in one or more embodiments, may include a bore flow management actuator and a valve closure mechanism, and may be located below the first portion of the WLRSV including the electromagnet assembly and the fluid isolation sleeve.

The WLRSV, in one or more embodiments, further includes a third portion that is run-in-hole after the second portion of the WLRSV is latched downhole (e.g., latched within the casing string, including the TRSV or first portion of the WLRSV). In another embodiment, the third portion is run-in-hole after the second portion is run-in-hole on a separate wellbore operation, such as a separate wireline trip or a separate slickline trip. In another embodiment, the third portion is run-in-hole after the second portion in the same wellbore operation, such as on the same wireline trip or the same slickline trip. The third portion, in one or more embodiments, includes a mechanical connecting apparatus. For example, in accordance with one or more embodiments of the disclosure, once the second portion of the WLRSV is latched in place, the mechanical connecting apparatus may be run-in-hole and coupled with the bore flow management actuator of the second portion. In at least this one embodiment, the mechanical connecting apparatus is located radially inside of the electromagnet assembly and/or the fluid isolation sleeve of the first portion. The mechanical connecting apparatus, in one or more embodiments, includes one or more ferromagnet assemblies associated therewith (e.g., coupled thereto or forming a part thereof). The phrase "ferromagnet assembly," as used herein, can be a permanent magnet feature, a ferromagnetic material feature, or another feature that exhibits a magnetic field (e.g., a significant enough magnetic field) or a response to an applied magnetic field (e.g., a significant enough response to an applied magnetic field). The ferromagnet assembly, in this embodiment, is configured to magnetically couple with the electromagnet assembly of the first portion, when the electromagnet assembly of the first portion is energized and the two are at least partially axially aligned. In essence, the mechanical connecting apparatus may be run-in-hole to axially fix the ferromagnet assembly of the third portion of the WLRSV with the bore flow management actuator of the second portion of the WLRSV. Accordingly, any axial movement of the ferromagnetic assembly, and thus mechanical connecting apparatus, would result in the same axial movement of the bore flow management actuator, and vice-versa. Thus, when the electromagnet assembly is used to actuate the mechanical connecting apparatus via the ferromagnet assembly, the bore flow management actuator also moves, typically a similar axial distance. The above is discussed in the context of the second portion and the third portion being run-in-hole at different times. Other embodiments may exist wherein the second portion and the third portion are run-in-hole in a single trip (e.g., already coupled with one another).

In essence, the present disclosure is employing the concepts disclosed above with regard to the electromagnet assembly and ferromagnet assembly to actuate the mechanical connecting apparatus a stroke distance (D) and slide the bore flow management actuator (e.g., coupled thereto) from the first position to the second position to move the valve closure mechanism between the closed state and the open state. Again, in one or more embodiments, as discussed in great detail above, the electromagnet assembly is operable to receive electric power to produce an electromagnetic field having an electromagnetic polarity (Y), the electromagnetic field configured to magnetically engage with the ferromagnet assembly to actuate the mechanical connecting apparatus a stroke distance (D) and slide the bore flow management actuator from the first position to the second position to move the valve closure mechanism between the closed state and the open state. It should be noted that all of the different configurations of the electromagnet assemblies (e.g., first electromagnet assembly having the electromagnetic polarity (Y) and one or more additional electromagnet assemblies coupled to the first portion sequentially toward the second portion, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y)), as well as all configuration of the ferromagnet assemblies (e.g., the first ferromagnet assembly and one or more additional ferromagnet assemblies), may be applied to a downhole device configured as a WLRSV.

In operation, once the mechanical connecting apparatus is in place, power supplied to the electromagnet assembly may urge the bore flow management actuator toward the valve closure mechanism. Typically, the bore flow management actuator is unable to move past the valve closure mechanism until a pressure differential across the valve closure mechanism is reduced/eliminated. Once the pressure differential across the valve closure mechanism is reduced/eliminated, for example by pumping fluid down the wellbore toward an uphole side of the valve closure mechanism, the bore flow management actuator may be urged past the valve closure mechanism, for example using the force from the powered electromagnet assembly or one or more separate energy storage devices, such as springs (e.g., power springs). Again, as the one or more ferromagnet assemblies are axially fixed to the bore flow management actuator (e.g., through the mechanical connecting apparatus), the electromagnetic field generated by the powered electromagnet assembly and magnetically engaged with the ferromagnet assembly actuates the mechanical connecting apparatus a stroke distance (D) and slides the bore flow management actuator from the first position to the second position to move the valve closure mechanism between the closed state and the open state. Accordingly, when the electromagnet assembly of the first portion is energized and located proximate the one or more ferromagnet assemblies, the mechanical connecting apparatus and bore flow management actuator coupled therewith will move. In at least one embodiment, the powered electromagnet assembly may be used to independently hold the bore flow management actuator at the second position may be held in the flow state.

Turning to FIGS. 7A through 7C, illustrated is one embodiment of a downhole device 700, such as a WLRSV or TRSV depending on the application, designed, manufactured and/or operated according to one or more embodiments of the disclosure, as might employ the first, second and third portions discussed above. The downhole device 700, in one or more embodiments, includes an outer housing 710 (e.g., tubular housing, wellbore tubing, etc.) containing a central bore 715 therein. In the illustrated embodiment, the downhole device 700 includes a first portion 720, the first portion 720 including an electromagnet assembly 725. As indicated above, the first portion 720 may be run-in-hole as part of wellbore tubing, such as with the housing 710.

In at least one embodiment, the electromagnet assembly 725 is located in a pocket 730 in the first portion 720. In accordance with one or more embodiments, the first portion 720 further includes a fluid isolation sleeve 735 separating the electromagnet assembly 725 located in the pocket 730 from features (e.g., the mechanical connecting apparatus) and/or fluids located inside an inner diameter (ID) of the electromagnet assembly 725. In accordance with one embodiment, the fluid isolation sleeve 735 is non-ferromagnetic. In accordance with one or more alternative embodiments, the fluid isolation sleeve 735 is an axially fixed fluid isolation sleeve, and thus does not move as other features located inside an inner diameter (ID) electromagnet assembly 725 might. Those skilled in the art fully appreciate that the electromagnet assembly 725, whether a single electromagnet assembly or a plurality of electromagnet assemblies, may comprise any of the electromagnet assemblies disclosed above, whether in type, form, number, location, spacing, etc. Essentially, it is the inventive aspects disclosed above of using the electromagnet assembly and ferromagnet assembly to actuate a movable feature, which is uniquely being employed to the downhole device 700 (e.g., WLRSV) of FIGS. 7A through 7C.

The downhole device 700, in the illustrated embodiment, further includes a second portion 740. The second portion 740, in at least one embodiment, is run-in-hole after the first portion 720. In at least one embodiment, the second portion 740 includes a valve closure mechanism 745 (e.g., a flapper type valve) and a bore flow management actuator 750. In this embodiment, the bore flow management actuator 750 is configured to slide from a first position (e.g., that shown in FIG. 7A) to a second position (e.g., not shown) to move the valve closure mechanism 745 between a closed state (e.g., that shown in FIG. 7A) and an open state (e.g., not shown). The downhole device 700, and more particularly the second portion 740, may additionally include a separate energy storage element 755 coupled with the bore flow management actuator 750, the separate energy storage element 755 generating a return force that biases the bore flow management actuator 750 toward the first position. In at least one embodiment, the separate energy storage element 755 is a spring force element, such as a spring member.

The downhole device 700, and more particularly the second portion 740, may include a latch coupling 760, as might be used to engage with a latch profile 718 in the outer housing 710. In this embodiment, the latch coupling 760, and the latch profile 718 that it engages with, may be used to position, align, and fix the second portion 740 within the outer housing 710 of the downhole device 700, again after the first portion 720 has been run-in-hole.

The downhole device 700, in the illustrated embodiment, further includes a third portion 770. The third portion 770, in at least one embodiment, is run-in-hole after the first portion 720. In yet another embodiment, the third portion 770 is run-in-hole after the second portion 740. In at least one embodiment, the third portion 770 includes a mechanical connecting apparatus 775 having a ferromagnet assembly 780 coupled thereto. In at least this one embodiment, the mechanical connecting apparatus 775 is configured to engage with at least a portion of the bore flow management actuator 750. For example, in at least one embodiment, the bore flow management actuator 750 includes a bore flow management actuator profile 752 and the mechanical connecting apparatus 775 includes a downhole mechanical connecting apparatus profile 778, and further wherein the downhole mechanical connecting apparatus profile 778 is configured to couple with the bore flow management actuator profile 752 to axially couple the at least a portion of the bore flow management actuator 750 and the mechanical connecting apparatus 775. Those skilled in the art fully appreciate that the ferromagnet assembly 780, whether a single ferromagnet assembly or a plurality of ferromagnet assemblies, may comprise any of the ferromagnet assemblies disclosed above, whether in type, form, number, location, spacing, etc. Essentially, it is the inventive aspects disclosed above of using the electromagnet assembly and ferromagnet assembly to actuate a movable feature, which is uniquely being employed to the downhole device 700 (e.g., WLRSV) of FIGS. 7A through 7C.

Turning now to FIGS. 8A through 12C, illustrated are cross-sectional views of a downhole device 800 designed, manufactured, and/or operated according to one or more embodiments of the disclosure at different operational states thereof. The downhole device 800 of FIGS. 8A through 12C is similar in many respects to the downhole device 700 of FIGS. 7A through 7C. Accordingly, like reference numbers have been used to illustrate similar, if not identical features.

Figure 8A:
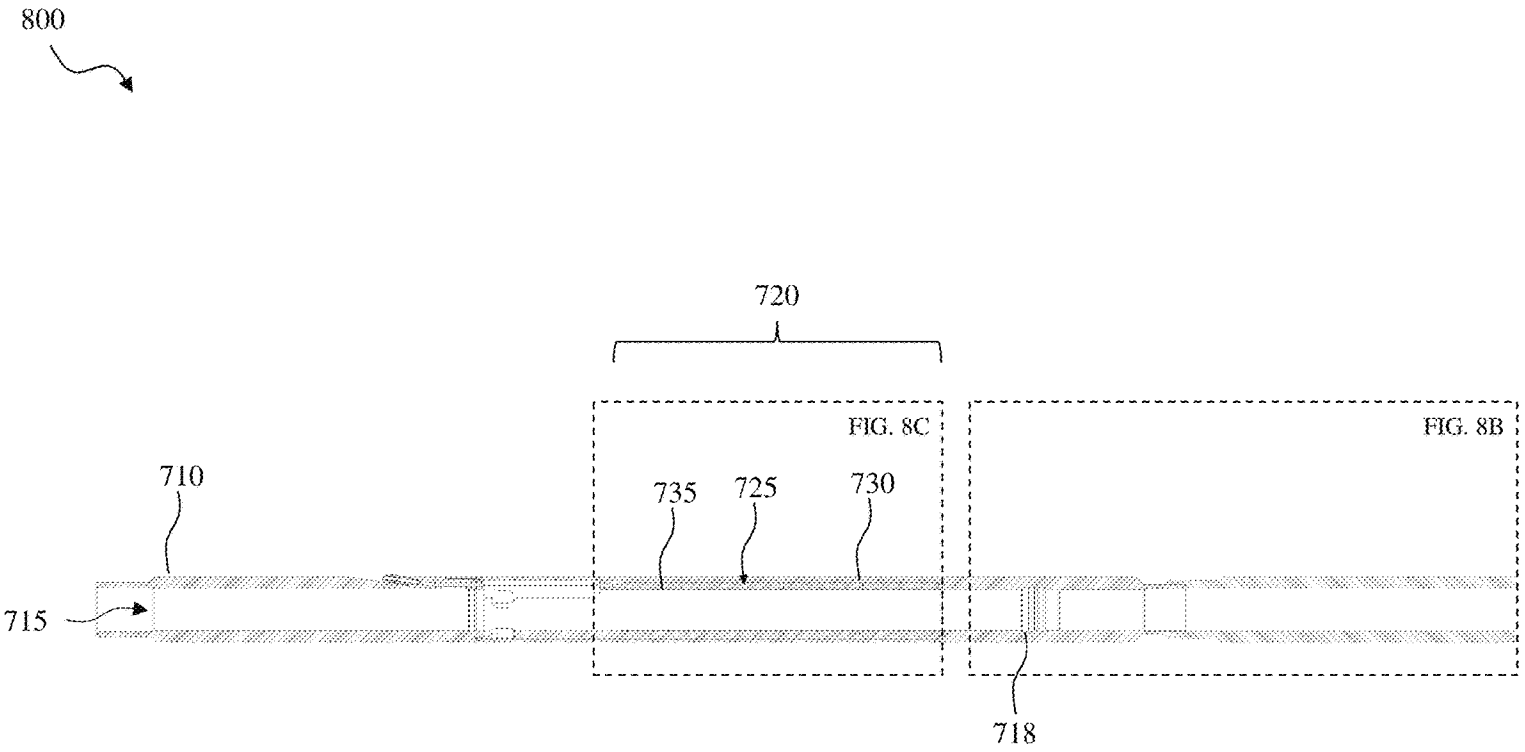
Figure 8B:
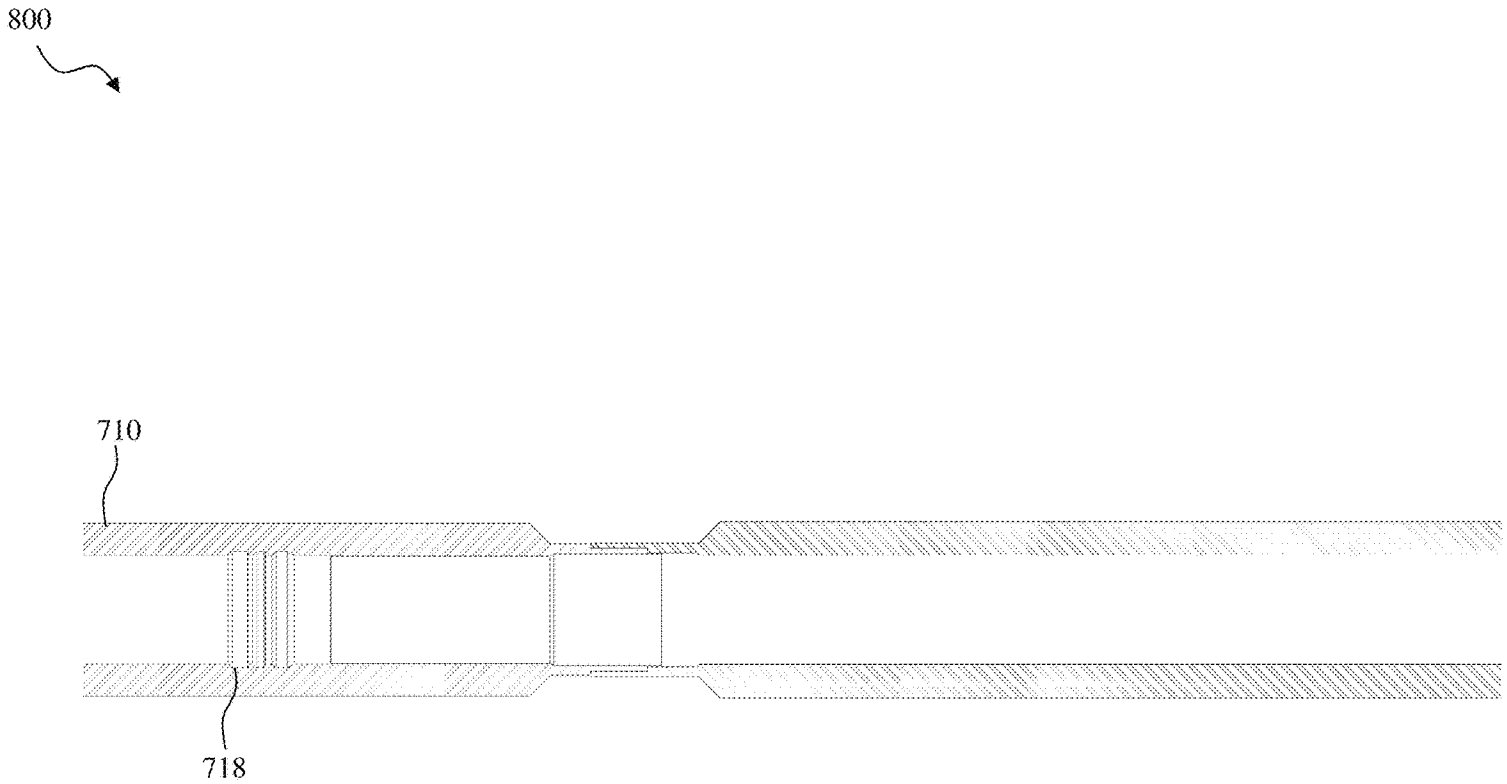
Figure 8C:
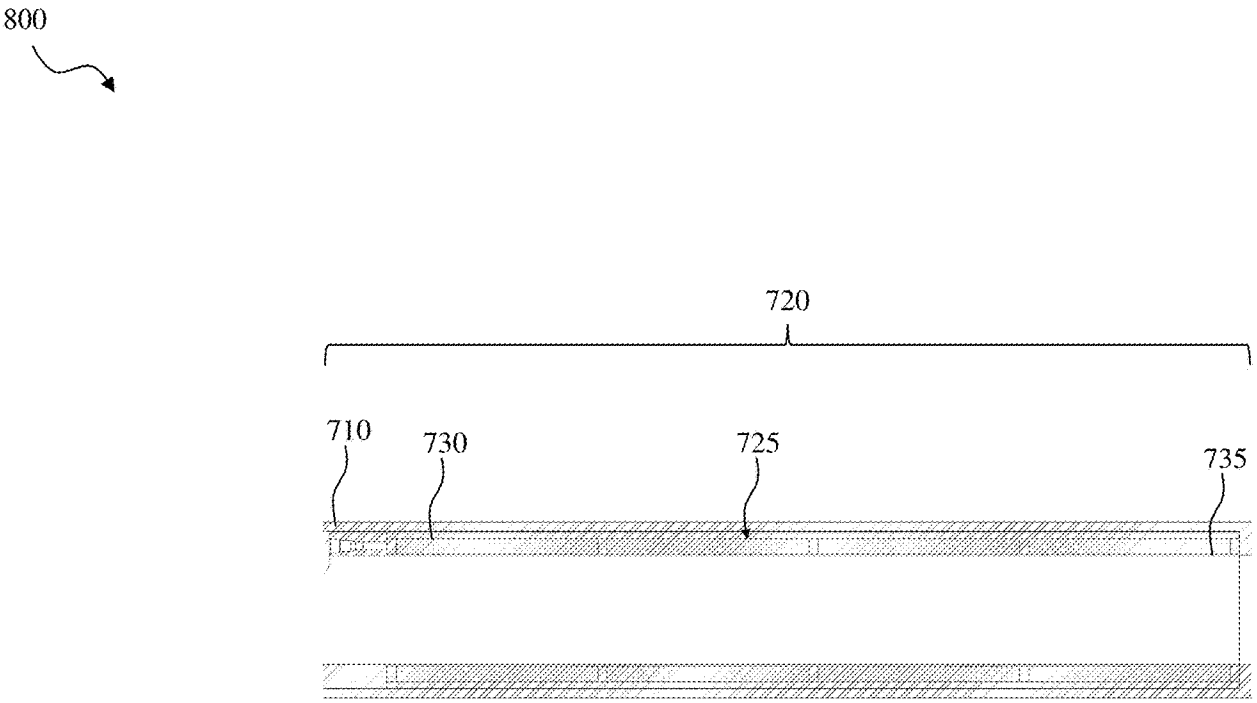

Turning to FIGS. 8A through 8C, the downhole device 800 includes an outer housing 710, such as a tubing string. The downhole device 800, at this stage of manufacture and/or operation, further includes the a first portion 720, the first portion 720 including the electromagnet assembly 730 coupled thereto. In this embodiment, the first portion 720 was run-in-hole as part of wellbore tubing, such as the outer housing 710.

Figure 9A:
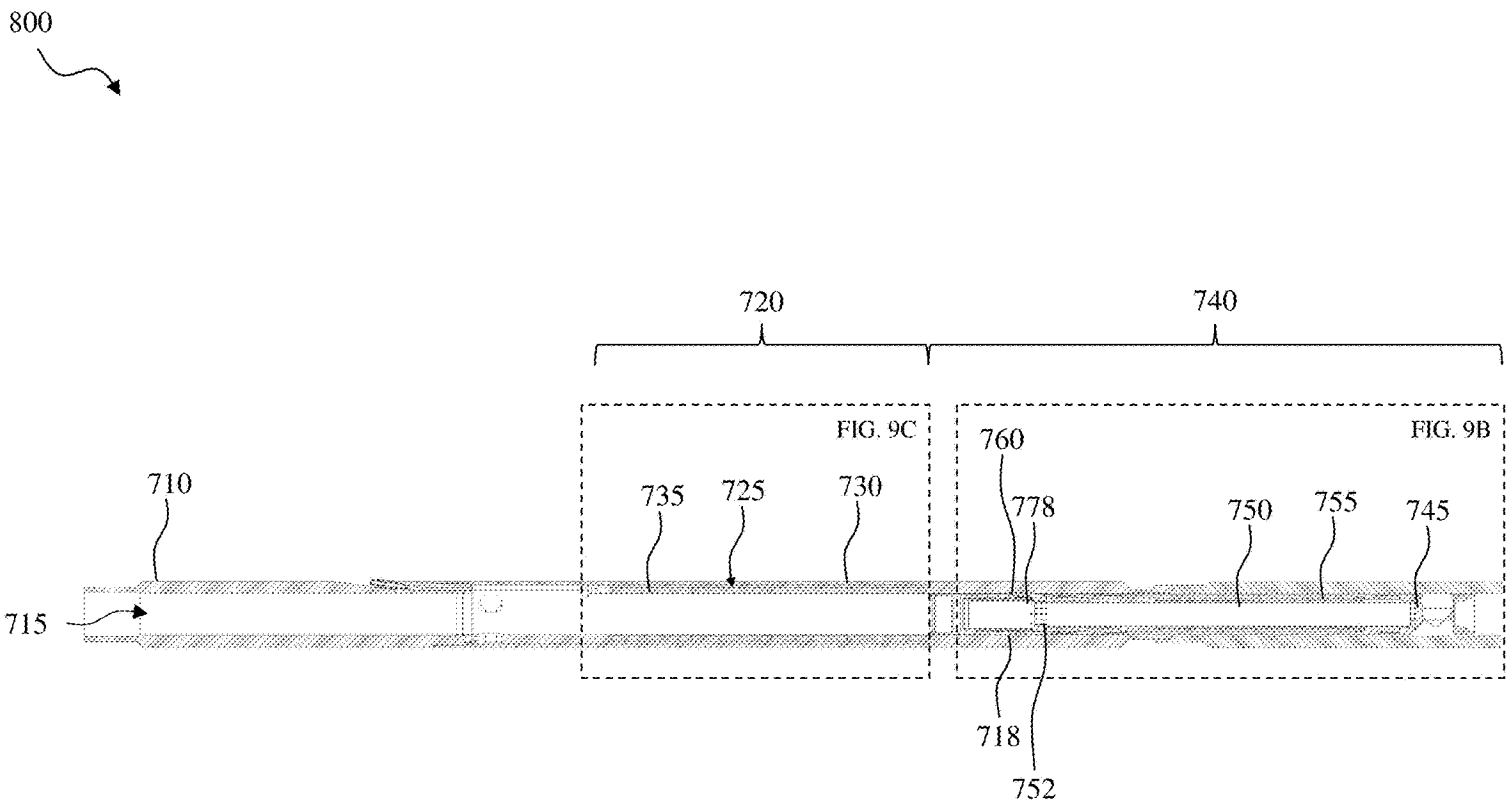
Figure 9B:
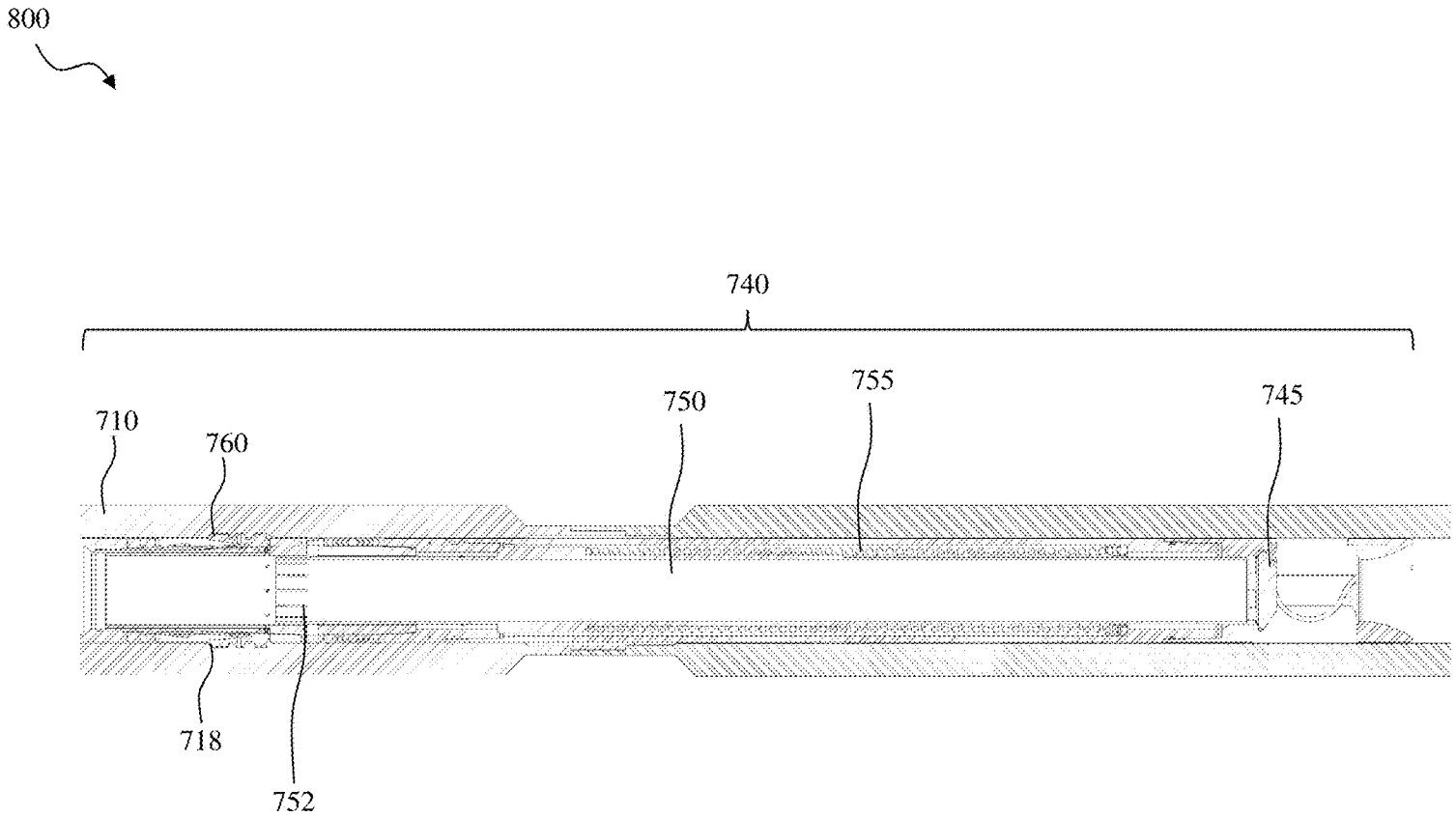
Figure 9C:
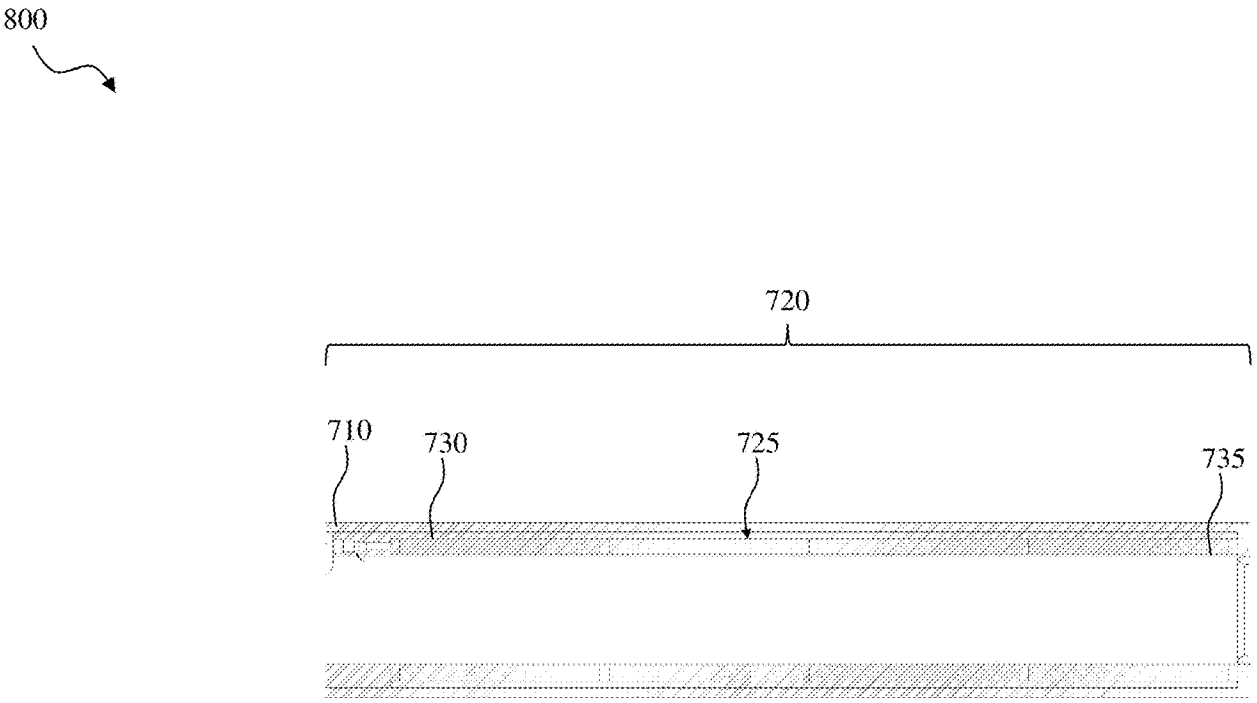

Turning to FIGS. 9A through 9C, illustrated is the downhole device 800 of FIGS. 8A through 8C after positioning a second portion 740 therein. In at least this one embodiment, the second portion 740 includes a valve closure mechanism 745 and the bore flow management actuator 750. In accordance with one embodiment of the disclosure, the bore flow management actuator 750 is configured to slide from a first position (e.g., that shown in FIG. 9A) to a second position (e.g., that shown in FIG. 11A) to move the valve closure mechanism 745 between a closed state (e.g., that shown in FIG. 9A) and an open state (e.g., that shown in FIG. 11A).

Figure 10A:
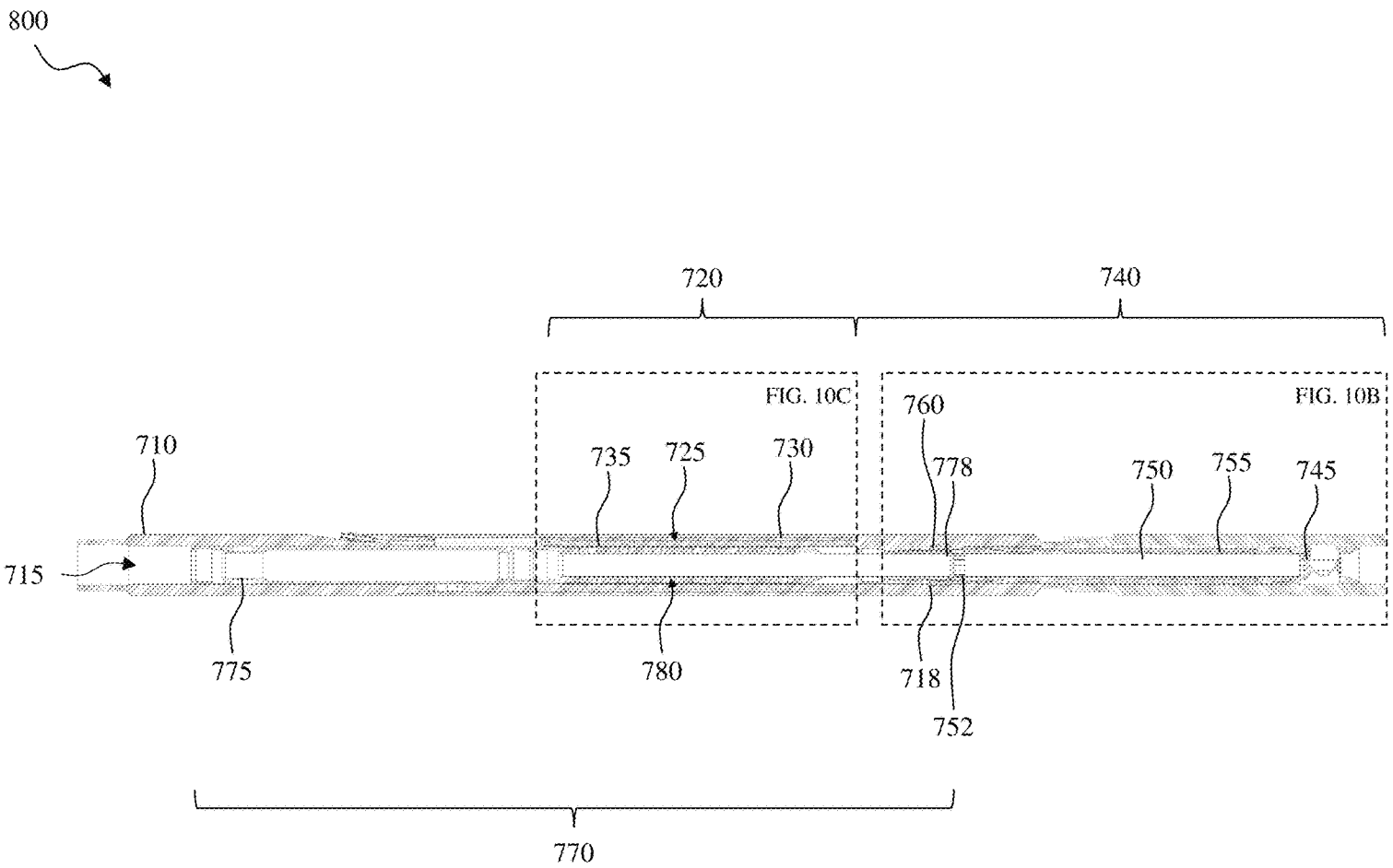
Figure 10B:
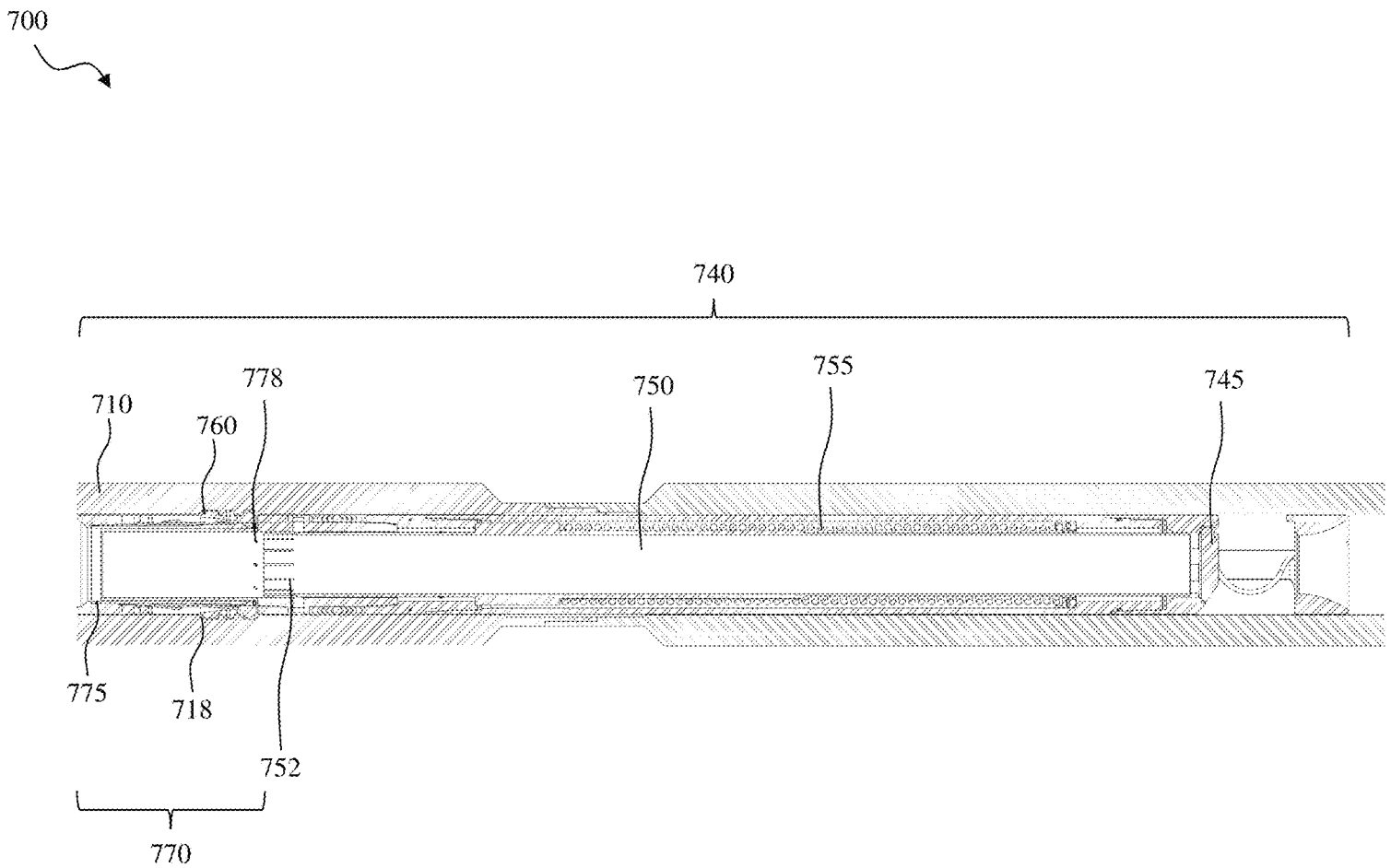
Figure 10C:
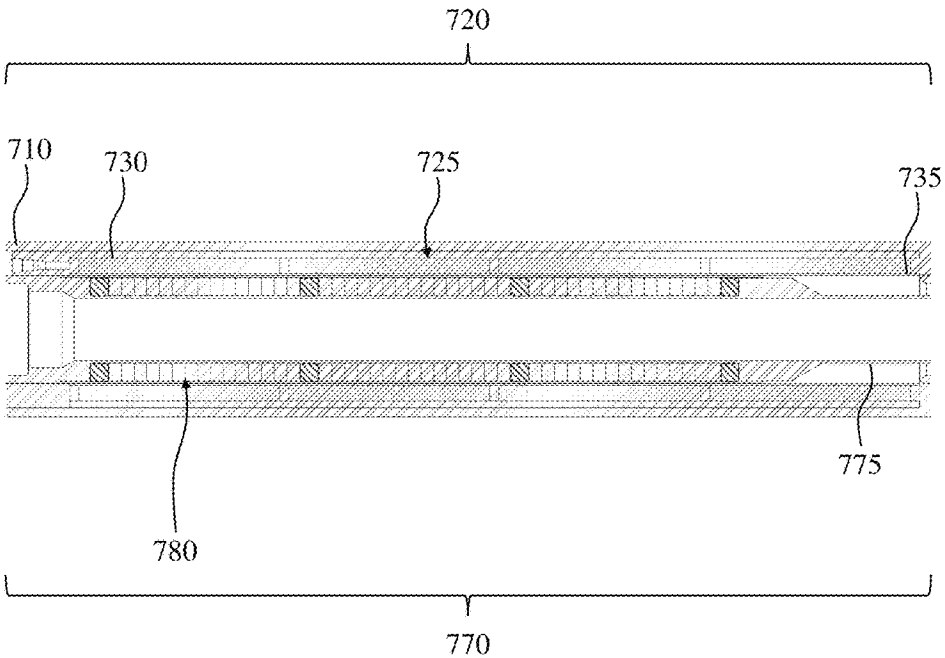

Turning to FIGS. 10A through 10C, illustrated is the downhole device 800 of FIGS. 9A through 9C after positioning a third portion 770 therein. In at least one embodiment, the third portion 770 includes the mechanical connecting apparatus 775 having the ferromagnet assembly 780 coupled thereto. In at least this one embodiment, the mechanical connecting apparatus 775 is configured to engage with at least a portion of the bore flow management actuator 750, for example as shown using the downhole mechanical connecting apparatus profile 778 and bore flow management actuator profile 752. At this stage, the downhole device 800 is substantially complete.

Figure 11A:
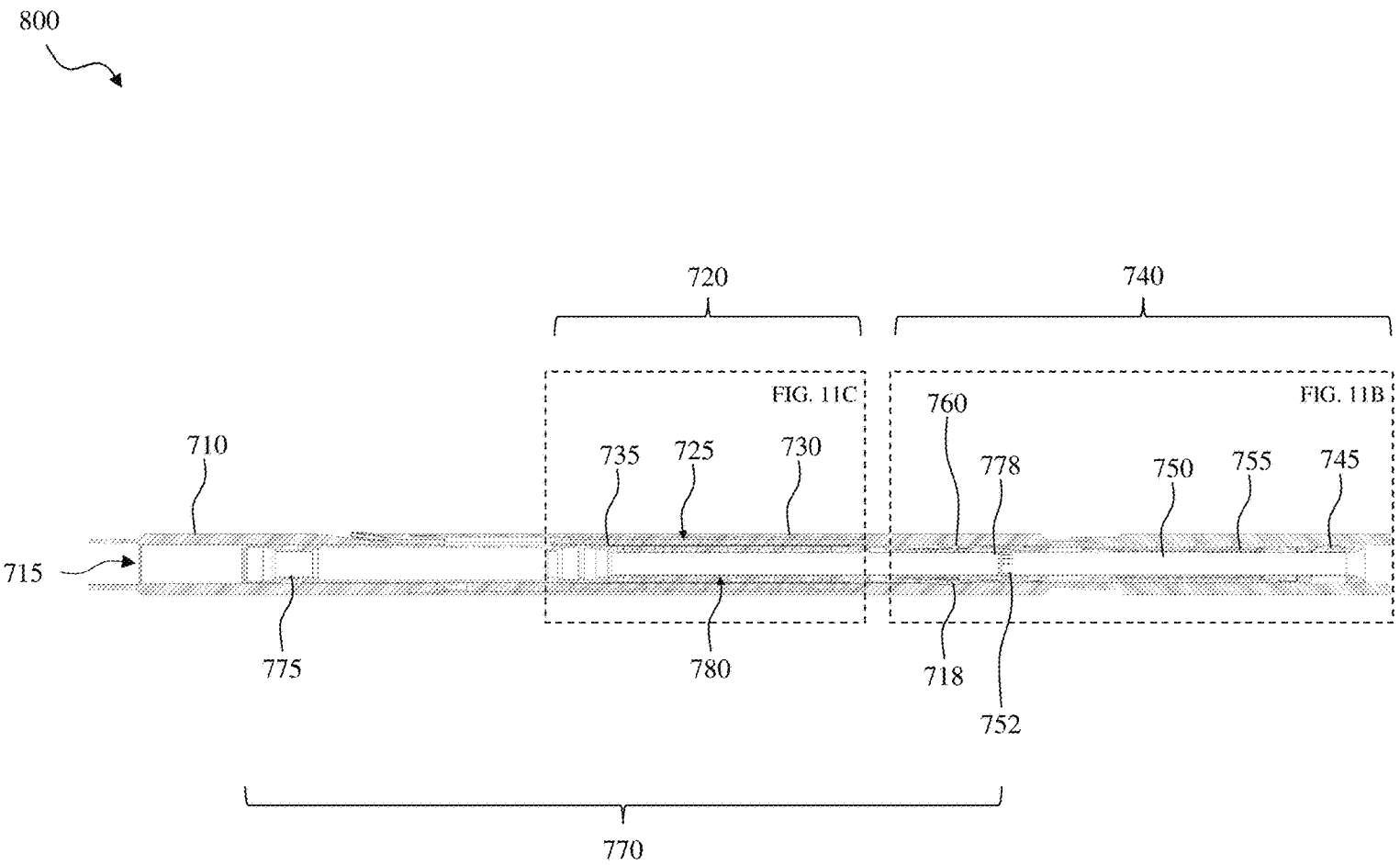
Figure 11B:
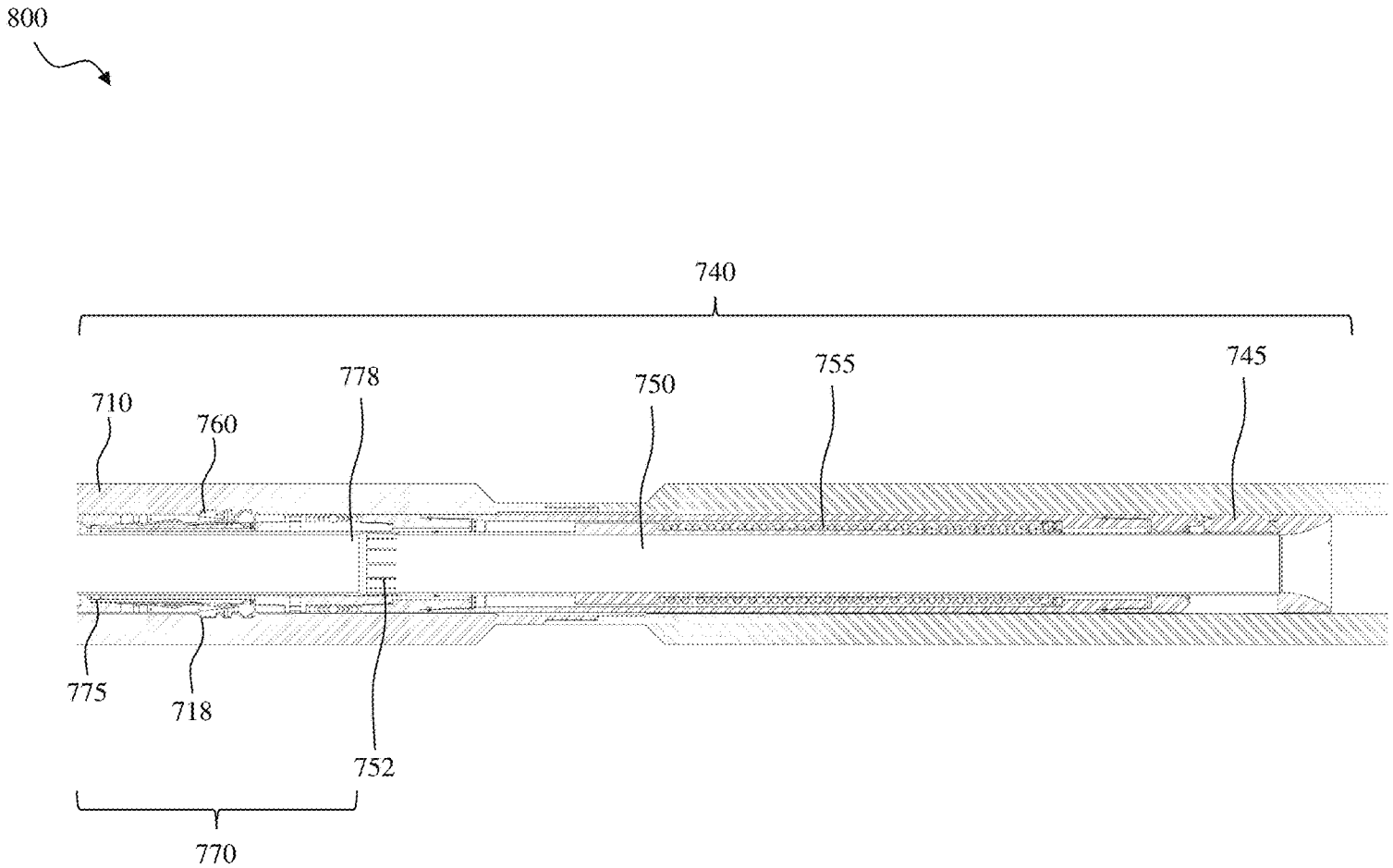
Figure 11C:
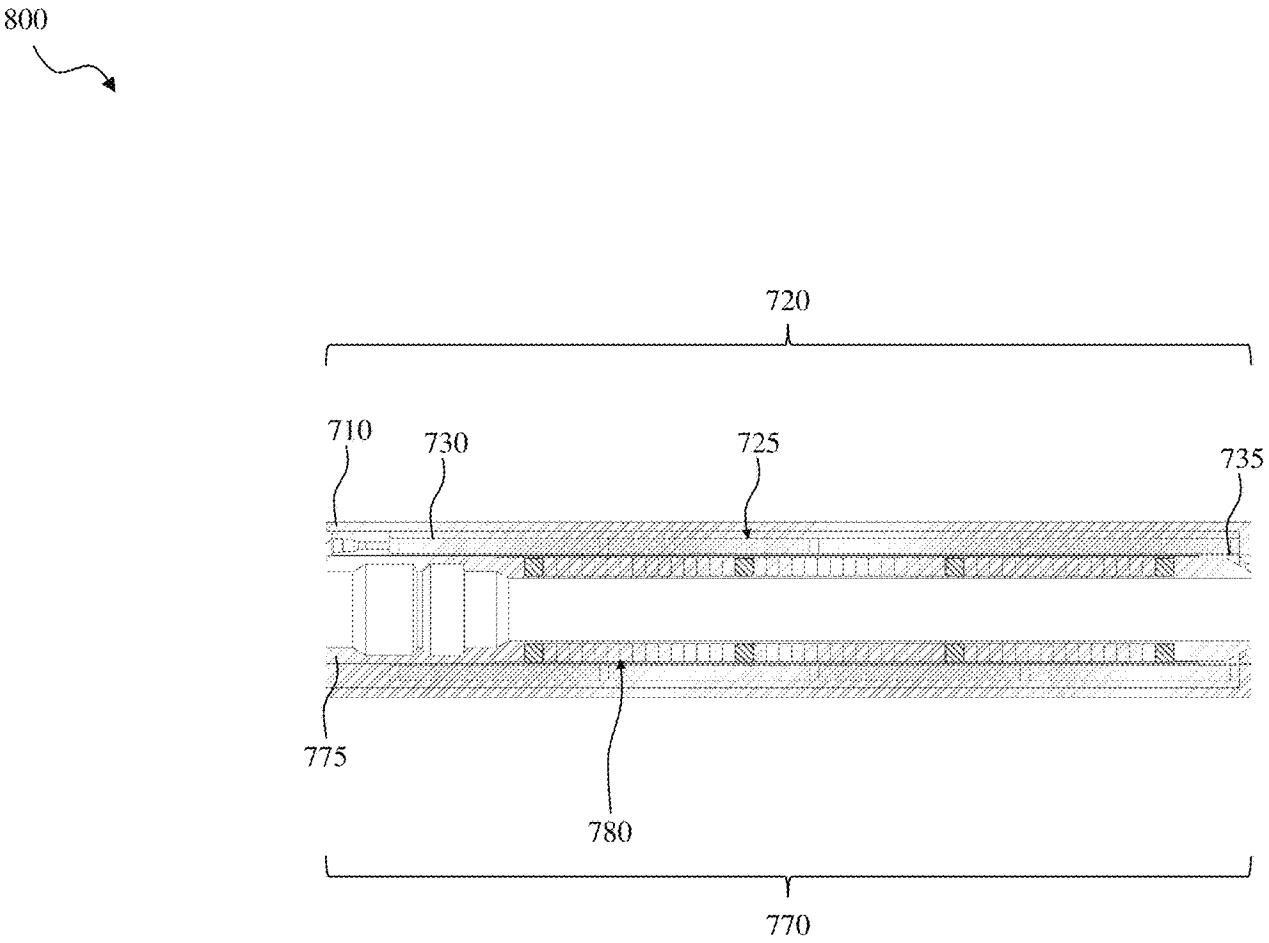

Turning to FIGS. 11A through 11C, illustrated is the downhole device 800 of FIGS. 10A through 10C after supplying electric power to the electromagnet assembly 725 to produce an electromagnetic field having an electromagnetic polarity (Y), the electromagnetic field magnetically engaging with the ferromagnet assembly 780 to actuate the mechanical connecting apparatus 775 a stroke distance (D) and slide the bore flow management actuator 750 from the first position (e.g., that shown in FIG. 9A) to the second position (e.g., that shown in FIG. 11A) to move the valve closure mechanism 745 between the closed state (e.g., that shown in FIG. 9A) and the open state (e.g., that shown in FIG. 11A). In at least this embodiment, no fluid pressure is used and/or required to slide the bore flow management actuator 750 from the first position (e.g., that shown in FIG. 9A) to the second position (e.g., that shown in FIG. 11A) to move the valve closure mechanism 745 between the closed state (e.g., that shown in FIG. 9A) and the open state (e.g., that shown in FIG. 11A). Moreover, in at least this one embodiment, the electric power being applied to the electromagnet assembly 725 may be used to independently hold the bore flow management actuator 750 at the second position (e.g., that shown in FIG. 11A).

Figure 12A:
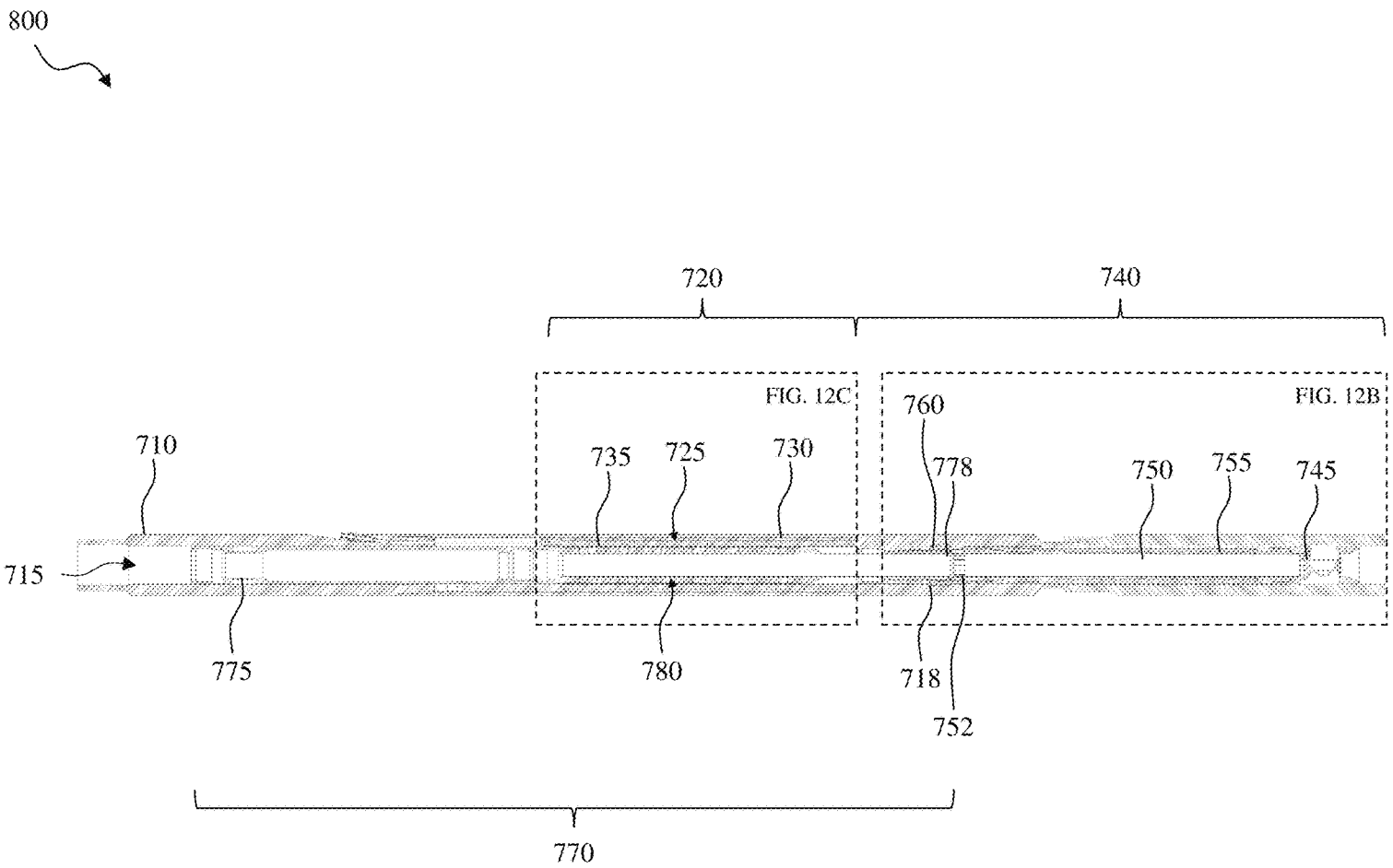
Figure 12B:
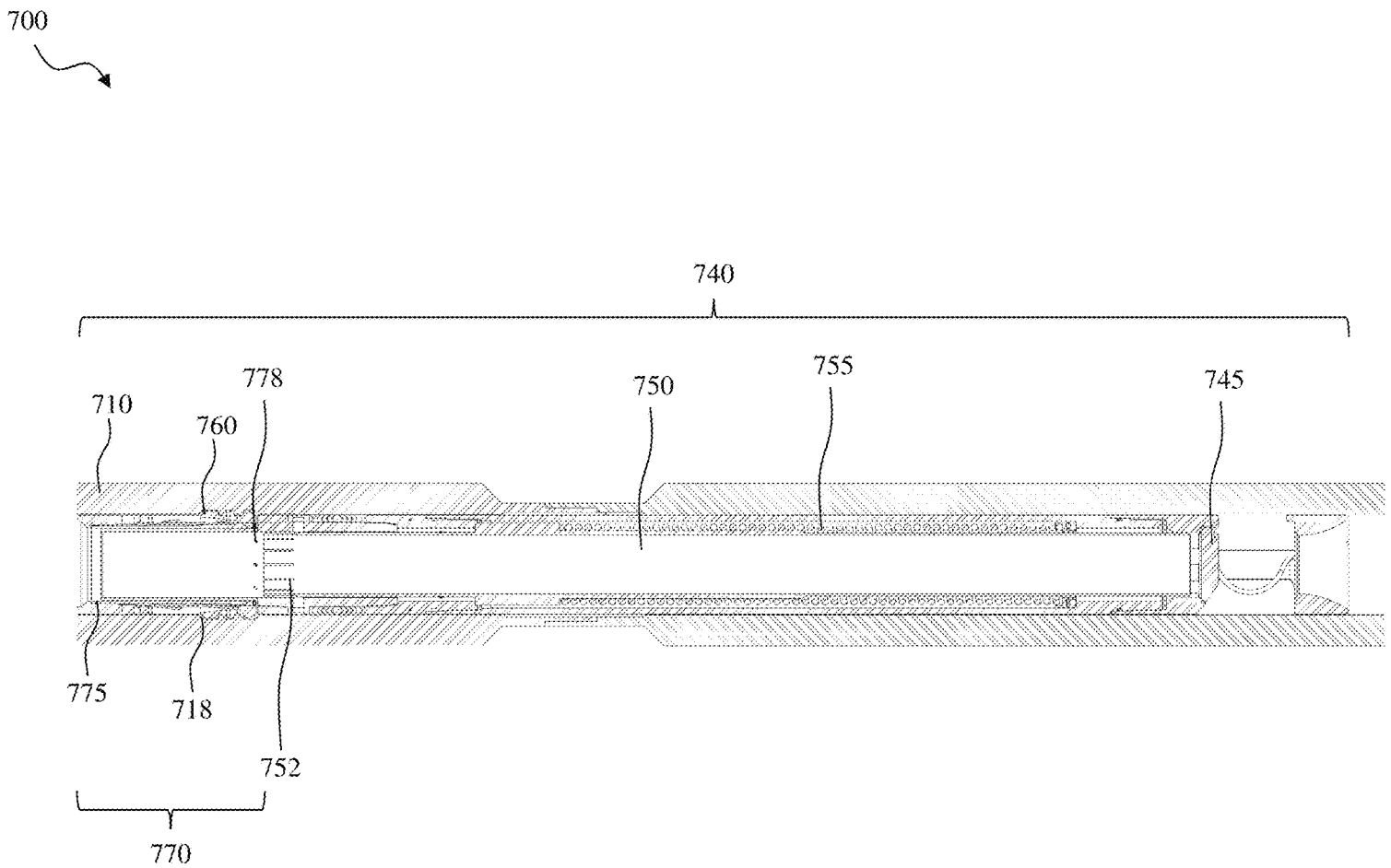
Figure 12C:
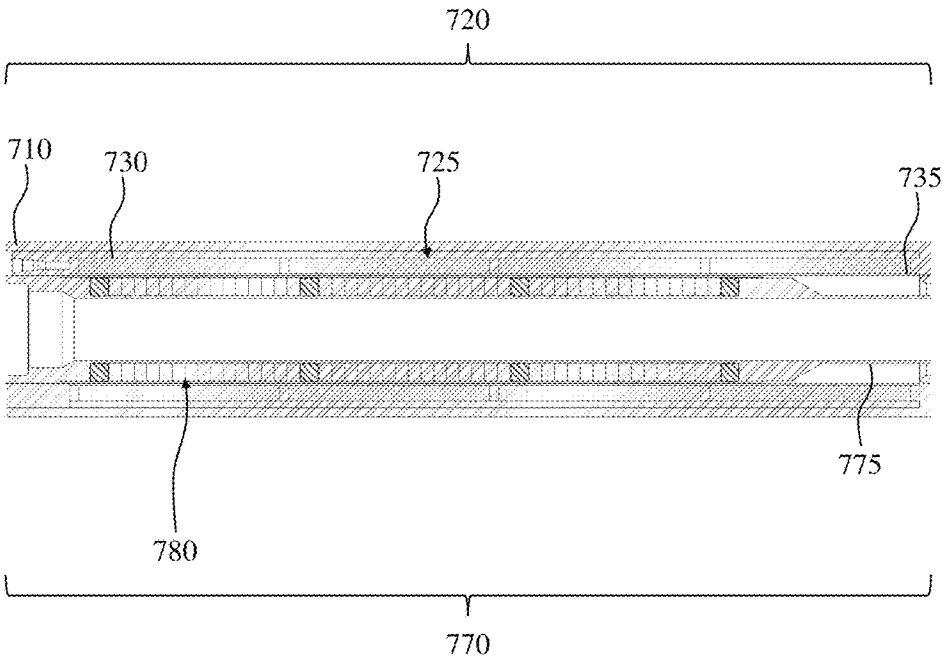

Turning to FIGS. 12A through 12C, illustrated is the downhole device 800 of FIGS. 11A through 11C after discontinuing to supply electric power to the electromagnet assembly 725. As there is no electromagnetic field being generated, the energy storage element 755 returns the bore flow management actuator 750 to the first position (e.g., that shown in FIG. 12A) thereby allowing the valve closure mechanism 745 to return to the closed state (e.g., that shown in FIG. 12A). At this stage, the downhole device 800 has progress through a full open/close sequence.

Aspects disclosed herein include:

A. A downhole device, the downhole device including: 1) a member having a first member end and a second opposite member end; 2) a movable element positioned about the member, the movable element having a first movable element end and a second opposite movable element end, the movable element configured to move a stroke distance (D) from a first position to a second position; 3) a permanent magnet assembly fixed to one of the member or the movable element, the permanent magnet assembly producing an inherent magnetic field having a magnetic polarity (X), the permanent magnet assembly generating a magnetic coupling force that biases the movable element toward the first position; and 4) an electromagnet assembly fixed to an other of the movable element or the member, the electromagnet assembly operable to receive electric power to produce an electromagnetic field having an electromagnetic polarity (Y) similar in direction to the magnetic polarity (X), the electromagnetic field configured to generate an opposite electromagnetic coupling force greater than the magnetic coupling force to actuate the movable element from the first position towards the second position when the electromagnet assembly receives the electric power.

B. A method, the method including: 1) accessing a downhole device located within a wellbore extending through one or more subterranean formations, wherein the downhole device includes: a) a member having a first member end and a second opposite member end; b) a movable element positioned about the member, the movable element having a first movable element end and a second opposite movable element end, the movable element configured to move a stroke distance (D) from a first position to a second position; c) a permanent magnet assembly fixed to one of the member or the movable element, the permanent magnet assembly producing an inherent magnetic field having a magnetic polarity (X), the permanent magnet assembly generating a magnetic coupling force that biases the movable element toward the first position; and d) an electromagnet assembly fixed to an other of the movable element or the member; and 2) supplying electric power to the electromagnet assembly to produce an electromagnetic field having an electromagnetic polarity (Y) similar in direction to the magnetic polarity (X), the electromagnetic field generating an opposite electromagnetic coupling force greater than the magnetic coupling force to actuate the movable element from the first position towards the second position.

C. A well system, the well system including: 1) a wellbore extending through one or more subterranean formations; and 2) a downhole device located within the wellbore, the downhole device including: a) a member having a first member end and a second opposite member end; b) a movable element positioned about the member, the movable element having a first movable element end and a second opposite movable element end, the movable element configured to move a stroke distance (D) from a first position to a second position; c) a permanent magnet assembly fixed to one of the member or the movable element, the permanent magnet assembly producing an inherent magnetic field having a magnetic polarity (X), the permanent magnet assembly generating a magnetic coupling force that biases the movable element toward the first position; and d) an electromagnet assembly fixed to an other of the movable element or the member, the electromagnet assembly operable to receive electric power to produce an electromagnetic field having an electromagnetic polarity (Y) similar in direction to the magnetic polarity (X), the electromagnetic field configured to generate an opposite electromagnetic coupling force greater than the magnetic coupling force to actuate the movable element from the first position towards the second position when the electromagnet assembly receives the electric power.

D. A downhole device, the downhole device including: 1) a member having a first member end and a second opposite member end; 2) a movable element positioned about the member, the movable element having a first movable element end and a second opposite movable element end, the movable element configured to move a stroke distance (D) from a first position to a second position; 3) a ferromagnet assembly fixed to one of the member or the movable element; and 4) an electromagnet assembly fixed to an other of the movable element or the member, the electromagnet assembly operable to receive electric power to produce an electromagnetic field having an electromagnetic polarity (Y), the electromagnetic field configured to actuate the movable element from the first position toward the second position and independently hold the movable element in the second position when the electromagnet assembly receives the electric power.

E. A method, the method including: 1) accessing a downhole device located within a wellbore extending through one or more subterranean formations, wherein the downhole device includes: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; and d) an electromagnet assembly fixed to an other of the movable element or the member; and 2) supplying electric power to the electromagnet assembly to produce an electromagnetic field having an electromagnetic polarity (Y), the electromagnetic field actuating the movable element from the first position toward the second position and independently holding the movable element at the second position.

F. A well system, the well system including: 1) a wellbore extending through one or more subterranean formations; and 2) a downhole device located within the wellbore, the downhole device including: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; and d) an electromagnet assembly fixed to an other of the movable element or the member, the electromagnet assembly operable to receive electric power to produce an electromagnetic field having an electromagnetic polarity (Y), the electromagnetic field configured to actuate the movable element from the first position to the second position and independently hold the movable element in the second position when the electromagnet assembly receives the electric power.

G downhole device, the downhole device including: 1) a member having a first member end and a second opposite member end; 2) a movable element positioned about the member, the movable element having a first movable element end and a second opposite movable element end, the movable element configured to move a stroke distance (D) from a first position to a second position; 3) a ferromagnet assembly fixed to one of the member or the movable element; 4) a first electromagnet assembly fixed to an other of the movable element or the member; and 5) a second electromagnet assemblies fixed to the other of the movable element or the member sequentially further from the first member end than the first electromagnet assembly, the first and second electromagnet assemblies each having a width ($W_{EM}$) and separated by a distance ($D_{EM}$), wherein the distance ($D_{EM}$) is less than each width ($W_{EM}$), and further wherein the first and second electromagnet assemblies are operable to receive electric power to produce first and second electromagnetic fields, the first and second electromagnetic fields configured to actuate the movable element from the first position toward the second position.

H. A method, the method including: 1) accessing a downhole device located within a wellbore extending through one or more subterranean formations, wherein the downhole device includes: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; d) a first electromagnet assembly fixed to an other of the movable element or the member; and e) a second electromagnet assemblies fixed to the other of the movable element or the member sequentially further from the first member end than the first electromagnet assembly, the first and second electromagnet assemblies each having a width ($W_{EM}$) and separated by a distance ($D_{EM}$), wherein the distance ($D_{EM}$) is less than each width ($W_{EM}$); and 2) supplying electric power to the first and second electromagnet assemblies to produce first and second electromagnetic fields, the first and second electromagnetic fields actuating the movable element from the first position toward the second position.

I. A well system, the well system including: 1) a wellbore extending through one or more subterranean formations; and 2) a downhole device located within the wellbore, the downhole device including: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; d) a first electromagnet assembly fixed to an other of the movable element or the member; and e) a second electromagnet assemblies fixed to the other of the movable element or the member sequentially further from the first member end than the first electromagnet assembly, the first and second electromagnet assemblies each having a width ($W_{EM}$) and separated by a distance ($D_{EM}$), wherein the distance ($D_{EM}$) is less than each width ($W_{EM}$), and further wherein the first and second electromagnet assemblies are operable to receive electric power to produce first and second electromagnetic fields, the first and second electromagnetic fields configured to actuate the movable element from the first position toward the second position.

J. A downhole device, the downhole device including: 1) a member having a first member end and a second opposite member end; 2) a movable element positioned about the member, the movable element having a first movable element end and a second opposite movable element end, the movable element configured to move a stroke distance (D) from a first position to a second position; 3) a ferromagnet assembly fixed to one of the member or the movable element; and 4) an electromagnet assembly fixed to an other of the movable element or the member, the electromagnet assembly having a width ($W_{EM}$), wherein the width ($W_{EM}$) is no more than 200% of the stroke distance (D), the electromagnet assembly operable to receive electric power to produce an electromagnetic field having an electromagnetic polarity (Y), the electromagnetic field configured to actuate the movable element from the first position toward the second position when the electromagnet assembly receives the electric power.

K. A method, the method including: 1) accessing a downhole device located within a wellbore extending through one or more subterranean formations, wherein the downhole device includes: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; and d) an electromagnet assembly fixed to an other of the movable element or the member, the electromagnet assembly having a width ($W_{EM}$), wherein the width ($W_{EM}$) is no more than 200% of the stroke distance (D); and 2) supplying electric power to the electromagnet assembly to produce an electromagnetic field having an electromagnetic polarity (Y), the electromagnetic field actuating the movable element from the first position toward the second position.

L. A well system, the well system including: 1) a wellbore extending through one or more subterranean formations; and 2) a downhole device located within the wellbore, the downhole device including: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; and d) an electromagnet assembly fixed to an other of the movable element or the member, the electromagnet assembly having a width ($W_{EM}$), wherein the width ($W_{EM}$) is no more than 200% of the stroke distance (D), the electromagnet assembly operable to receive electric power to produce an electromagnetic field having an electromagnetic polarity (Y), the electromagnetic field configured to actuate the movable element from the first position toward the second position when the electromagnet assembly receives the electric power.

M. A downhole device, the downhole device including: 1) a member having a first member end and a second opposite member end; 2) a movable element positioned about the member, the movable element having a first movable element end and a second opposite movable element end, the movable element configured to move a stroke distance (D) from a first position to a second position; 3) one or more ferromagnet assemblies fixed to one of the member or the movable element; and 4) two or more electromagnet assemblies fixed to an other of the movable element or the member, wherein a combined number (n) of the two or more electromagnet assemblies is greater than a combined number (m) of the one or more ferromagnet assemblies, wherein the two or more electromagnet assemblies are operable to receive electric power to produce two or more electromagnetic fields configured to actuate the movable element from the first position toward the second position.

N. A method, the method including: 1) accessing a downhole device located within a wellbore extending through one or more subterranean formations, wherein the downhole device includes: a) a member having a first member end and a second opposite member end; b) a movable element positioned about the member, the movable element having a first movable element end and a second opposite movable element end, the movable element configured to move a stroke distance (D) from a first position to a second position; c) one or more ferromagnet assemblies fixed to one of the member or the movable element; and d) two or more electromagnet assemblies fixed to an other of the movable element or the member, wherein a combined number (n) of the two or more electromagnet assemblies is greater than a combined number (m) of the one or more ferromagnet assemblies, wherein the two or more electromagnet assemblies are operable to receive electric power to produce; and 2) supplying electric power to the two or more electromagnet assemblies to produce two or more electromagnetic fields to actuate the movable element from the first position toward the second position.

O. A well system, the well system including: 1) a wellbore extending through one or more subterranean formations; and 2) a downhole device located within the wellbore, the downhole device including: a) a member having a first member end and a second opposite member end; b) a movable element positioned about the member, the movable element having a first movable element end and a second opposite movable element end, the movable element configured to move a stroke distance (D) from a first position to a second position; c) one or more ferromagnet assemblies fixed to one of the member or the movable element; and d) two or more electromagnet assemblies fixed to an other of the movable element or the member, wherein a combined number (n) of the two or more electromagnet assemblies is greater than a combined number (m) of the one or more ferromagnet assemblies, wherein the two or more electromagnet assemblies are operable to receive electric power to produce two or more electromagnetic fields configured to actuate the movable element from the first position toward the second position.

P. A downhole device, the downhole device including: 1) a member having a first member end and a second opposite member end; 2) a movable element positioned about the member, the movable element having a first movable element end and a second opposite movable element end, the movable element configured to move a stroke distance (D) from a first position to a second position; 3) a ferromagnet assembly fixed to one of the member or the movable element; 4) a first electromagnet assembly fixed to an other of the movable element or the member, the first electromagnet assembly operable to receive electric power to produce a first electromagnetic field having an electromagnetic polarity (Y); and 5) one or more additional electromagnet assemblies fixed to the other of the movable element or the member sequentially further from the first member end than the first electromagnet assembly, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y), the first electromagnet assembly and one or more additional electromagnetic assemblies configured to actuate the movable element from the first position toward the second position.

Q. A method, the method including: 1) accessing a downhole device located within a wellbore extending through one or more subterranean formations, wherein the downhole device includes: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; d) a first electromagnet assembly fixed to an other of the movable element or the member; and e) one or more additional electromagnet assemblies fixed to the other of the movable element or the member sequentially further from the first member end than the first electromagnet assembly; 2) supplying electric power to the first electromagnet assembly to produce a first electromagnetic field having an electromagnetic polarity (Y); and 3) supplying additional power to the one or more additional electromagnet assemblies to produce additional electromagnetic fields that alternate between having a second electromagnetic polarity (Y') opposite the electromagnetic polarity (Y), and the electromagnetic polarity (Y), the first electromagnet assembly and one or more additional electromagnetic assemblies actuating the movable element from the first position toward the second position.

R. A well system, the well system including: 1) a wellbore extending through one or more subterranean formations; and 2) a downhole device located within the wellbore, the downhole device including: a) a member having a first member end and a second opposite member end; b) a movable element positioned about the member, the movable element having a first movable element end and a second opposite movable element end, the movable element configured to move a stroke distance (D) from a first position to a second position; c) a ferromagnet assembly fixed to one of the member or the movable element; d) a first electromagnet assembly fixed to an other of the movable element or the member, the first electromagnet assembly operable to receive electric power to produce a first electromagnetic field having an electromagnetic polarity (Y); and e) one or more additional electromagnet assemblies fixed to the other of the movable element or the member sequentially further from the first member end than the first electromagnet assembly, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y), the first electromagnet assembly and one or more additional electromagnetic assemblies configured to actuate the movable element from the first position toward the second position.

S. A downhole device, the downhole device including: 1) a first portion, the first portion including an electromagnet assembly coupled thereto, the first portion configured to be run-in-hole as part of wellbore tubing; 2) a second portion, the second portion including a valve closure mechanism and a bore flow management actuator, the bore flow management actuator configured to slide from a first position to a second position to move the valve closure mechanism between a closed state and an open state; and 3) a third portion, the third portion including a mechanical connecting apparatus having a ferromagnet assembly coupled thereto, the mechanical connecting apparatus configured to engage with at least a portion of the bore flow management actuator, the electromagnet assembly operable to receive electric power to produce an electromagnetic field having an electromagnetic polarity (Y), the electromagnetic field configured to magnetically engage with the ferromagnet assembly to actuate the mechanical connecting apparatus a stroke distance (D) and slide the bore flow management actuator from the first position to the second position to move the valve closure mechanism between the closed state and the open state.

T. A method, the method including: 1) accessing a downhole device located within a wellbore extending through one or more subterranean formations, wherein the downhole device includes: a) a first portion, the first portion including an electromagnet assembly coupled thereto, the first portion configured to be run-in-hole as part of wellbore tubing; b) a second portion, the second portion including a valve closure mechanism and a bore flow management actuator, the bore flow management actuator configured to slide from a first position to a second position to move the valve closure mechanism between a closed state and an open state; and c) a third portion, the third portion including a mechanical connecting apparatus having a ferromagnet assembly coupled thereto, the mechanical connecting apparatus coupling with at least a portion of the bore flow management actuator; and 2) supplying electric power to the electromagnet assembly to produce an electromagnetic field having an electromagnetic polarity (Y), the electromagnetic field magnetically engaging with the ferromagnet assembly to actuate the mechanical connecting apparatus a stroke distance (D) and slide the bore flow management actuator from the first position to the second position to move the valve closure mechanism between the closed state and the open state.

U. A well system, the well system including: 1) a wellbore extending through one or more subterranean formations; and 2) a downhole device located within the wellbore, the downhole device including: a) a first portion, the first portion including an electromagnet assembly coupled thereto, the first portion configured to be run-in-hole as part of wellbore tubing; b) a second portion, the second portion including a valve closure mechanism and a bore flow management actuator, the bore flow management actuator configured to slide from a first position to a second position to move the valve closure mechanism between a closed state and an open state; and c) a third portion, the third portion including a mechanical connecting apparatus having a ferromagnet assembly coupled thereto, the mechanical connecting apparatus configured to engage with at least a portion of the bore flow management actuator, the electromagnet assembly operable to receive electric power to produce an electromagnetic field having an electromagnetic polarity (Y), the electromagnetic field configured to magnetically engage with the ferromagnet assembly to actuate the mechanical connecting apparatus a stroke distance (D) and slide the bore flow management actuator from the first position to the second position to move the valve closure mechanism between the closed state and the open state.

Aspects A through U may have one or more of the following additional elements in combination: Element 1: wherein the magnetic coupling force and relative positions of the permanent magnet assembly and the electromagnet assembly along the stroke distance (D) are set such that a required electric power needed to generate the opposite electromagnetic coupling force greater than the magnetic coupling force to actuate the movable element decreases as the movable element moves from the first position to the second position. Element 2: further including a separate energy storage element coupled with the movable element, the separate energy storage element generating a return force that biases the movable element toward the first position. Element 3: wherein the magnetic coupling force, the return force, and the relative positions of the permanent magnet assembly and the electromagnet assembly along the stroke distance (D) are set such that the required electric power needed to generate the opposite electromagnetic coupling force greater than the magnetic coupling force and the return force to actuate the movable element decreases as the movable element moves from the first position to the second position. Element 4: wherein the permanent magnet assembly is a first permanent magnet assembly having the magnetic polarity (X) and the electromagnet assembly is a first electromagnet assembly having the electromagnetic polarity (Y), and further including: one or more additional permanent magnet assemblies fixed to the one of the member or the movable element sequentially further from the first member end than the first permanent magnet assembly, the one or more additional permanent magnet assemblies each producing additional inherent magnetic fields that alternate between having a second magnetic polarity (X') opposite the magnetic polarity (X), and the magnetic polarity (X); and one or more additional electromagnet assemblies fixed to the other of the movable element or the member sequentially further from the first member end than the first electromagnet assembly, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y). Element 5: wherein a combined number (n) of the first electromagnet assembly and the one or more additional electromagnet assemblies fixed to the other of the movable element or the member is greater than a combined number (m) of the first permanent magnet assembly and the one or more additional permanent magnet assemblies fixed to the one of the member or the movable element. Element 6: wherein n=m+1. Element 7: wherein the electric power and the additional electric power are a same electric power. Element 8: wherein the first electromagnet assembly and the one or more additional electromagnet assemblies are wired in series to provide the electromagnetic polarity (Y) and second electromagnetic polarity (Y') that alternate. Element 9: wherein first ones of the first electromagnet assembly and the one or more additional electromagnet assemblies, as well as second ones of the first permanent magnet assembly and the one or more additional permanent magnet assemblies, are separated by individual ferromagnetic rings. Element 10: wherein the electromagnetic field is configured to generate the opposite electromagnetic coupling force greater than the magnetic coupling force to linearly actuate the movable element from the first position to the second position when the electromagnet assembly receives the electric power. Element 11: wherein the permanent magnet assembly is fixed to the movable element and the electromagnet assembly is fixed to the member. Element 12: wherein the member is a flow control valve housing, the movable element is a movable flow control element, and further including a valve closure mechanism coupled with the flow control valve housing, the movable flow control element configured to actuate between the first position and the second position and thereby move the valve closure mechanism between a closed state and an open state. Element 13: wherein the movable flow control element is a movable flow control tube. Element 14: wherein the valve closure mechanism is a flapper-type valve configured to rotate between the closed state and the open state as the movable flow control tube moves between the first position and the second position. Element 15: wherein the ferromagnet assembly is a permanent magnet assembly, the permanent magnet assembly producing an inherent magnetic field having a magnetic polarity (X), the permanent magnet assembly generating a magnetic coupling force that biases the movable element toward the first position. Element 16: wherein the magnetic coupling force and relative positions of the permanent magnet assembly and the electromagnet assembly along the stroke distance (D) are set such that a required electric power needed to generate an opposite electromagnetic coupling force greater than the magnetic coupling force to actuate the movable element decreases as the movable element moves from the first position to the second position. Element 17: further including a separate energy storage element coupled with the movable element, the separate energy storage element generating a return force that biases the movable element toward the first position. Element 18: wherein the magnetic coupling force, the return force, and the relative positions of the permanent magnet assembly and the electromagnet assembly along the stroke distance (D) are set such that the required electric power needed to generate the opposite electromagnetic coupling force greater than the magnetic coupling force and the return force to actuate the movable element decreases as the movable element moves from the first position to the second position. Element 19: wherein the ferromagnet assembly is a first ferromagnet assembly and the electromagnet assembly is a first electromagnet assembly having the electromagnetic polarity (Y), and further including: one or more additional ferromagnet assemblies fixed to the one of the member or the movable element sequentially further from the first member end than the first ferromagnet assembly; and one or more additional electromagnet assemblies fixed to the other of the movable element or the member sequentially further from the first member end than the first electromagnet assembly, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y). Element 20: wherein a combined number (n) of the first electromagnet assembly and the one or more additional electromagnet assemblies fixed to the other of the movable element or the member is greater than a combined number (m) of the first ferromagnet assembly and the one or more additional ferromagnet assemblies fixed to the one of the member or the movable element. Element 21: wherein n=m+1. Element 22: wherein the electric power and the additional electric power are a same electric power, and further wherein the first electromagnet assembly and the one or more additional electromagnet assemblies are wired in series to provide the electromagnetic polarity (Y) and second electromagnetic polarity (Y') that alternate. Element 23: wherein ones of the first electromagnet assembly and the one or more additional electromagnet assemblies are separated by individual ferromagnetic rings. Element 24: wherein the electromagnet assembly is operable to receive electric power to produce the electromagnetic field having the electromagnetic polarity (Y), the electromagnetic field configured to linearly actuate the movable element from the first position toward the second position. Element 25: wherein the ferromagnet assembly is fixed to the movable element and the electromagnet assembly is fixed to the member. Element 26: wherein the member is a flow control valve housing, the movable element is a movable flow control element, and further including a valve closure mechanism coupled with the flow control valve housing, the movable element configured to actuate between the first position and the second position and thereby move the valve closure mechanism between a closed state and an open state. Element 27: wherein the movable flow control element is a movable flow control tube. Element 28: wherein the valve closure mechanism is a flapper-type valve configured to rotate between the closed state and the open state as the movable flow control tube moves between the first position and the second position. Element 29: wherein the distance ($D_{EM}$) is at least 10% less than each width ($W_{EM}$). Element 30: wherein the distance ($D_{EM}$) is at least 30% less than each width ($W_{EM}$). Element 31: wherein the distance ($D_{EM}$) is at least 50% less than each width ($W_{EM}$). Element 32: wherein the distance ($D_{EM}$) is at least 70% less than each width ($W_{EM}$). Element 33: wherein the distance ($D_{EM}$) is at least 90% less than each width ($W_{EM}$). Element 34: wherein the first and second electromagnet assemblies are operable to receive the electric power to produce the first and second electromagnetic fields having a same electromagnetic polarity (Y). Element 35: wherein the first electromagnet assembly is operable to receive the electric power to produce the first electromagnetic field having an electromagnetic polarity (Y) and the second electromagnet assembly is operable to receive the electric power to produce the second electromagnetic field having an opposite electromagnetic polarity (Y'). Element 36: wherein the ferromagnet assembly is a permanent magnet assembly, the permanent magnet assembly producing an inherent magnetic field having a magnetic polarity (X), the permanent magnet assembly generating a magnetic coupling force that biases the movable element toward the first position. Element 37: wherein the magnetic coupling force and relative positions of the permanent magnet assembly and the first and second electromagnet assemblies along the stroke distance (D) are set such that a required electric power needed to generate an opposite electromagnetic coupling force greater than the magnetic coupling force to actuate the movable element decreases as the movable element moves from the first position to the second position. Element 38: further including a separate energy storage element coupled with the movable element, the separate energy storage element generating a return force that biases the movable element toward the first position. Element 39: wherein the magnetic coupling force, the return force, and the relative positions of the permanent magnet assembly and the first and second electromagnet assemblies along the stroke distance (D) are set such that the required electric power needed to generate the opposite electromagnetic coupling force greater than the magnetic coupling force and the return force to actuate the movable element decreases as the movable element moves from the first position to the second position. Element 40: wherein the ferromagnet assembly is a first ferromagnet assembly, and further including: one or more additional ferromagnet assemblies fixed to the one of the member or the movable element sequentially further from the first member end than the first ferromagnet assembly; and one or more additional electromagnet assemblies fixed to the other of the movable element or the member sequentially further from the first member end than the first electromagnet assembly and second electromagnet assembly, the one or more additional electromagnet assemblies operable to receive additional electric power and each produce additional electromagnetic fields, the first electromagnetic field, second electromagnetic field, and additional electromagnetic fields alternating between having an electromagnetic polarity (Y) and an electromagnetic polarity (Y') opposite the electromagnetic polarity (Y). Element 41: wherein a combined number (n) of the first electromagnet assembly, second electromagnet assembly, and one or more additional electromagnet assemblies is greater than a combined number (m) of the first ferromagnet assembly and the one or more additional ferromagnet assemblies. Element 42: wherein n=m+1. Element 43: wherein the width ($W_{EM}$) is no more than 180% of the stroke distance (D). Element 44: wherein the width ($W_{EM}$) is no more than 160% of the stroke distance (D). Element 45: wherein the width ($W_{EM}$) is no more than 140% of the stroke distance (D). Element 46: wherein the width ($W_{EM}$) ranges from 150% to 50% of the stroke distance (D). Element 47: wherein the width ($W_{EM}$) ranges from 120% to 80% of the stroke distance (D). Element 48: wherein the ferromagnet assembly is a permanent magnet assembly, the permanent magnet assembly producing an inherent magnetic field having a magnetic polarity (X), the permanent magnet assembly generating a magnetic coupling force that biases the movable element toward the first position. Element 49: wherein the magnetic coupling force and relative positions of the permanent magnet assembly and the electromagnet assembly along the stroke distance (D) are set such that a required electric power needed to generate an opposite electromagnetic coupling force greater than the magnetic coupling force to actuate the movable element decreases as the movable element moves from the first position to the second position. Element 50: further including a separate energy storage element coupled with the movable element, the separate energy storage element generating a return force that biases the movable element toward the first position. Element 51: wherein the magnetic coupling force, the return force, and the relative positions of the permanent magnet assembly and the electromagnet assembly along the stroke distance (D) are set such that the required electric power needed to generate the opposite electromagnetic coupling force greater than the magnetic coupling force and the return force to actuate the movable element decreases as the movable element moves from the first position to the second position. Element 52: wherein the ferromagnet assembly is a first ferromagnet assembly and the electromagnet assembly is a first electromagnet assembly having the electromagnetic polarity (Y), and further including: one or more additional ferromagnet assemblies fixed to the one of the member or the movable element sequentially further from the first member end than the first ferromagnet assembly; and one or more additional electromagnet assemblies fixed to the other of the movable element or the member sequentially further from the first member end than the first electromagnet assembly, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y). Element 53: wherein a combined number (n) of the first electromagnet assembly and the one or more additional electromagnet assemblies fixed to the other of the movable element or the member is greater than a combined number (m) of the first ferromagnet assembly and the one or more additional ferromagnet assemblies fixed to the one of the member or the movable element. Element 54: wherein n=m+1. Element 55: wherein the electric power and the additional electric power are a same electric power, and further wherein the first electromagnet assembly and the one or more additional electromagnet assemblies are wired in series to provide the electromagnetic polarity (Y) and second electromagnetic polarity (Y') that alternate. Element 56: wherein the ferromagnet assembly is fixed to the movable element and the electromagnet assembly is fixed to the member. Element 57: wherein n=m+1. Element 58: wherein n is at least 3. Element 59: wherein n is at least 4. Element 60: wherein n ranges from 3 to 10. Element 61: wherein n ranges from 4 to 8. Element 62: wherein the two or more electromagnet assemblies are operable to receive the electric power to produce two or more electromagnetic fields having a same electromagnetic polarity (Y). Element 63: wherein a first of the two or more electromagnet assemblies is operable to receive the electric power to produce a first electromagnetic field having an electromagnetic polarity (Y) and a second of the two or more electromagnet assemblies is operable to receive the electric power to produce a second electromagnetic field having an opposite electromagnetic polarity (Y'). Element 64: wherein the one or more ferromagnet assemblies are one or more permanent magnet assemblies, the one or more permanent magnet assemblies producing an inherent magnetic field having a magnetic polarity (X), the one or more permanent magnet assemblies generating a magnetic coupling force that biases the movable element toward the first position. Element 65: wherein the magnetic coupling force and relative positions of the one or more permanent magnet assemblies and the two or more electromagnet assemblies along the stroke distance (D) are set such that a required electric power needed to generate an opposite electromagnetic coupling force greater than the magnetic coupling force to actuate the movable element decreases as the movable element moves from the first position to the second position. Element 66: further including a separate energy storage element coupled with the movable element, the separate energy storage element generating a return force that biases the movable element toward the first position. Element 67: wherein the magnetic coupling force, the return force, and the relative positions of the one or more permanent magnet assemblies and the two or more electromagnet assemblies along the stroke distance (D) are set such that the required electric power needed to generate the opposite electromagnetic coupling force greater than the magnetic coupling force and the return force to actuate the movable element decreases as the movable element moves from the first position to the second position. Element 68: wherein the member is a flow control valve housing, the movable element is a movable flow control element, and further including a valve closure mechanism coupled with the flow control valve housing, the movable flow control element configured to actuate between the first position and the second position and thereby move the valve closure mechanism between a closed state and an open state. Element 69: wherein the movable flow control element is a movable flow control tube. Element 70: wherein the valve closure mechanism is a flapper-type valve configured to rotate between the closed state and the open state as the movable flow control tube moves between the first position and the second position. Element 71: wherein the one or more additional electromagnetic assemblies are second and third electromagnetic assemblies fixed to the other of the movable element or the member sequentially further from the first member end than the first electromagnet assembly, and further wherein the second electromagnet assembly is operable to receive the additional electric power to produce a second electromagnetic field having the second electromagnetic polarity (Y') and the third electromagnet assembly is operable to receive the additional electric power to produce a third electromagnetic field having the electromagnetic polarity (Y). Element 72: wherein the one or more additional electromagnetic assemblies are second and third electromagnetic assemblies fixed to the other of the movable element or the member sequentially further from the first member end than the first electromagnet assembly, and further wherein the second electromagnet assembly is operable to receive the additional electric power to produce a second electromagnetic field having the second electromagnetic polarity (Y'), the third electromagnet assembly is operable to receive the additional electric power to produce a third electromagnetic field having the electromagnetic polarity (Y), and the fourth electromagnet assembly is operable to receive the additional electric power to produce a fourth electromagnetic field having the second electromagnetic polarity (Y'). Element 73: wherein the ferromagnet assembly is a permanent magnet assembly, the permanent magnet assembly producing an inherent magnetic field having a magnetic polarity (X), the permanent magnet assembly generating a magnetic coupling force that biases the movable element toward the first position. Element 74: wherein the magnetic coupling force and relative positions of the permanent magnet assembly and the first and one or more additional electromagnet assemblies along the stroke distance (D) are set such that a required electric power needed to generate an opposite electromagnetic coupling force greater than the magnetic coupling force to actuate the movable element decreases as the movable element moves from the first position to the second position. Element 75: further including a separate energy storage element coupled with the movable element, the separate energy storage element generating a return force that biases the movable element toward the first position. Element 76: wherein the magnetic coupling force, the return force, and the relative positions of the permanent magnet assembly and the first and one or more additional electromagnet assemblies along the stroke distance (D) are set such that the required electric power needed to generate the opposite electromagnetic coupling force greater than the magnetic coupling force and the return force to actuate the movable element decreases as the movable element moves from the first position to the second position. Element 77: wherein the first electromagnetic field and additional electromagnetic fields are configured to generate an opposite electromagnetic coupling force greater than the magnetic coupling force to linearly actuate the movable element from the first position to the second position when the first electromagnet assembly and one or more additional electromagnet assemblies receive the electric power and additional electric power. Element 78: wherein the permanent magnet assembly is fixed to the movable element and the first electromagnet assembly and one or more additional electromagnet assemblies are fixed to the member. Element 79: wherein the ferromagnet assembly is a first ferromagnet assembly, and further including one or more additional ferromagnet assemblies fixed to the one of the member or the movable element sequentially further from the first member end than the first ferromagnet assembly. Element 80: wherein a combined number (n) of the first electromagnet assembly and one or more additional electromagnet assemblies is greater than a combined number (m) of the first ferromagnet assembly and the one or more additional ferromagnet assemblies. Element 81: wherein n=m+1. Element 82: wherein the member is a flow control valve housing, the movable element is a movable flow control element, and further including a valve closure mechanism coupled with the flow control valve housing, the movable flow control element configured to actuate between the first position and the second position and thereby move the valve closure mechanism between a closed state and an open state. Element 83: wherein the movable flow control element is a movable flow control tube. Element 84: wherein the valve closure mechanism is a flapper-type valve configured to rotate between the closed state and the open state as the movable flow control tube moves between the first position and the second position. Element 85: wherein the electromagnetic field is configured to magnetically engage with the ferromagnet assembly to independently hold the bore flow management actuator at the second position. Element 86: wherein the ferromagnet assembly is a permanent magnet assembly, the permanent magnet assembly producing an inherent magnetic field having a magnetic polarity (X), the permanent magnet assembly generating a magnetic coupling force that biases the bore flow management actuator toward the first position. Element 87: wherein the magnetic coupling force and relative positions of the permanent magnet assembly and the electromagnet assembly along the stroke distance (D) are set such that a required electric power needed to generate an opposite electromagnetic coupling force greater than the magnetic coupling force to slide the bore flow management actuator decreases as the bore flow management actuator slides from the first position to the second position. Element 88: further including a separate energy storage element coupled with the bore flow management actuator, the separate energy storage element generating a return force that biases the bore flow management actuator toward the first position. Element 89: wherein the magnetic coupling force, the return force, and the relative positions of the permanent magnet assembly and the electromagnet assembly along the stroke distance (D) are set such that the required electric power needed to generate the opposite electromagnetic coupling force greater than the magnetic coupling force and the return force to slide the bore flow management actuator decreases as the bore flow management actuator slides from the first position to the second position. Element 90: wherein the electromagnet assembly is a first electromagnet assembly having the electromagnetic polarity (Y) and the ferromagnet assembly is a first ferromagnet assembly, and further including: one or more additional electromagnet assemblies coupled to the first portion sequentially toward the second portion, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y); and one or more additional ferromagnet assemblies coupled to the mechanical connecting apparatus sequentially toward the second portion. Element 91: wherein a combined number (n) of the first electromagnet assembly and the one or more additional electromagnet assemblies coupled to the first portion is greater than a combined number (m) of the first ferromagnet assembly and the one or more additional ferromagnet assemblies coupled to the mechanical connecting apparatus. Element 92: wherein n=m+1. Element 93: wherein the electric power and the additional electric power are a same electric power, and further wherein the first electromagnet assembly and the one or more additional electromagnet assemblies are wired in series to provide the electromagnetic polarity (Y) and second electromagnetic polarity (Y') that alternate. Element 94: wherein ones of the first electromagnet assembly and the one or more additional electromagnet assemblies are separated by individual ferromagnetic rings. Element 95: wherein the electromagnet assembly is operable to receive electric power to produce the electromagnetic field having the electromagnetic polarity (Y), the electromagnetic field configured to linearly slide the bore flow management actuator from the first position toward the second position. Element 96: wherein the valve closure mechanism is a flapper-type valve configured to rotate between the closed state and the open state as the bore flow management actuator moves between the first position and the second position. Element 97: wherein the electromagnet assembly is located in a pocket in the first portion. Element 98: wherein the first portion further includes a fluid isolation sleeve separating the electromagnet assembly located in the pocket from the mechanical connecting apparatus. Element 99: wherein the fluid isolation sleeve is non-ferromagnetic. Element 100: wherein the fluid isolation sleeve is an axially fixed fluid isolation sleeve. Element 101: wherein the bore flow management actuator includes a bore flow management actuator profile and the mechanical connecting apparatus includes a downhole mechanical connecting apparatus profile, and further wherein the downhole mechanical connecting apparatus profile is configured to couple with the bore flow management actuator profile to axially couple the at least a portion of the bore flow management actuator and the mechanical connecting apparatus. Element 102: wherein the second portion and third portion are configured to be run-in-hole after the first portion. Element 103: wherein the third portion is configured to be run-in-hole after the second portion. Element 104: further including deploying the downhole device within the wellbore prior to accessing the downhole device. Element 105: wherein at least a portion of the downhole device is a WLRSV, and further wherein deploying includes deploying using a wireline. Element 106: wherein at least a portion of the downhole device is a TRSV, and further wherein deploying includes deploying at least a portion of the TRSV using a tubing string.

Those skilled in the art to which this application relates will appreciate that other and further additions, deletions, substitutions and modifications may be made to the described embodiments.

What is claimed is:

1. A downhole device, comprising:

a first portion, the first portion including an electromagnet assembly coupled thereto, the first portion configured to be run-in-hole as part of wellbore tubing;

a second portion, the second portion including a valve closure mechanism and a bore flow management actuator, the bore flow management actuator configured to slide from a first position to a second position to move the valve closure mechanism between a closed state and an open state; and a third portion, the third portion including a mechanical connecting apparatus having a ferromagnet assembly coupled thereto, the mechanical connecting apparatus configured to engage with at least a portion of the bore flow management actuator, the electromagnet assembly operable to receive electric power to produce an electromagnetic field having an electromagnetic polarity (Y), the electromagnetic field configured to magnetically engage with the ferromagnet assembly to actuate the mechanical connecting apparatus a stroke distance (D) and slide the bore flow management actuator from the first position to the second position to move the valve closure mechanism between the closed state and the open state.

2. The downhole device as recited in claim 1, wherein the electromagnetic field is configured to magnetically engage with the ferromagnet assembly to independently hold the bore flow management actuator at the second position.

3. The downhole device as recited in claim 1, wherein the ferromagnet assembly is a permanent magnet assembly, the permanent magnet assembly producing an inherent magnetic field having a magnetic polarity (X), the permanent magnet assembly generating a magnetic coupling force that biases the bore flow management actuator toward the first position.

4. The downhole device as recited in claim 3, wherein the magnetic coupling force and relative positions of the permanent magnet assembly and the electromagnet assembly along the stroke distance (D) are set such that a required electric power needed to generate an opposite electromagnetic coupling force greater than the magnetic coupling force to slide the bore flow management actuator decreases as the bore flow management actuator slides from the first position to the second position.

5. The downhole device as recited in claim 4, further including a separate energy storage element coupled with the bore flow management actuator, the separate energy storage element generating a return force that biases the bore flow management actuator toward the first position.

6. The downhole device as recited in claim 5, wherein the magnetic coupling force, the return force, and the relative positions of the permanent magnet assembly and the electromagnet assembly along the stroke distance (D) are set such that the required electric power needed to generate the opposite electromagnetic coupling force greater than the magnetic coupling force and the return force to slide the bore flow management actuator decreases as the bore flow management actuator slides from the first position to the second position.

7. The downhole device as recited in claim 1, wherein the electromagnet assembly is a first electromagnet assembly having the electromagnetic polarity (Y) and the ferromagnet assembly is a first ferromagnet assembly, and further including:

one or more additional electromagnet assemblies coupled to the first portion sequentially toward the second portion, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y); and one or more additional ferromagnet assemblies coupled to the mechanical connecting apparatus sequentially toward the second portion.

8. The downhole device as recited in claim 7, wherein a combined number (n) of the first electromagnet assembly and the one or more additional electromagnet assemblies coupled to the first portion is greater than a combined number (m) of the first ferromagnet assembly and the one or more additional ferromagnet assemblies coupled to the mechanical connecting apparatus.

9. The downhole device as recited in claim 8, wherein n=m+1.

10. The downhole device as recited in claim 9, wherein the electric power and the additional electric power are a same electric power, and further wherein the first electromagnet assembly and the one or more additional electromagnet assemblies are wired in series to provide the electromagnetic polarity (Y) and second electromagnetic polarity (Y') that alternate.

11. The downhole device as recited in claim 7, wherein ones of the first electromagnet assembly and the one or more additional electromagnet assemblies are separated by individual ferromagnetic rings.

12. The downhole device as recited in claim 1, wherein the electromagnet assembly is operable to receive electric power to produce the electromagnetic field having the electromagnetic polarity (Y), the electromagnetic field configured to linearly slide the bore flow management actuator from the first position toward the second position.

13. The downhole device as recited in claim 1, wherein the valve closure mechanism is a flapper-type valve configured to rotate between the closed state and the open state as the bore flow management actuator moves between the first position and the second position.

14. The downhole device as recited in claim 1, wherein the electromagnet assembly is located in a pocket in the first portion.

15. The downhole device as recited in claim 14, wherein the first portion further includes a fluid isolation sleeve separating the electromagnet assembly located in the pocket from the mechanical connecting apparatus.

16. The downhole device as recited in claim 15, wherein the fluid isolation sleeve is non-ferromagnetic.

17. The downhole device as recited in claim 15, wherein the fluid isolation sleeve is an axially fixed fluid isolation sleeve.

18. The downhole device as recited in claim 1, wherein the bore flow management actuator includes a bore flow management actuator profile and the mechanical connecting apparatus includes a downhole mechanical connecting apparatus profile, and further wherein the downhole mechanical connecting apparatus profile is configured to couple with the bore flow management actuator profile to axially couple the at least a portion of the bore flow management actuator and the mechanical connecting apparatus.

19. The downhole device as recited in claim 1, wherein the second portion and third portion are configured to be run-in-hole after the first portion.

20. The downhole device as recited in claim 19, wherein the third portion is configured to be run-in-hole after the second portion.

21. A method, comprising:

accessing a downhole device located within a wellbore extending through one or more subterranean formations, wherein the downhole device includes:

a first portion, the first portion including an electromagnet assembly coupled thereto, the first portion configured to be run-in-hole as part of wellbore tubing;

a second portion, the second portion including a valve closure mechanism and a bore flow management actuator, the bore flow management actuator configured to slide from a first position to a second position to move the valve closure mechanism between a closed state and an open state; and a third portion, the third portion including a mechanical connecting apparatus having a ferromagnet assembly coupled thereto, the mechanical connecting apparatus coupling with at least a portion of the bore flow management actuator; and supplying electric power to the electromagnet assembly to produce an electromagnetic field having an electromagnetic polarity (Y), the electromagnetic field magnetically engaging with the ferromagnet assembly to actuate the mechanical connecting apparatus a stroke distance (D) and slide the bore flow management actuator from the first position to the second position to move the valve closure mechanism between the closed state and the open state.

22. The method as recited in claim 21, wherein the electromagnetic field is configured to magnetically engage with the ferromagnet assembly to independently hold the bore flow management actuator at the second position.

23. The method as recited in claim 21, wherein the ferromagnet assembly is a permanent magnet assembly, the permanent magnet assembly producing an inherent magnetic field having a magnetic polarity (X), the permanent magnet assembly generating a magnetic coupling force that biases the bore flow management actuator toward the first position.

24. The method as recited in claim 23, wherein the magnetic coupling force and relative positions of the permanent magnet assembly and the electromagnet assembly along the stroke distance (D) are set such that a required electric power needed to generate an opposite electromagnetic coupling force greater than the magnetic coupling force to slide the bore flow management actuator decreases as the bore flow management actuator slides from the first position to the second position.

25. The method as recited in claim 24, further including a separate energy storage element coupled with the bore flow management actuator, the separate energy storage element generating a return force that biases the bore flow management actuator toward the first position.

26. The method as recited in claim 25, wherein the magnetic coupling force, the return force, and the relative positions of the permanent magnet assembly and the electromagnet assembly along the stroke distance (D) are set such that the required electric power needed to generate the opposite electromagnetic coupling force greater than the magnetic coupling force and the return force to slide the bore flow management actuator decreases as the bore flow management actuator slides from the first position to the second position.

27. The method as recited in claim 21, wherein the electromagnet assembly is a first electromagnet assembly having the electromagnetic polarity (Y) and the ferromagnet assembly is a first ferromagnet assembly, and further including:

one or more additional electromagnet assemblies coupled to the first portion sequentially toward the second portion, the one or more additional electromagnet assemblies operable to receive additional electric power and each produce additional electromagnetic fields that alternate between having a second electromagnetic polarity (Y') opposite the electromagnetic polarity (Y), and the electromagnetic polarity (Y); and one or more additional ferromagnet assemblies coupled to the mechanical connecting apparatus sequentially toward the second portion.

28. The method as recited in claim 27, wherein a combined number (n) of the first electromagnet assembly and the one or more additional electromagnet assemblies coupled to the first portion is greater than a combined number (m) of the first ferromagnet assembly and the one or more additional ferromagnet assemblies coupled to the mechanical connecting apparatus.

29. The method as recited in claim 28, wherein n=m+1.

30. The method as recited in claim 29, wherein the electric power and the additional electric power are a same electric power, and further wherein the first electromagnet assembly and the one or more additional electromagnet assemblies are wired in series to provide the electromagnetic polarity (Y) and second electromagnetic polarity (Y') that alternate.

31. The method as recited in claim 27, wherein ones of the first electromagnet assembly and the one or more additional electromagnet assemblies are separated by individual ferromagnetic rings.

32. The method as recited in claim 21, wherein the electromagnet assembly is operable to receive electric power to produce the electromagnetic field having the electromagnetic polarity (Y), the electromagnetic field configured to linearly slide the bore flow management actuator from the first position toward the second position.

33. The method as recited in claim 21, wherein the valve closure mechanism is a flapper-type valve configured to rotate between the closed state and the open state as the bore flow management actuator moves between the first position and the second position.

34. The method as recited in claim 21, wherein the electromagnet assembly is located in a pocket in the first portion.

35. The method as recited in claim 34, wherein the first portion further includes a fluid isolation sleeve separating the electromagnet assembly located in the pocket from the mechanical connecting apparatus.

36. The method as recited in claim 35, wherein the fluid isolation sleeve is non-ferromagnetic.

37. The method as recited in claim 35, wherein the fluid isolation sleeve is an axially fixed fluid isolation sleeve.

38. The method as recited in claim 21, wherein the bore flow management actuator includes a bore flow management actuator profile and the mechanical connecting apparatus includes a downhole mechanical connecting apparatus profile, and further wherein the downhole mechanical connecting apparatus profile is configured to couple with the bore flow management actuator profile to axially couple the at least a portion of the bore flow management actuator and the mechanical connecting apparatus.

39. The method as recited in claim 21, wherein the second portion and third portion are configured to be run-in-hole after the first portion.

40. The method as recited in claim 39, wherein the third portion is configured to be run-in-hole after the second portion.

41. The method as recited in claim 21, further including deploying the downhole device within the wellbore prior to accessing the downhole device.

42. The method as recited in claim 41, wherein at least a portion of the downhole device is a WLRSV, and further wherein deploying includes deploying using a wireline.

43. The method as recited in claim 41, wherein at least a portion of the downhole device is a TRSV, and further wherein deploying includes deploying at least a portion of the TRSV using a tubing string.

44. A well system, comprising:

a wellbore extending through one or more subterranean formations; and a downhole device located within the wellbore, the downhole device including:

a first portion, the first portion including an electromagnet assembly coupled thereto, the first portion configured to be run-in-hole as part of wellbore tubing;

a second portion, the second portion including a valve closure mechanism and a bore flow management actuator, the bore flow management actuator configured to slide from a first position to a second position to move the valve closure mechanism between a closed state and an open state; and a third portion, the third portion including a mechanical connecting apparatus having a ferromagnet assembly coupled thereto, the mechanical connecting apparatus configured to engage with at least a portion of the bore flow management actuator, the electromagnet assembly operable to receive electric power to produce an electromagnetic field having an electromagnetic polarity (Y), the electromagnetic field configured to magnetically engage with the ferromagnet assembly to actuate the mechanical connecting apparatus a stroke distance (D) and slide the bore flow management actuator from the first position to the second position to move the valve closure mechanism between the closed state and the open state.

* * * * *